US010100612B2

(12) United States Patent
Lisowski et al.

(10) Patent No.: US 10,100,612 B2
(45) Date of Patent: Oct. 16, 2018

(54) INDEXING DART SYSTEM AND METHOD FOR WELLBORE FLUID TREATMENT

(71) Applicant: PACKERS PLUS ENERGY SERVICES INC., Calgary (CA)

(72) Inventors: Trevor Nicholas Stanley Lisowski, Beaumont (CA); Brian Kenneth Stainthorpe, Cochrane (CA)

( * ) Notice: Subject to any disclaimer, the term of this patent is extended or adjusted under 35 U.S.C. 154(b) by 119 days.

(21) Appl. No.: 15/253,500

(22) Filed: Aug. 31, 2016

(65) Prior Publication Data

US 2017/0175488 A1 Jun. 22, 2017

Related U.S. Application Data

(60) Provisional application No. 62/270,518, filed on Dec. 21, 2015, provisional application No. 62/270,522, (Continued)

(51) Int. Cl.

| | |
|---|---|
| ***E21B 23/08*** | (2006.01) |
| ***E21B 34/14*** | (2006.01) |
| ***E21B 43/14*** | (2006.01) |
| ***E21B 34/10*** | (2006.01) |
| ***E21B 43/08*** | (2006.01) |
| ***E21B 43/12*** | (2006.01) |

(Continued)

(52) U.S. Cl.

CPC ..... *E21B 34/14* (2013.01); *E21B 23/08* (2013.01); *E21B 34/102* (2013.01); *E21B 43/08* (2013.01); *E21B 43/12* (2013.01); *E21B 43/14* (2013.01); *E21B 43/26* (2013.01); *E21B 43/267* (2013.01); *E21B 2034/007* (2013.01)

(58) Field of Classification Search

CPC ... E21B 34/14; E21B 34/102; E21B 2034/007
USPC ..... 166/318
See application file for complete search history.

(56) References Cited

U.S. PATENT DOCUMENTS

| | | | |
|---|---|---|---|
| 2,927,643 | A | 3/1960 | Dellinger |
| 3,263,752 | A | 8/1966 | Conrad |

(Continued)

FOREIGN PATENT DOCUMENTS

| | | |
|---|---|---|
| CA | 2735402 | 10/2011 |
| GB | 961901 | 6/1964 |

(Continued)

OTHER PUBLICATIONS

International Search Report and Written Opinion issued for PCT Patent Application No. PCT/CA2011/001133, dated Jan. 10, 2012, 8 pages.

(Continued)

*Primary Examiner* — Taras P Bemko

(57) ABSTRACT

A smart dart has a central bore and a collapsible annular protrusion extending radially outward from the dart body. The dart is deployed in a run-in configuration and actuated to a landing configuration to stop on a target seat identified by a control mechanism based on a seat count. The dart also includes a latch tool at a nose section and the central bore and the inner bore of the latch tool are aligned axially. A valve is installed in the central bore and a valve actuator closes the valve to seal the central bore for pressure isolating the wellbore downhole from the wellbore uphole the valve when the dart lands on the target seat.

16 Claims, 48 Drawing Sheets

Related U.S. Application Data filed on Dec. 21, 2015, provisional application No. 62/270,526, filed on Dec. 21, 2015, provisional application No. 62/270,528, filed on Dec. 21, 2015.

(51) Int. Cl.

| | |
|---|---|
| ***E21B 43/26*** | (2006.01) |
| ***E21B 43/267*** | (2006.01) |
| *E21B 34/00* | (2006.01) |

(56) References Cited

U.S. PATENT DOCUMENTS

| | | | |
|---|---|---|---|
| 4,590,995 | A | 5/1986 | Evans |
| 4,601,343 | A | 7/1986 | Lindsey, Jr. et al. |
| 5,012,865 | A | 5/1991 | McLeod |
| 5,197,547 | A | 3/1993 | Morgan |
| 6,189,618 | B1 | 2/2001 | Beeman |
| 6,189,619 | B1 | 2/2001 | Wyatt et al. |
| 6,220,363 | B1 | 4/2001 | Dallas |
| 6,343,649 | B1 | 2/2002 | Beck et al. |
| 6,662,877 | B2 | 12/2003 | Patel |
| 6,907,936 | B2 | 6/2005 | Fehr et al. |
| 7,207,384 | B2 | 4/2007 | Dallas et al. |
| 7,387,165 | B2 | 6/2008 | Lopez de Cardenas et al. |
| 7,543,634 | B2 | 6/2009 | Fehr et al. |
| 7,571,773 | B1 | 8/2009 | West et al. |
| 7,714,741 | B2 | 5/2010 | Snider et al. |
| 7,762,333 | B2 | 7/2010 | Themig et al. |
| 7,775,288 | B2 | 8/2010 | Hickie |
| 7,886,833 | B2 | 2/2011 | McGuire et al. |
| 7,926,571 | B2 | 4/2011 | Hofman |
| 8,136,585 | B2 | 3/2012 | Cherewyk |
| 8,302,678 | B2 | 11/2012 | Swagerty et al. |
| 8,403,068 | B2 | 3/2013 | Robinson et al. |
| 8,668,013 | B2 | 3/2014 | O'Connell et al. |
| 8,695,693 | B2 | 4/2014 | Nguyen et al. |
| 8,727,010 | B2 | 5/2014 | Turner et al. |
| 8,757,273 | B2 | 6/2014 | Themig et al. |
| 8,869,904 | B2 | 10/2014 | Jani |
| 9,683,419 | B2 | 6/2017 | Coon |
| 2006/0124310 | A1 | 6/2006 | Lopez de Cardenas |
| 2007/0044958 | A1 | 3/2007 | Rytlewski et al. |
| 2009/0044944 | A1 | 2/2009 | Murray et al. |
| 2010/0294515 | A1 | 11/2010 | Xu |
| 2011/0056692 | A1 | 3/2011 | Lopez de Cardenas et al. |
| 2011/0240301 | A1 | 10/2011 | Robison et al. |
| 2011/0278017 | A1 | 11/2011 | Themig et al. |
| 2012/0079827 | A1 | 4/2012 | Huang et al. |
| 2012/0085538 | A1 | 4/2012 | Guerrero |
| 2012/0325466 | A1 | 12/2012 | Themig |
| 2013/0118732 | A1 | 5/2013 | Chauffe et al. |
| 2013/0153237 | A1 | 6/2013 | McGuire |
| 2013/0206402 | A1 | 8/2013 | Coon |
| 2013/0220603 | A1 | 8/2013 | Robinson et al. |
| 2013/0264049 | A1 | 10/2013 | Mireles |
| 2013/0264056 | A1* | 10/2013 | Stout ..... E21B 43/261 166/281 |
| 2013/0299199 | A1 | 11/2013 | Naedler et al. |
| 2014/0020900 | A1 | 1/2014 | Nguyen et al. |
| 2014/0076542 | A1 | 3/2014 | Whitsitt et al. |
| 2014/0246207 | A1 | 9/2014 | Hofman et al. |

FOREIGN PATENT DOCUMENTS

| | | |
|---|---|---|
| GB | 2421745 | 7/2006 |
| WO | WO 2001073423 | 10/2001 |
| WO | WO 2009098512 | 8/2009 |
| WO | WO 2011146866 | 11/2011 |

OTHER PUBLICATIONS

International Preliminary Report on Patentability issued for PCT Patent Application No. PCT/CA2011/001133, dated Apr. 9, 2013, 6 pages.

Office Action issued for U.S. Appl. No. 13/877,739, dated Sep. 22, 2015, 14 pages.

European Search Report issued for European Patent Application No. 11830162.1, dated Nov. 27, 2015, 6 pages.

Office Action issued for U.S. Appl. No. 13/877,739, dated Mar. 18, 2016, 12 pages.

Dictionary Definition, Merriam Webster: "contact" at http://www.meriam-webster.com/dictionary/contact.

Office Action issued for U.S. Appl. No. 13/877,739, dated Jul. 7, 2016, 15 pages.

Office Action issued for U.S. Appl. No. 13/877,739, dated Oct. 26, 2016, 12 pages.

Notice of Allowance issued for U.S. Appl. No. 13/877,739, dated Feb. 6, 2017, 5 pages.

Bennet et al. "Design Methodology for Selection of Horizontal Open-Hole Sand Control Completions Supported by Filed Case Histories," Copyright 2000, Society of Petroleum Engineers, Inc., 19 pages.

Ott, "Selection and Design Criteria for Sand Control Screens," SPE Distinguished Lecturer Series, SPE International, 2008, 33 pages.

Tiffin et al., "New Criteria for Gravel and Screen Selection for Sand Control," Copyright 1998, Society of Petroleum Engineers, Inc., 14 pages.

Ott et al., "Sandface Conpletions Guide," Jun. 2006, 1 page.

"Sand Control" [retrieved on Jan. 20, 2016 from <<http://petrowiki.org/Sand-control>>], 5 pages.

Ott et al., "Modern Sandface Completion Practices Handbook," World Oil magazine, Gulf Puyclishing Company, Houston, TX, 109 pages.

"Slotted Liners and Wire Wrapped Screens," [retrieved on Jan. 15, 2016 from <<http://petrowiki.org/Slotted_liners_and_wiere_wrapped_screens>>], 8 pages.

* cited by examiner

INDEXING DART SYSTEM AND METHOD FOR WELLBORE FLUID TREATMENT

RELATED APPLICATIONS

This application claims the benefit of priority under 35 U.S.C. § 119 of United States Provisional Patent Application No. 62/270,518, entitled "Indexing Dart System and Method For Wellbore Fluid Treatment," filed Dec. 21, 2015, U.S. Provisional Patent Application No. 62/270,522, entitled "Wellbore Sleeve Assembly With Screen," filed Dec. 21, 2015, U.S. Provisional Patent Application No. 62/270,526, entitled "Indexing Smart Dart," filed Dec. 21, 2015 and U.S. Provisional Patent Application No. 62/270,528, entitled "Recoverable Wellbore Dart," filed Dec. 21, 2015, each of which are incorporated by reference herein in their entireties.

TECHNICAL FIELD

The present application relates to an apparatus and method for wellbore tools and more particularly to actuation darts for actuation of wellbore tools, sleeve assemblies and wellbore treatment apparatus and methods relating thereto.

BACKGROUND

A number of oil and gas wellbore operations are implemented using a tubing string inserted in the wellbore. In some cases, the tubing string may include tools activated by a ball conveyed to the tool from the surface. These ball-activated tools typically include a ball seat on which the ball can land to create a seal so that pressure can be increased above the ball to actuate the tool.

A tubing string may use a number of these ball-activated tools in series. For example, well treatment strings for staged well treatment operations such as hydraulic fracturing often include a series of ball-activated sliding sleeves that can be individually activated to stimulate isolated portions of a wellbore. In these ball-activated systems, each sliding sleeve valve defines a ball seat designed to seat a ball of particular size, but allow smaller balls to pass through the seat. The ball seat diameters are graduated such that the ball seat closest to the surface has the largest diameter and the ball seat furthest down the well has the smallest diameter.

To activate a selected ball-activated sliding sleeve valve in such systems, the operator launches a ball having the appropriate size to seat at the selected valve. The ball passes through ball seats above the selected valve, but seats at the selected valve because the ball is too large to pass through the selected valve's ball seat. The operator can then increase pressure above the seated ball to actuate the selected valve. The operator continues to launch balls of progressively larger size and increase pressure in the string to actuate the sliding sleeve valves up the string. While these ball-activated sliding sleeve valve systems provide some significant benefits over prior systems, there are also some limitations in these systems.

Furthermore, the number of ball-activated stages that can be used within a tubing string in series is limited by the need to size the balls and ball seats appropriately. Indeed, as a practical matter, manufacturing tolerances of the balls and ball seats require that each ball/ball seat be of a sufficiently different size from others in the string to ensure that the wrong ball cannot seat in a ball seat. Moreover, as ball seat diameter decreases the flow restriction through the ball seat increases. Eventually, the flow restriction becomes so large that it becomes impractical to include additional ball-activated tools. These design and manufacturing considerations effectively limit the number of ball-activated tools that can be used in series for a given diameter tube string.

Furthermore, since a ball will block a portion of a tubing string inner bore after it is used to actuate a sliding sleeve valve, the continued presence of the ball may adversely affect subsequent operations such as shifting previously opened sleeves and back flowing production fluids. In certain circumstances the balls can be flowed back to the surface by flowing fluids up the well. However, the lifting forces of the fluid may be inadequate to carry the balls to surface. For this reason, among others, operators may be required to mill the balls in order to remove them from the tubing string. In addition, the operators may also be required to mill out the ball seats to remove the flow restrictions caused by the seats. Milling out items within a tubing string can be time consuming and costly.

Plugs that can be retrieved by retrieval tools rather than back flowing or milling have been proposed. These plugs suffer their own limitations however. Some conventional tool retrievable plugs are set using a setting line. Thus, the plugs must be run in tethered to a wireline, slickline or other setting line.

Moreover, after the plug is set, debris or other materials, for example proppant, may accumulate on top of the plug, which may make it difficult or even impossible to latch onto the plug for retrieval. The debris or other materials may also accumulate in the annular region between the plug and casing and may interfere with release of the plug.

One result of stimulation is that the return fluids (e.g., stimulation fluid, production fluid, etc.) may include proppant and other debris. It may be desirable in certain circumstances to screen the return fluid to prevent the proppant and other debris from flowing back into the tubing string. In some conventional systems, this involves providing a second set of "production ports" along the tubing string that are screened so that the return fluids can enter the tubing string through the screened ports and not the stimulation ports through which the stimulation fluid was injected into the formation.

These conventional systems suffer a number of limitations. As one disadvantage, these systems typically require the use of relatively complex tubing string components that include mechanisms to keep the screened ports fully closed during stimulation—otherwise, the proppant in the stimulation fluids would damage the screens due to the relatively high pressures used during stimulation—but allow the screened ports to be opened and the stimulation ports to be closed after stimulation. As another disadvantage, components providing both stimulation ports and screened ports must be relatively long to accommodate the extra set of ports.

SUMMARY

According to one broad aspect of the present disclosure, a dart configured to target a location in a wellbore is provided. The dart may comprise a body conveyable through a tubing string, the body defining a central flow bore from an upper end to a lower end of the wellbore dart where the central flow bore is adapted to allow circulation of fluid from a tool through the wellbore dart. The dart may include an internal valve to seal the central flow bore and a valve actuator movable from a first actuator position to a valve open position to selectively open the internal valve. The dart may further include a collapsible annular protrusion extending radially outward from the body, the collapsible annular protrusion being configurable between a run in configuration and a landing configuration. The dart may further include a control mechanism further comprising an indexing mechanism, the indexing mechanism configured to register a dart seat count responsive to dart seat contact and the control mechanism configured to switch the dart between the run in configuration and landing configuration responsive to the indexing mechanism registering a target number of counts.

According to one embodiment, the dart comprises a mandrel that at least partially defines the central flow bore. The indexing mechanism may be disposed on the outside of the mandrel.

The dart may further comprise a locking mechanism operatively coupled to the indexing mechanism, wherein the locking mechanism is configured to lock the annular protrusion in an extended position in the landing configuration and wherein the indexing mechanism is configured to activate the locking mechanism responsive to registering the target number of counts.

The indexing mechanism, in one embodiment, comprises a longitudinally reciprocating sleeve operatively coupled to the annular protrusion, the reciprocating sleeve configured to actuate responsive to movement of the annular protrusion in a first direction to register a dart seat, to move the annular protrusion in a second direction and to follow at least one guide slot.

The dart may further comprise a disengagement mechanism configured to disengage the annular protrusion.

In one embodiment, the central flow bore comprises a central flow bore upper portion proximate to an upper opening. The central flow bore upper portion may have a lower opening with a smaller diameter than the upper opening. The central flow bore upper portion may define a recovery tool receiving area having a shape adapted to receive a tool nose. The central flow bore may include a central flow bore second portion extending forward from the upper portion of the central bore. The second portion may be adapted to receive a latch tool extending from the tool nose.

The wellbore dart may further comprise a latch keeper feature defined in the second portion of the central flow bore.

The wellbore dart may be adapted to form a string of darts with at least one other dart. The string of darts can comprise a central flow passage through the string of darts through which fluid can be circulated.

According to another aspect of the present disclosure, a system for treatment of a borehole is provided. The system may include a tubing string having a long axis and comprising a plurality of sleeve assemblies spaced apart along the long axis; a set of indexing darts and a dart launcher coupled to the tubing string adapted to launch the set of indexing darts down the tubing string.

According to one embodiment, each indexing dart defines a central fluid flow bore and each indexing dart comprises an engagement feature for engaging one of the plurality of sleeve assemblies. Each indexing dart further comprises an indexing mechanism to define which of the plurality of sleeve assemblies with which the indexing dart will engage.

The set of indexing darts can be adapted to form a dart string. According to one embodiment, the set of indexing darts comprises a first indexing dart and a second indexing dart, the second indexing dart comprise a latch tool configured to engage the first indexing dart. The first indexing dart and second indexing dart can be configured to cooperatively form a continuous central flow passage, through which fluid can be circulated from a recovery tool. The second indexing dart may be configured to activate a disengagement mechanism of the first indexing dart.

According to another broad aspect of the present disclosure, embodiments provide a wellbore sliding sleeve assembly. The wellbore sliding sleeve assembly comprises a tubular body comprising an outer wall defining a port through the outer wall and a port sleeve assembly configurable in a port-closed configuration in which the port through the outer wall is blocked, a port-open configuration in which the port through the outer wall is fully open to fluid flow therethrough and a port-screened configuration in which the port through the outer wall is open and covered with a screen. In one embodiment, the screen may be disposed radially inward of the outer wall in the port-screened configuration.

The port sleeve assembly may comprise a screen sleeve comprising a screened port positioned to align with the port through the outer wall when in the port-screened configuration and a port cover sleeve comprising a port cover adapted to cover the port through the outer wall when in the port-closed configuration. The screen sleeve can be adapted to be movable from a screen sleeve first position in which screened port aligns with the port through the outer wall to a screen sleeve second position in which the screened port does not align with the port through the outer wall. The screen sleeve second position can correspond to the port-closed and port-screened configurations.

The port cover sleeve can be adapted to be movable from a port cover sleeve first position in which the port cover is aligned with the port through the outer wall to a port cover sleeve second position in which the port cover is not aligned with the port through the outer wall.

According to one embodiment, in the port-closed configuration, the screen sleeve is in the screen sleeve first position and the port cover sleeve is in the port cover sleeve first position; in the port-open configuration, the screen sleeve is in the screen sleeve second position and the port cover sleeve is in the port cover sleeve second position; and in the port-screened configuration, the screen sleeve is in the screen sleeve first position and the port cover sleeve is in the port cover sleeve second position.

The screen sleeve may be concentrically arranged about the port cover sleeve. According to one embodiment, the port cover sleeve is adapted such that the port cover closes to a radially inner side of the screen sleeve. The port cover sleeve can cooperate with seals between the port cover sleeve and the screen sleeve and seals between the screen sleeve and the outer wall to seal the port through the outer wall.

A wellbore sliding sleeve method may comprise running a sliding sleeve assembly into a well in a port-closed configuration; actuating a port sleeve assembly in the sliding sleeve assembly to open a stimulation port at the sliding sleeve assembly; injecting stimulation fluid into an annulus through the stimulation port; reconfiguring the port sleeve assembly to cover the stimulation port with a screen; and using the stimulation port as a production port. The method may further comprise reclosing the stimulation port with the port sleeve assembly.

BRIEF DESCRIPTION OF THE DRAWINGS

The drawings accompanying and forming part of this specification are included to depict certain aspects of the invention. A clearer impression of the invention, and of the components and operation of systems provided with the invention, will become more readily apparent by referring to the exemplary, and therefore non-limiting, embodiments illustrated in the drawings, wherein identical reference numerals designate the same components. Note that the features illustrated in the drawings are not necessarily drawn to scale.

DETAILED DESCRIPTION

Figure 1A:
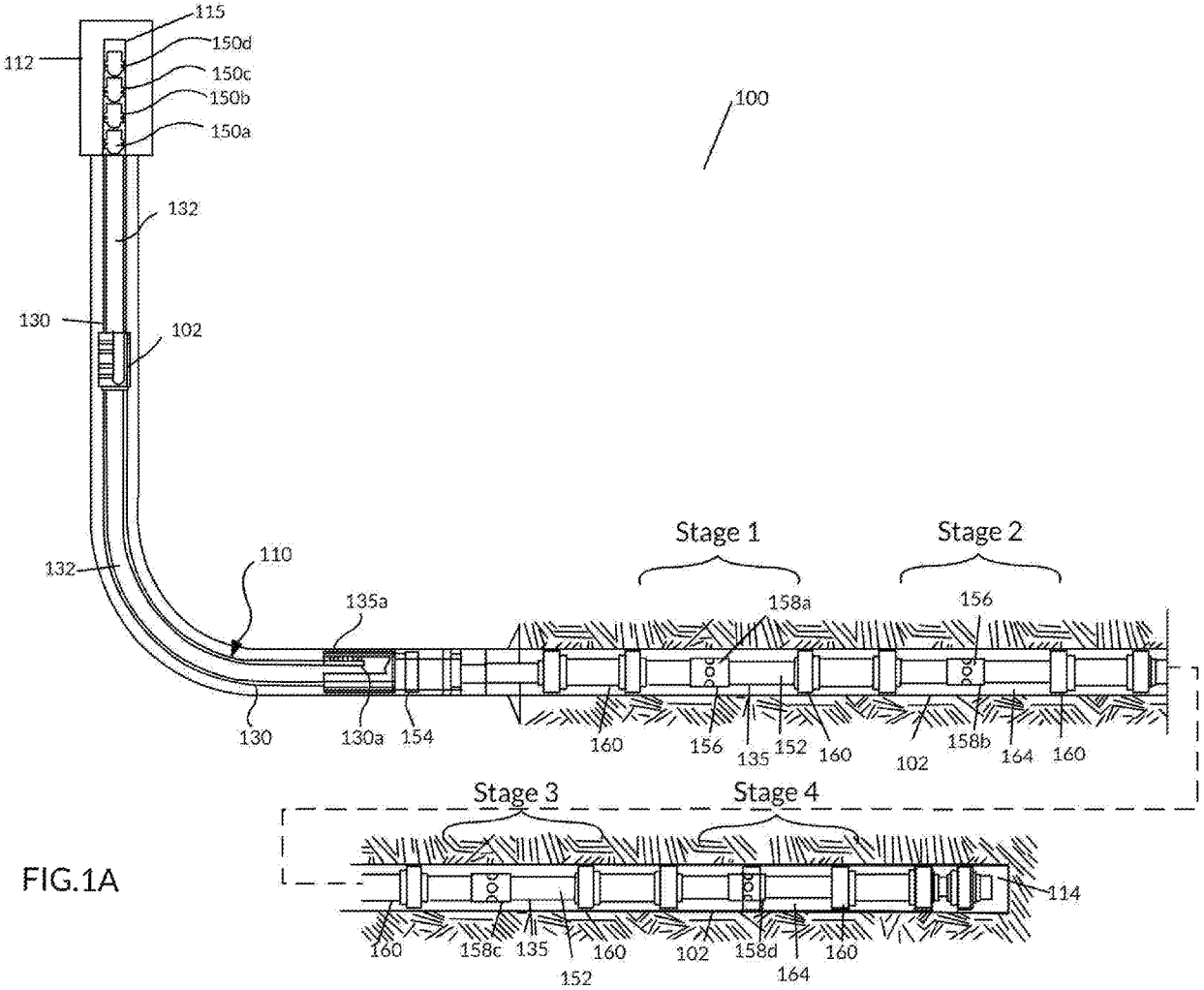
FIGS. 1A-1G depict one embodiment of a wellbore system for performing operations in a wellbore.

This disclosure and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure the disclosure in detail. Skilled artisans should understand, however, that the detailed description and the specific examples, while disclosing preferred embodiments, are given by way of illustration only and not by way of limitation. Various substitutions, modifications, additions or rearrangements within the scope of the underlying inventive concept(s) will become apparent to those skilled in the art after reading this disclosure.

Embodiments described herein provide a dart that can be targeted to specific locations in a wellbore (such dart referred to herein as a "dart," "indexing dart" or "smart dart"). The indexing dart may have a number of configurations including, for example, a "run in" configuration in which the indexing dart can pass through seats in a tubing string and a landing configuration in which an engagement feature is activated to engage the indexing dart with a dart seat. The landing configuration may be a "locked out" configuration in which an annular protrusion that gives the indexing dart a larger effective outer diameter than the dart seat's inner diameter is locked in an extended position so that the indexing dart can engage a dart seat. The ability to allow the dart to be seated in a particular dart seat makes the dart "smart" because the indexing mechanism tracks how many dart seats the dart has passed through in order to engage the indexing dart with a particular dart seat.

More particularly, the indexing dart may have a selective engagement mechanism that can be configured such that the smart dart changes between the run in configuration and the landing configuration at the occurrence of a particular event. For example, in one embodiment, the selective engagement mechanism may include a control mechanism that counts the number of stages the indexing dart has passed through and, responsive to reaching a particular target dart seat count, activates the engagement feature to engage the smart dart at a particular target seat.

In one embodiment, the selective engagement mechanism can include an indexing mechanism that is responsive to contact with seats or other features of a tubing string to register a dart seat or other feature. The indexing mechanism may register a dart seat by changing states as the indexing dart passes through or by each dart seat. In one embodiment, the indexing mechanism may have a reciprocating sleeve that actuates in response to contact with mechanical feature (e.g., features within a sleeve or tools) in the tubing string. A guide member provides one or more guide slots to induce angular displacement of the reciprocating sleeve about the dart's longitudinal axis as the sleeve actuates. In such an embodiment, the total angular displacement of the reciprocating sleeve (or a portion thereof) from a beginning position can depend on the number of dart seats the indexing dart registers as having passed through in the tubing string. The indexing mechanism can be operatively coupled to an engagement feature such that the indexing mechanism activates the engagement feature when a particular number of dart seats have registered.

In one embodiment, the reciprocating sleeve of the indexing mechanism may include upper and lower indexing sleeves, each of which follows different guide slots. The upper and lower indexing sleeves may rotate independently. The indexing mechanism can be configured so that, when the sleeves achieve a particular angular orientation relative to each other, the two indexing sleeves separate. Separation of the indexing sleeves can initiate a transition to the landing configuration.

The guide slots can be configured so that the upper and lower indexing sleeves rotate different amounts during translation. More particularly, the guide slots may be configured to achieve a desired relative angular displacement between the upper and lower indexing sleeves during longitudinal translation so that the indexing sleeves continually change angular orientation relative to each other as the index mechanism is triggered until the indexing sleeves reach a separation orientation in which they can separate.

One advantage of the indexing dart is that the engagement mechanism can be configured to provide the ability to activate a significant range of stages in a tubing string, including as few as two stages to relatively high maximum stage counts (up to and in excess of 60-90 stages for example). The stage count limit may be based, in some cases, on the relative angular displacement between the indexing sleeves.

Embodiments of the indexing dart have a robust mechanical design that is stable across pressures and capable of operating at high pressures including, but not limited to, pressures greater than 15,000 psi. Indexing darts can be used as actuation mechanisms, plugs, tool delivery and for other purposes and uses within the wellbore. Another advantage of particular embodiments is that the indexing mechanism can be carried on the radially outer side of a mandrel. Consequently, the area within the mandrel may be kept open to provide a fluid flow bore, carry tools, etc. Indexing darts and corresponding tools may be used a variety of wellbore configuration including, open hole, cemented, vertical, horizontal, multilateral, steam assisted gravity drainage (SAGD), high pressure high temperature (HPHT), monobore and other configurations.

Embodiments described herein also provide a wellbore dart that, after fulfilling its purpose in the well, can be moved to a location where the dart does not restrict further operations. According to one embodiment, the wellbore dart includes a disengagement mechanism so that the dart may be disengaged from the tool in the wellbore at which the dart landed so that the dart can be moved. The dart may include features with which a recovery tool can engage so that a recovery tool can be run in to move the retrievable dart. In certain embodiments, a dart can include a latch tool so that each dart can be pushed onto and engage the next dart to create a string of darts, where the string of darts can be pushed down the well or pulled back to surface (allowing multiple darts to be recovered in a single run-in operation).

According to one embodiment, the dart can be configured so that the recovery tool can circulate fluid through the dart to clear dunes or other debris that may impede progress of the dart as the dart is moved. For example, the dart may include a fluid flow bore through the dart to provide a flow passage through which the fluid can be circulated. The flow bore of a dart can be configured so that, when multiple darts are pushed together in a dart string, the flow bores of the individual darts in the string create a continuous flow passage through the string of darts. Thus, in one embodiment, fluid can be circulated through the string.

An internal valve can be provided to seal a flow bore through the dart, allowing the dart to be used as a plug. A dart may include a valve actuator so that the valve can be selectively opened to allow circulation of fluid through the dart. According to one embodiment, the valve actuator may be activated by the recovery tool or another dart.

Embodiments described herein provide a number of advantages. According to one embodiment, the dart may have an internal bore that is shaped to promote clearing of debris that may have accumulated on top of the dart. Furthermore, the internal bore may provide a fluid flow passage that allows fluid to be circulated through the dart so that proppant or other debris can be cleared from below or around the dart.

As another advantage, some embodiments can be configured so that darts may be recovered in a dart string, allowing multiple darts to be recovered in a single run-in operation.

As another advantage, a recoverable smart dart can be run in to a target location untethered. That is, embodiments can be run in without being attached to a wireline, slick line or other setting line because the control mechanism autonomously changes the dart from a run in configuration to a landing configuration without requiring the application of force or electronic signals from the surface.

Embodiments described herein further provide a system that can utilizes a set of darts configurable to target specific locations in a wellbore (such darts are referred to herein as a "dart" or "indexing dart") in order to perform a number of functions, including hydraulic fracturing operations. One embodiment of the indexing dart system includes a plurality of sleeve assemblies (e.g., dart actuated frac port sleeve assemblies) spaced apart along the tubing string and a set of indexing darts that can be configured to land (i.e., engage) at any of the plurality of sleeve assemblies. The system can also include a dart launcher coupled to the tubing string to launch the indexing darts down the tubing string, where each indexing dart is configured to land at the particular target sleeve assembly (e.g., to allow hydraulic fracturing, deliver a tool to a location in the wellbore or for other purposes). The indexing darts of the system can also include features to facilitate recovery of the darts, including a disengagement mechanism to unlock the indexing dart so that the indexing dart may be disengaged from a sleeve assembly and pulled to surface and captured by a dart trap. In another embodiment, a recovery tool can be run in to recover the indexing darts by connecting to a feature on the indexing darts. In certain embodiments, each indexing dart can include a latch tool so that each dart can be pushed onto and disengage the next dart to create a string of indexing darts, where the string of indexing darts can be pulled back to surface (allowing multiple indexing darts to be recovered in a single run-in operation).

In one embodiment, the dart/sleeve combination used in the system can allow for the same type/configuration of indexing dart to be targeted at any of the sleeve assemblies in the tubing string without the need for a specially sized indexing dart or sleeve assembly (e.g., the sleeve assemblies can have internal dart seats having the same or substantially similar diameters). In contrast to ball-activated systems that require graduated diameter balls and ball seats specifically designed for a particular diameter ball, identically or substantially similar indexing darts and sleeve assemblies can be used with one another throughout the tubing string. Accordingly, the number of sleeve assemblies (or other tools incorporating a dart seat) that can be activated in the tubing string is not limited by decreasingly sized dart seats and a significant number of consecutive sleeve assemblies can be used along a tubing string as desired by the operator. For example, according to one embodiment, an identical (or substantially similar) sleeve assembly can be run on every joint of casing in a liner system and can be engaged by any one of a set of identical (or substantially similar) indexing darts.

Moreover, the indexing mechanism of the system can reside entirely on the indexing darts, obviating the need for complex (or any) mechanics on the sleeve assembly. Furthermore, the sleeve assemblies can be adapted to retain the full bore with only minimal restriction, providing better conductivity and ability to pump at higher rates than traditional ball-activated systems. Embodiments therefore more easily achieve maximum frac rates along the entire well and increase the frac length.

The dart launcher of the system can include a magazine of preconfigured indexing darts so that darts can be launched in the proper order. Moreover, in one embodiment, the dart launcher can be adapted so that high pressure seals do not have to be broken to launch multiple indexing darts. Therefore, indexing darts can be launched in order in a continuous fracturing operation.

Each indexing dart used with the system can also include a fluid flow bore through the indexing dart to provide a passage through which fluid can be circulated. The circulating fluid can be used to clear dunes or other debris in a tubing string that may impede progress of the indexing dart. The flow bores of each indexing dart can be configured so that they create a continuous flow bore through a string of indexing darts. Thus, fluid can still be circulated through the darts when multiple indexing darts are deployed within the tubing string or are being recovered at one time.

Indexing darts may include a variety of tools. In one embodiment, indexing darts may carry sensor packages (e.g., within the dart, to the rear of the dart, carried on the nose of the dart, etc.) containing one or more acoustic sensors, pressure sensors, temperature sensors, flow meters, seismic monitors, or other sensors. For example, in one embodiment, a dart can include pressure sensors above and below a sealing element of the dart so that pressure above and below the dart can be determined. In some cases, the pressure data may be used to determine flow through the dart. Data from the sensors may be communicated to the surface via wireless transmitter, pulse technology, wireline or other mechanism. Data may be sent back intermittently or in real time. In another embodiment, the darts may include an onboard memory that can store data. The stored data can be read when the darts are recovered to surface.

According to one embodiment, multiple darts that include acoustic sensors, seismic sensors or other sensors can be conveyed down the well so that data can be acquired at multiple locations in the well. The data from sensors at different locations in the well can be used to triangulate where fractures are occurring or for other purposes. Data from the darts can also be used to model where fractures are occurring, how long the fractures are, fracture direction, etc.

Embodiments described herein provide sliding sleeve assemblies in which ports can be selectively screened. One embodiment of a sliding sleeve assembly includes a tubular body comprising an outer wall that has ports through the outer wall. A port sleeve assembly disposed in the tubular body is configurable in a port-closed configuration in which the ports through the outer wall are blocked, a port-open configuration in which the ports through the outer wall are open to fluid flow therethrough and a port-screened configuration in which the port through the outer wall is open, but covered with a screen.

According to one embodiment, the port sleeve assembly comprises a concentrically arranged port cover sleeve and screen sleeve. The screen sleeve includes a screened port positioned to align with the port through the outer wall when the port sleeve assembly is in the port-screened configuration. The screened port may also align with the port through the outer wall in the port-closed configuration. The screen sleeve can be adapted to be movable from a screen sleeve first position in which screened port aligns with the port through the outer wall to a screen sleeve second position in which the screened port does not align with the port through the outer wall.

The port cover sleeve can comprise a port cover adapted to cover the outer port in the port-closed configuration. In one embodiment, the port cover closes to the radially inner side of the screen sleeve. The port cover may cooperate with seals between the port cover sleeve and the screen sleeve and seals between the screen sleeve and the outer wall to seal the outer port. The port cover sleeve may be adapted to be movable from a port cover sleeve first position in which the port cover is aligned with the outer port to a port cover sleeve second position in which the port cover is not aligned with the outer port.

According to one embodiment, in the port-closed configuration, the screen sleeve is in the screen sleeve first position and the port cover sleeve is in the port cover sleeve first position; in the port-open configuration, the screen sleeve is in the screen sleeve second position and the port cover sleeve is in the port cover sleeve second position; and in the port-screened configuration, the screen sleeve is in the screen sleeve first position and the port cover sleeve is in the port cover sleeve second position.

Embodiments described herein also provide a wellbore treatment method comprising: running a sliding sleeve assembly into a well in a port-closed configuration; opening a stimulation port at the sliding sleeve assembly; injecting stimulation fluid into an annulus through the stimulation port; covering the stimulation port with a screen; and using the stimulation port as a production port. The method can further include reclosing the stimulation port. In one embodiment, a port sleeve assembly is actuated to open the stimulation port and reconfigured to screen the stimulation port. The stimulation port may also be closed by the port sleeve assembly.

Embodiments described herein provide a sliding sleeve assembly that allows the same ports to be used as stimulation ports and screened production ports. Furthermore, Embodiments provide a sliding sleeve assembly that can be fully closed after production.

Darts and corresponding tools may be used a variety of wellbore configuration including, open hole, cemented, vertical, horizontal, multilateral, team assisted gravity drainage (SAGD), high pressure high temperature (HPHT), monobore and other configurations.

Before proceeding further, it should be noted that, at least with respect to an indexing dart, terms "upper", "back", "rear" are used to refer to a being on or closer to the surface side (upwell side) of the indexing dart relative to a corresponding feature that is "lower", "forward", "front" features. For example, an "upper" sleeve of an indexing dart generally refers to the feature relatively closer to back the indexing dart (surface side of the dart) than a corresponding "lower" sleeve. However, both or neither of the "upper" and "lower" sleeves may be on the "upper" half of the indexing dart. A feature may be referred to as an "upper" feature relative to a "lower" feature even if the features are aligned as may occur in a horizontal well.

Referring to FIG. 1A, an embodiment of a wellbore fluid treatment system 100 used to effect fluid treatment of a formation through wellbore 102 (or borehole) is shown. Wellbore treatment system 100 includes a tubing string 110 extending along a long axis from surface equipment 112 to a lower end 114. A series of sleeve assemblies 158 (e.g., sleeve assemblies 158*a* to 158*d*) are spaced along the long axis of tubing string 110. Surface equipment 112 includes a dart launcher 115 to launch indexing darts 150 (e.g., darts 150*a* to 150*d*) configured to engage the sleeve assemblies 158. In certain embodiments, dart launcher 115 may also act as a dart trap to catch darts conveyed back up tubing string 110.

According to one embodiment, each sleeve assembly 158 includes an internal sliding sleeve that is adapted to provide a dart seat on which an indexing dart 150 can land and, in certain embodiments, seal at the engagement between the indexing dart and the sleeve assembly. Pressure can be applied through tubing string 110 from the surface to create a pressure differential across a seated and sealed indexing dart, which drives the sleeve assembly against which the indexing dart is engaged toward the low pressure side, causing the respective ports 156 to open (e.g., to allow hydraulic fracturing of a formation). The sleeve assemblies 158 may include a screen (e.g., as described in FIG. 13 below) that can be closed to prevent proppant from falling back into tubing string 110 through the respective ports after a hydraulic fracturing operation.

Each indexing dart 150 can be configurable to land in any of sleeve assemblies 158 (or other dart seat). Dart launcher 115 can launch indexing darts 150 targeted at specific sleeve assemblies 158 into tubing string 110 in a deepest-to-closest order. For example, as illustrated in FIG. 1A-1D, indexing dart 150*a* targeting sleeve assembly 150*d* can be launched first (and engaged with sleeve assembly 150*d*), indexing dart 150*b* targeting sleeve assembly 158*c* launched next (and engaged with sleeve assembly 158*c*), and so on. In some embodiments, indexing darts 150 may be loaded and launched one at a time. In another embodiment, dart launcher 115 can include a magazine that stores multiple pre-configured indexing darts 150 where each indexing dart 150 in the magazine is configured to land at a different sleeve assembly 158. Dart launcher 115 can be controlled to launch each indexing dart 150 from the magazine as needed or as desired by the operator.

Figure 1B:
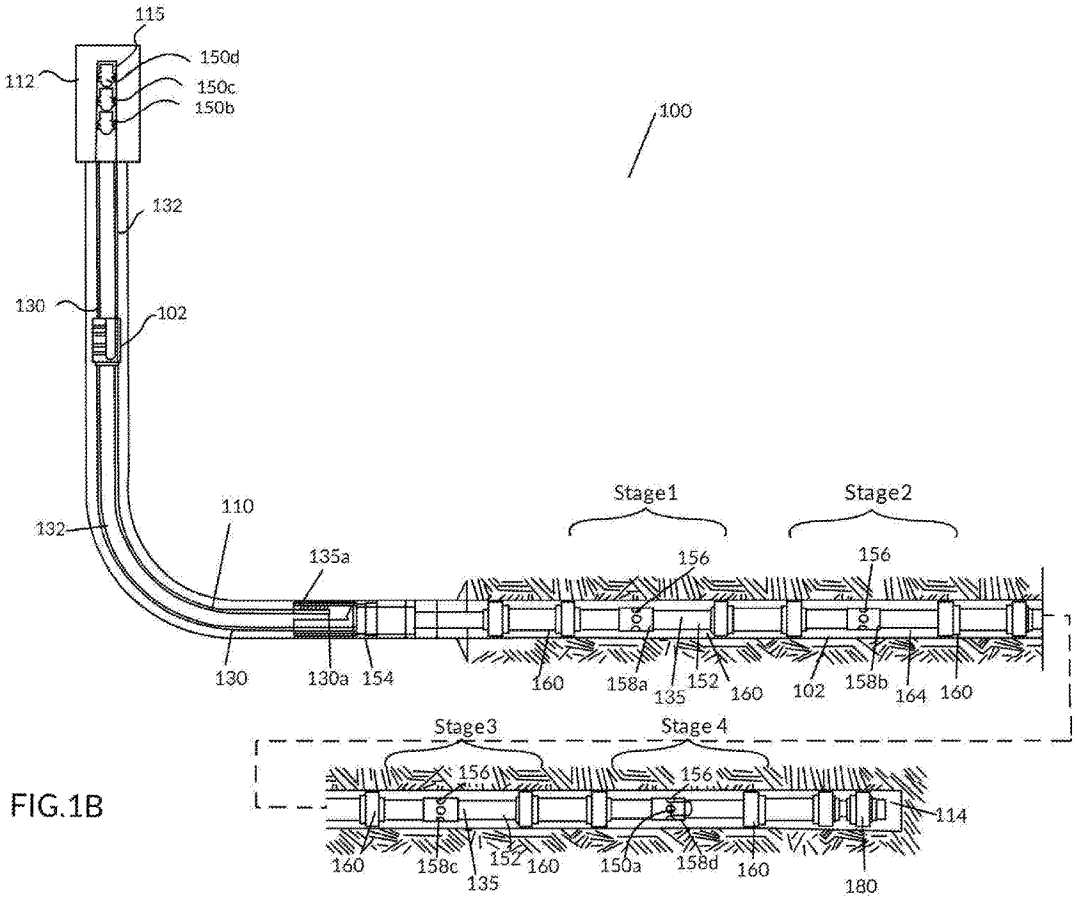
Figure 1C:
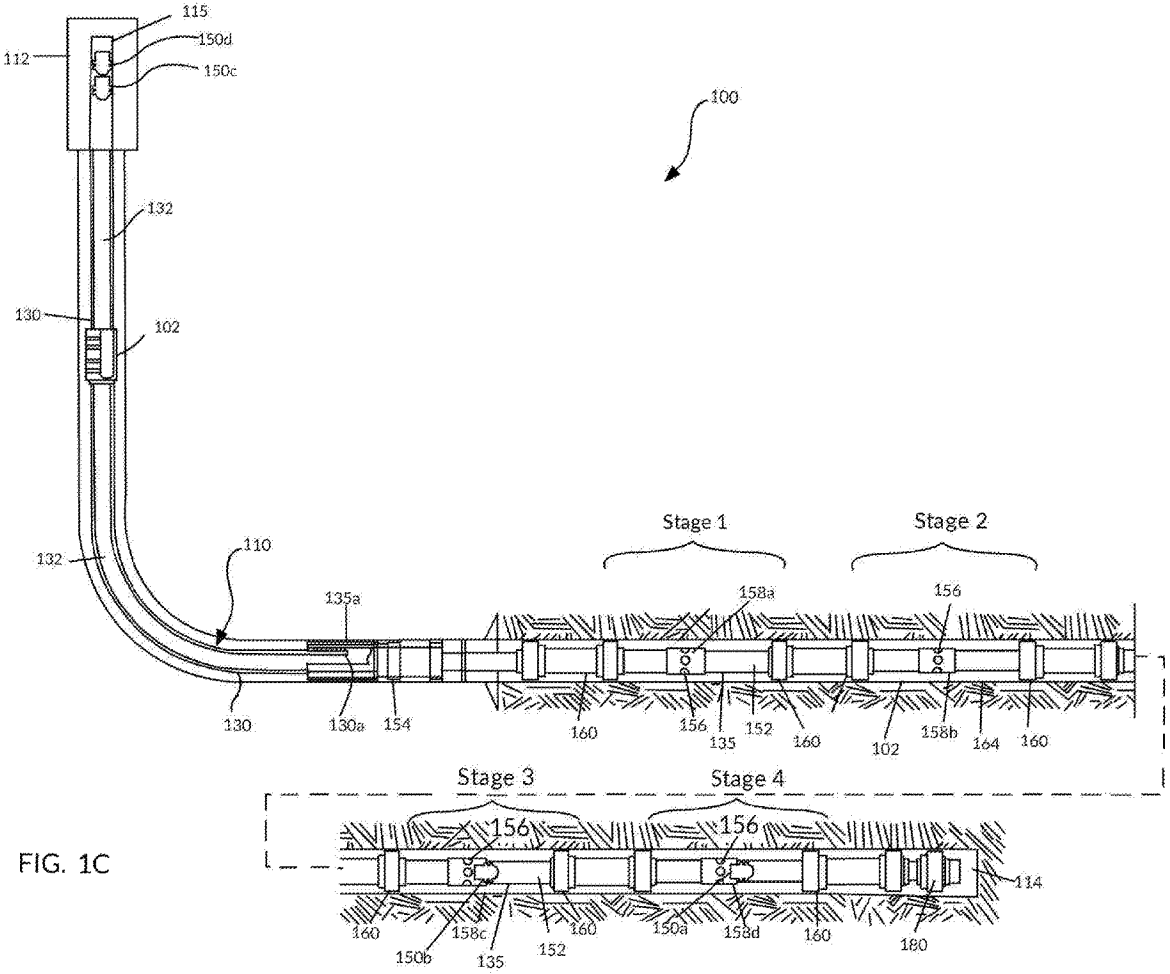
Figure 1D:
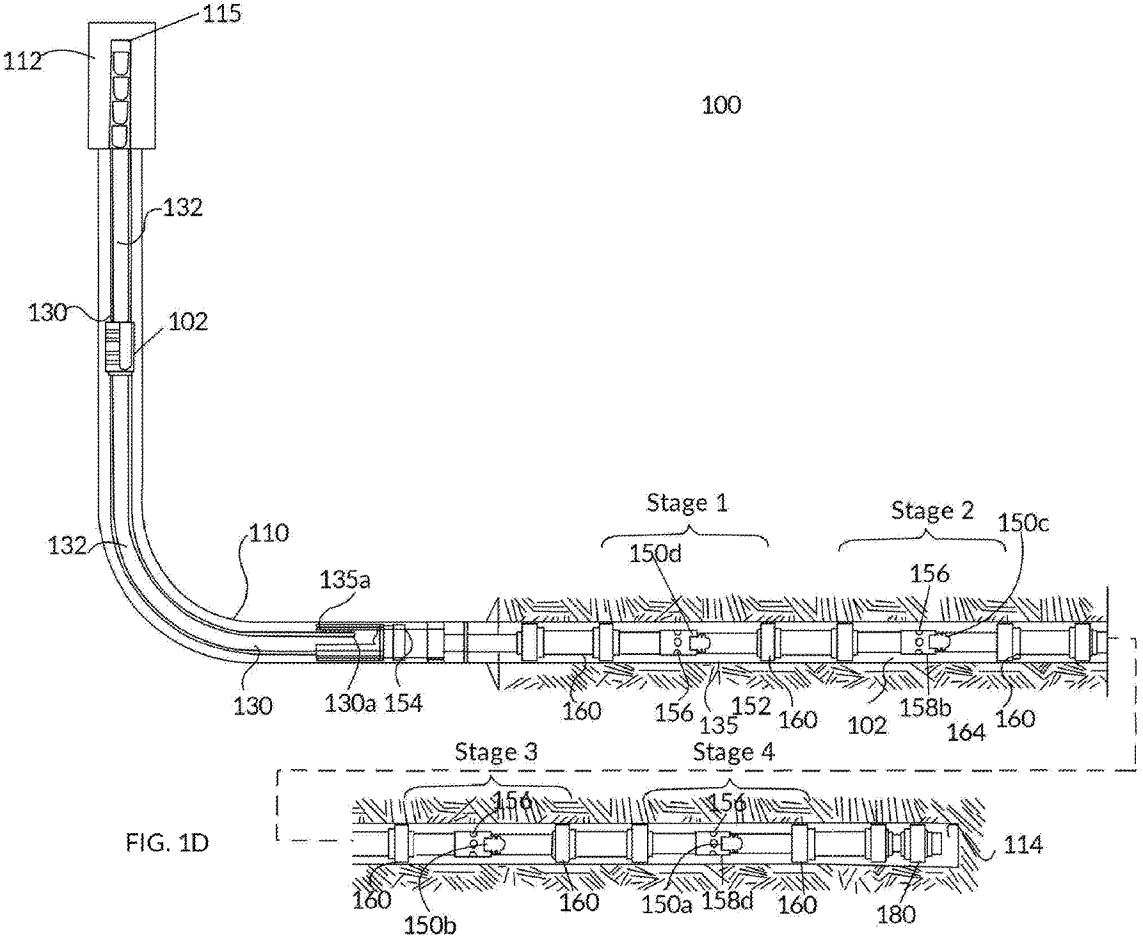
Figure 1E:
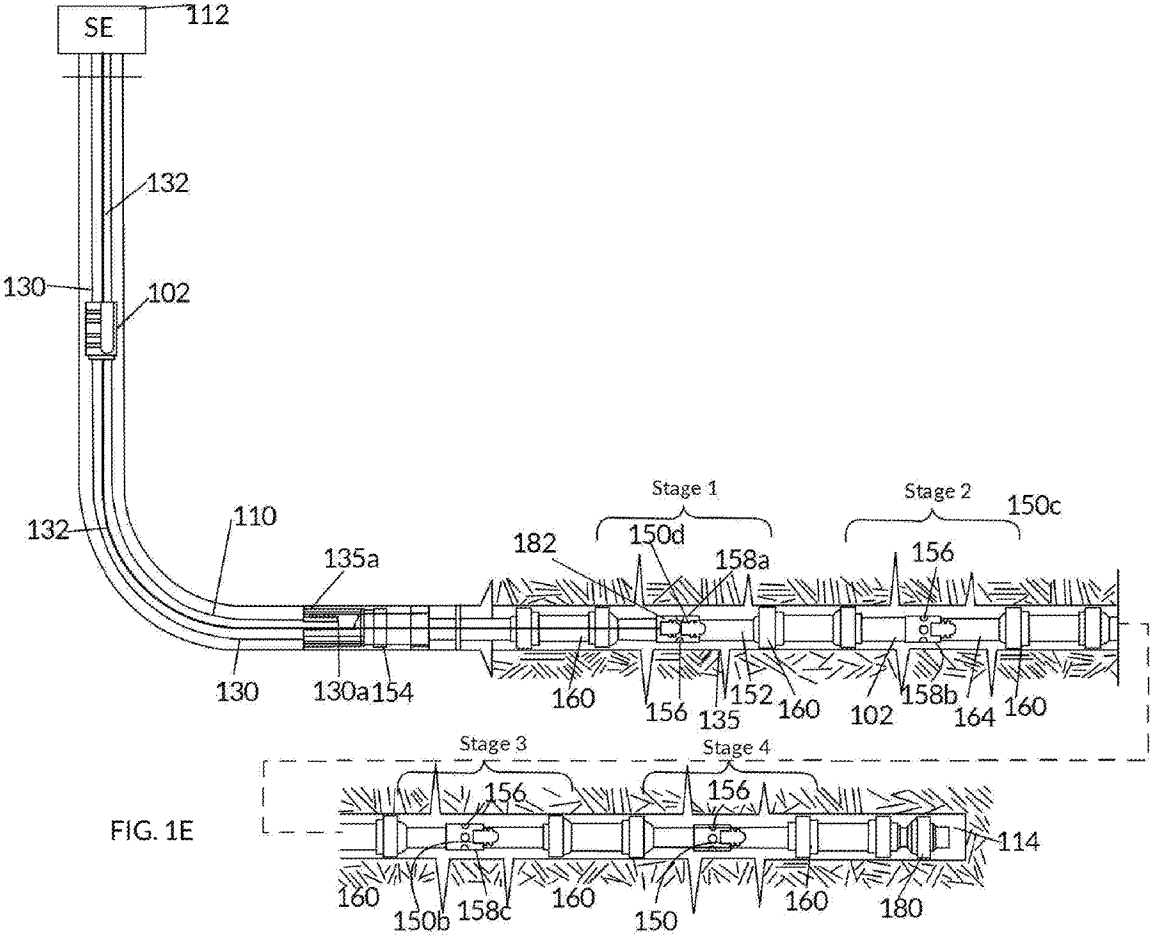

With respect to FIG. 1D, the continued presence of the indexing darts 150 at sleeve assemblies 158 after a fracturing operation (or other operation) may inhibit subsequent operations, such as shifting previously opened sleeve assemblies, back flowing production fluids, running production logs, etc. Accordingly, the indexing darts may include features to facilitate recovery of the wellbore. An indexing dart may include, for example, a disengagement mechanism to unlock the engagement feature of the indexing dart. According to one embodiment, indexing darts that have been disengaged may be back-flowed to surface and caught in a dart trap. In other embodiments, indexing darts may be pushed down the well or pulled to surface by a recovery tool. In some cases, the disengagement mechanism may be tool activated. For example, as illustrated in FIG. 1E, a recovery tool 182 can be run-in from surface to release the indexing dart closest to the surface (e.g., indexing dart 150*d*). The recovery tool 182 may then be used to pull the released dart to surface or push the released dart farther down the well.

Figure 1F:
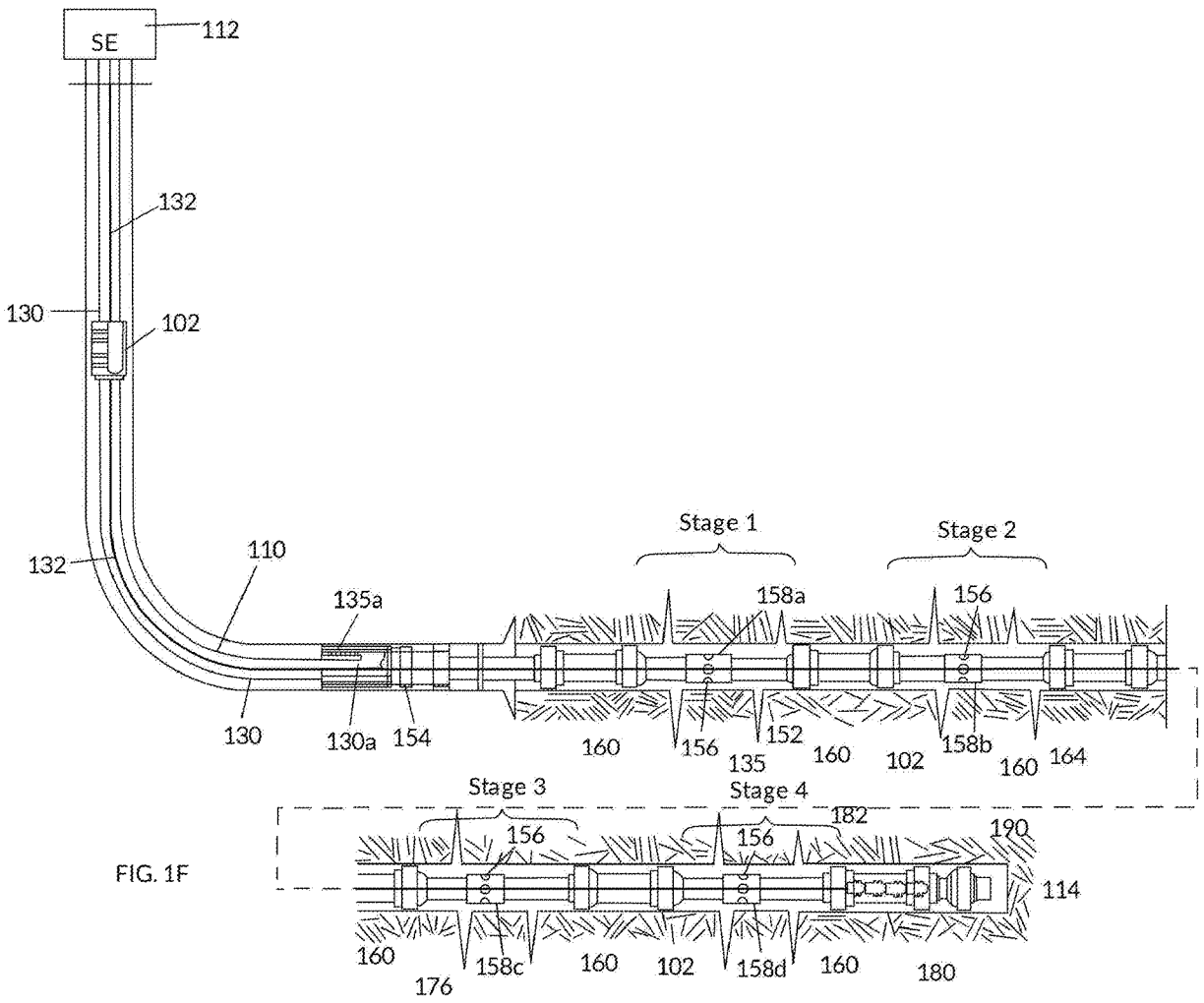
Figure 1G:
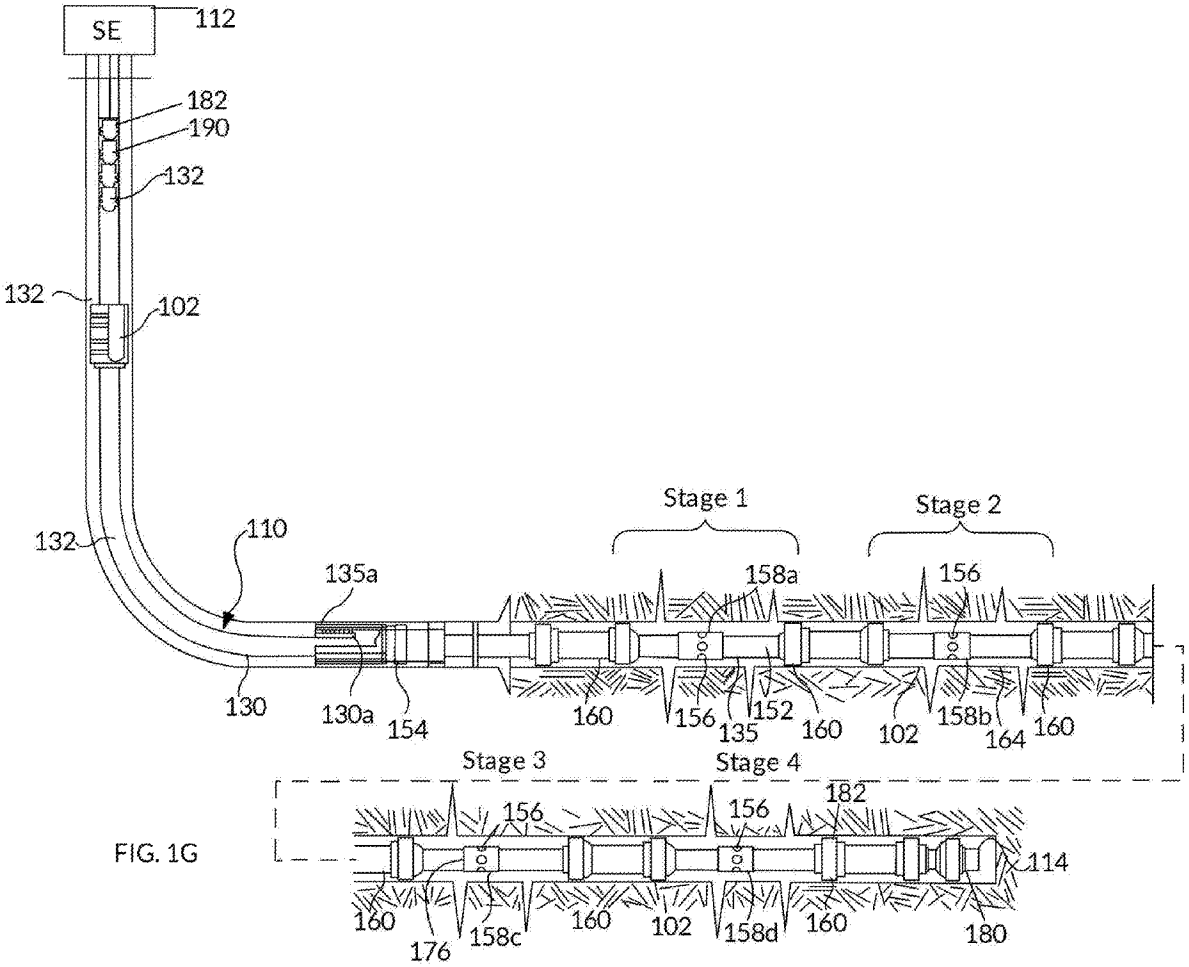

In one embodiment, each indexing dart 150 includes a latch tool so that it can be pushed onto the next indexing dart to release/disengage the next indexing dart from the sleeve assembly. As illustrated in FIG. 1F, for example, tool 182 can push indexing dart 150*d* onto indexing dart 150*c* causing indexing dart 150*c* to release. This operation can be repeated in the tubing string to create a string of indexing darts 190. The string of indexing darts 190 can be pushed to the end of tubing string 110 and, in some cases, left there during subsequent processes. In other cases, the string of indexing darts 190 may be pulled back to surface as illustrated in FIG. 1G.

Indexing darts may also include a fluid flow bore through each indexing dart (e.g., as described in FIG. 2 below). The fluid flow bore can provide a passage through which fluid can be circulated (e.g., by tool 182) to clear dunes in string 110 that may impede progress of the indexing dart. The indexing darts 150 can be configured so that their fluid flow bores essentially create a continuous flow bore through a continuous string of darts (e.g., string of darts 190) so that fluid can be circulated through the dart string.

Embodiments described herein provide a number of advantages. As discussed, above, indexing dart 150 can be configurable to target any of sleeve assemblies 158 in the system. Thus, the same type/configuration of indexing dart 150 may be targeted at any of the sleeve assemblies 158 (or other tool containing a dart seat) without the need for a specially sized indexing dart or sleeve assembly. Because the number of sleeve assemblies 158 is not limited by decreasingly sized dart seats, according to one embodiment, an identical sleeve assembly 158 can be run on every joint of casing in a liner system. Moreover, the indexing mechanism can be carried entirely on the indexing dart so that no indexing or tracking mechanisms need to exist on the sleeve assembly. Furthermore, the sleeve assemblies 158 can be adapted to retain the full bore with only minimal restriction, providing better conductivity and ability to pump at higher rates than traditional ball-activated systems. Embodiments therefore more easily achieve maximum frac rates along the entire well and increase the frac length.

Furthermore, a dart launcher may be provided so that the indexing darts may be launched in an order corresponding to the positions of their target sleeve assembly 158 (or other dart seat) in the tubing string 110. For example, the indexing dart targeted to the lowest dart seat (i.e. the one closest to end 114 of tubing string 110) may be launched first, followed by the indexing dart targeted to the dart seat next closest to surface (or other dart seat above an already seated dart) and so on. Dart launcher 115 can include a magazine of preconfigured indexing darts so that multiple preconfigured darts can be preloaded for launch in the proper order. In one embodiment, dart launcher 115 can be adapted so that high pressure seals do not have to be broken to launch multiple darts. Therefore, indexing darts 150*a* to 150*d* can be launched in order in a continuous fracturing operation.

As discussed above, an indexing dart 150 may be configurable to target any of sleeve assemblies 158. To this end, indexing dart 150 can include a selective engagement mechanism that can be configured to selectively engage a target sleeve assembly 158. As such, indexing dart 150 can have multiple modes of operation including a first mode of operation, referred to herein as a "run-in" configuration, in which indexing dart 150 is configured to pass through sleeve assemblies at which indexing dart 150 could otherwise land (without engaging) and a second mode of operation, referred as a "landing" configuration, in which indexing dart 150 is configured to land at and engage with a particular target sleeve assembly 158 (or other dart seat).

The selective engagement mechanism of an indexing dart 150 can include an engagement feature, such as a dog, catch, collet, shoulder, interference fit member, etc., that can be selectively activated to engage a target sleeve assembly 158 (or other dart seat). For example, the engagement feature may comprise an annular protrusion, such as provided by dogs, a c-ring, spring loaded detents or other structure that, when extended, has an effective outer diameter that is greater than the inner diameter the internal sleeve of sleeve assemblies 158. In this example, the annular protrusion may be collapsible (or alternatively maintained in a retracted position) when in the run-in configuration so that indexing dart 150 can pass through one or more sleeve assemblies 158. In the landing configuration, the annular protrusion can be locked in an extended position so that indexing dart 150 can engage a portion of a sleeve assembly, such as a shoulder, an indented feature or other feature.

The selective engagement mechanism may also include a control mechanism that controls setting of the engagement feature. The control mechanism can comprise an indexing mechanism responsive to contact with sleeve assemblies (or other dart seats or features of tubing string 110) to register passing by a dart seat (or other feature). The indexing mechanism is operatively coupled to the engagement feature such that the engagement feature can be set to engage a dart seat when the indexing mechanism registers a target number of counts.

Indexing dart 150 can be configured to land in a target sleeve assembly (or other dart seat) by setting an appropriate target count for the indexing dart. As an example, if indexing dart 150*a* in FIG. 1A is intended for sleeve assembly 158*d*, the target count of the dart can be set appropriately (e.g., the target count can be set at three and once the count has been met, the engagement mechanism can activate to engage the next target seat, in this particular example, the seat in sleeve assembly 158*d*). In this example, indexing dart 150 is initially deployed in its run in configuration to allow indexing dart 150 to pass through sleeve assemblies 158*a* to 158*c*. Each time indexing dart 150 passes through one of the sleeve assemblies 158*a* to 158*c*, the indexing mechanism registers a count. Once the indexing mechanism registers three counts, the engagement feature is set to engage the next dart seat, in this example, sleeve assembly 158*d*. That is, indexing dart 150 autonomously changes to the second mode of operation, the landing configuration, so that it can engage the next dart seat in sleeve assembly 158*d* (e.g., as shown in FIG. 1B).

It can be noted that the target triggering count is not required to correspond to the number of sleeve assemblies passed. In some embodiments, the selective engagement mechanism may be configured such that it can register a dart seat as it enters and set the engagement feature to engage that dart seat. In such an embodiment, the target count can be set to four to land at sleeve assembly 158*d*. Other target count procedures may also be employed so long as the procedure causes activation of the engagement mechanism of the indexing dart so that the indexing dart can engage the intended dart seat. Moreover, string 110 may include areas of reduced diameter that cannot act as dart seats for dart 150 but may still register as a "count." Indexing dart 150 can be configured prior to launching to take into account the appropriate number of triggers for a given well configuration and target dart seat location.

If it is desired to seat a dart in another sleeve assembly 158*a* to 158*c*, an indexing dart configured to land in a different target dart seat can be launched. For example, as shown in FIG. 1C, indexing dart 150*b* configured to target sleeve assembly 158*c* can be launched from the surface of the wellbore. This process can be repeated for sleeve assemblies 158*b* and 158*a* with darts 150*c* and 150*d* as shown in FIG. 1D. Indexing darts 150*b*-150*d* can be similar structurally to indexing dart 150*a*, except they are configured using the indexing mechanism with a different target trigger count in order to engage different dart seats within the tubing string. Thus, sleeve assemblies 158*a*-158*d* may also be structurally similar to each other.

Continuing with the previous example, the indexing mechanisms of darts 150*a*-150*d* may be set with the respective target counts and the darts 150*a* to 150*d* loaded in dart magazine at dart launcher 115. The darts 150*a* to 150*d* may be stacked in the magazine from bottom to top in order from the highest target count (e.g., indexing dart 150*a*) to the lowest target count (e.g., indexing dart 150*e*). In some cases, additional magazines may be stacked to increase the number of darts. Launcher 115 can be controlled to launch the darts 150 as needed or desired by the operator.

In one embodiment, indexing darts 150 may carry sensor packages (e.g., within the dart, to the rear of the dart, carried on the nose of the dart, etc.) containing one or more acoustic sensors, pressure sensors, temperature sensors, flow meters, seismic monitors, or other sensors. For example, in one embodiment, a dart 150 can include pressure sensors above and below the sealing element of the dart so that pressure above and below the dart can be determined. Data from the sensors may be communicated to the surface via wireless transmitter, pulse technology, wireline or other mechanism. Data may be sent back intermittently or in real time. In another embodiment, the darts 150 may include an onboard memory that can store data. The stored data can be read when the darts are recovered to surface.

According to one embodiment, multiple darts 150 that include acoustic sensors, seismic sensors or other sensors can be conveyed down the well so that data can be acquired at multiple locations in the well. The data from sensors at different locations in the well can be used to triangulate where fractures are occurring or for other purposes. Data from the darts can be used to model where fractures are occurring, how long the fractures are, fracture direction, etc.

Embodiments described herein may be used in a variety of well configurations. With reference to FIG. 1, during a staged wellbore stimulation operation, liner 135 including sleeve assemblies 158 may be set in the well through use of a liner hanger 154, liner packers 160, etc. An upper string 130 run from the surface can be coupled to liner 135 at liner hanger 154 such that fluid and tools (including indexing darts 150) can be conveyed through inner bore 132 of upper string 130 to the inner bore 152 of liner 135.

It may desirable in some cases to change the upper string 130 between operations while leaving liner 135 in wellbore 102. For example, some hydraulic fracturing operations require switching from a run-in string to a frac string between liner installation and stimulation. According to one embodiment, distal end 130*a* of upper string 130 can be latched to upper end 135*a* of liner 135 at a liner hanger 154 such that, when desired, upper string 130 may be disconnected and pulled to surface and a new upper string 130 run in if desired.

Stimulation of the formation occurs through liner 135. Liner 135 includes a plurality of spaced apart ported intervals, each interval comprising one or more fluid ports 156 provided by sleeve assemblies 158. Ports may also be provided by other sliding sleeve valves, kobe sub or other ported component, that can be actuated to open the ports. Ports 156 permit fluid communication between the liner inner bore 152 and the annulus 164.

In the embodiment illustrated in FIG. 1, a packer 160 is mounted between the upper-most ported interval and the surface and further packers 160 are mounted between each pair of adjacent ported intervals. The packers 160 are each disposed about the tubing string, encircling it and selected to seal the annulus 164 between the tubing string 110 and the wellbore wall, when the assembly is disposed in the wellbore and the packers are set (as shown). The packers 160 divide the wellbore into isolated zones or stages (e.g., four stages are illustrated in FIG. 1) wherein fluid can be applied to one zone of the well, but is prevented from passing through the annulus 164 into adjacent zones. Fluid can be directed to particular isolated zone by selectively actuating sleeve assemblies 158 to open ports 156.

As will be appreciated, the packers can be spaced in any way relative to the ported intervals to achieve a desired zone length or number of ported intervals per isolated zone. In some cases, packers may also be integrated with other tools in string 110. The packers may be of various types. In this illustration, packers 160 are of the solid body-type with at least one extrudable packing element, for example, formed of rubber. Solid body packers, including multiple, spaced apart packing elements on a single packer 160, are particularly useful, for example, in open hole (unlined wellbore) operations. In another embodiment, a plurality of packers is positioned in side-by-side relation on the tubing string, rather than using one packer between each ported interval. Packers 160 may also be arranged in other configurations as needed.

Lower end 114 of string 110 may be open, closed or fitted in various ways, depending on the operational characteristics of the tubing string 110. The depicted embodiment includes an end sub 180, such as a toe circulation sub, pump out plug assembly or other assembly.

Objects, such as plugs or other objects, can be conveyed through tubing string 110 from surface equipment 112 to a variety of locations to facilitate various functions, including fracturing functions. To this end, tubing string 110 includes a number of seats at which objects conveyed from the surface may land. The seats may be disposed in various components of tubing string 110 including, but not limited to valves, kobe subs, packers, liner hangers, wellbore isolation tools, circulation subs, pump out plug assemblies, cut-off subs, locate subs or other well components. In some cases, a seat may actuate to function a tool. As discussed above, for example, sleeve assemblies 158 may include dart seats to seat indexing darts 150. Other tools may also include dart seats.

In operation, wellbore fluid treatment system 100 can be used to stimulate wellbore 102. Indexing darts 150*a* to 150*d* are loaded in launcher 115, wherein each is configured to target a different sleeve assembly 158. To selectively treat Stage 4, dart 150*a* configured to target sleeve assembly 158*d* is launched by dart launcher 115. Once dart 150*a* has engaged sleeve assembly 158*d*, pressure can then be increased behind the indexing dart 150*a* to actuate sleeve assembly 158*d* so that the respective ports 156 open. Stimulation fluids and the like can be pumped through string 110 and into the formation at Stage 4 through the open ports to treat the formation, as illustrated in FIG. 1B.

Referring again to FIG. 1B, if it is desired to treat another zone, such as Stage 3, dart launcher 115 can launch indexing dart 150*b* configured to target sleeve assembly 158*c*. Indexing dart 150*b* can be used to actuate sleeve assembly 158*c* to open the respective ports 156 so that stimulation fluid can treat Stage 3, as illustrated in FIG. 1C. This process can be repeated for each zone, progressing up the well until all zones (or desired set of zones) are treated (e.g., as illustrated in FIG. 1D, which shows indexing dart 150*c* seated at sleeve assembly 158*b* and indexing dart 150*d* seated at sleeve assembly 158*a*).

In the example described, each of the stages was treated. However, indexing darts can be used to facilitate operations in which not all stages are treated at a particular time. For example, an operator may wish to stimulate Stage 4 and Stage 2 in year one and Stage 3 in year 2 and Stage 1 in year 3. Indexing darts can be used each year to target the appropriate dart seats so that the correct stages can be stimulated. The use of indexing darts makes it easier to frac (or refrac) a wellbore in stages, offsetting wellbore decline and increasing reserves for operators.

As discussed above, continued presence of the indexing darts within the tubing string may inhibit subsequent operations such as shifting previously opened sleeves, back flowing production fluids, running production logs, etc. Accordingly, the indexing darts may be recovered as discussed above with reference to FIG. 1E-1G.

Indexing darts, sleeve assemblies, dart launchers, dart traps and other components for use in this system can have a variety of forms. FIGS. 2-11 and 16-17 provide examples of various embodiments of indexing darts. FIGS. 12-13 provide example embodiments of sleeve assemblies. FIGS. 14-15 provide example embodiments of dart launchers.

FIGS. 2A-2M (collectively FIG. 2) provide diagrammatic representations of one embodiment of an indexing dart 200 for use in the wellbore treatment system that has a selective engagement mechanism that can be configured to engage a selected dart seat. Indexing dart 200 comprises a dart body 201 conveyable through a tubing string, for example tubing string 110. As shown in FIG. 2, the dart body is somewhat bullet shaped, though other shapes can also work for the dart body of indexing dart 200. In the embodiment illustrated, indexing dart 200 includes an annular sealing element 202, such as an elastomeric seal, configured to create a seal at the inner bore of a dart seat or other portion of the inner bore of a tubing string. In one embodiment, annular sealing element 202 may be a flexible seal sized to create an interference fit with the bore with which it can seal (e.g., a sleeve in a sleeve assembly 158).

Figure 2A:
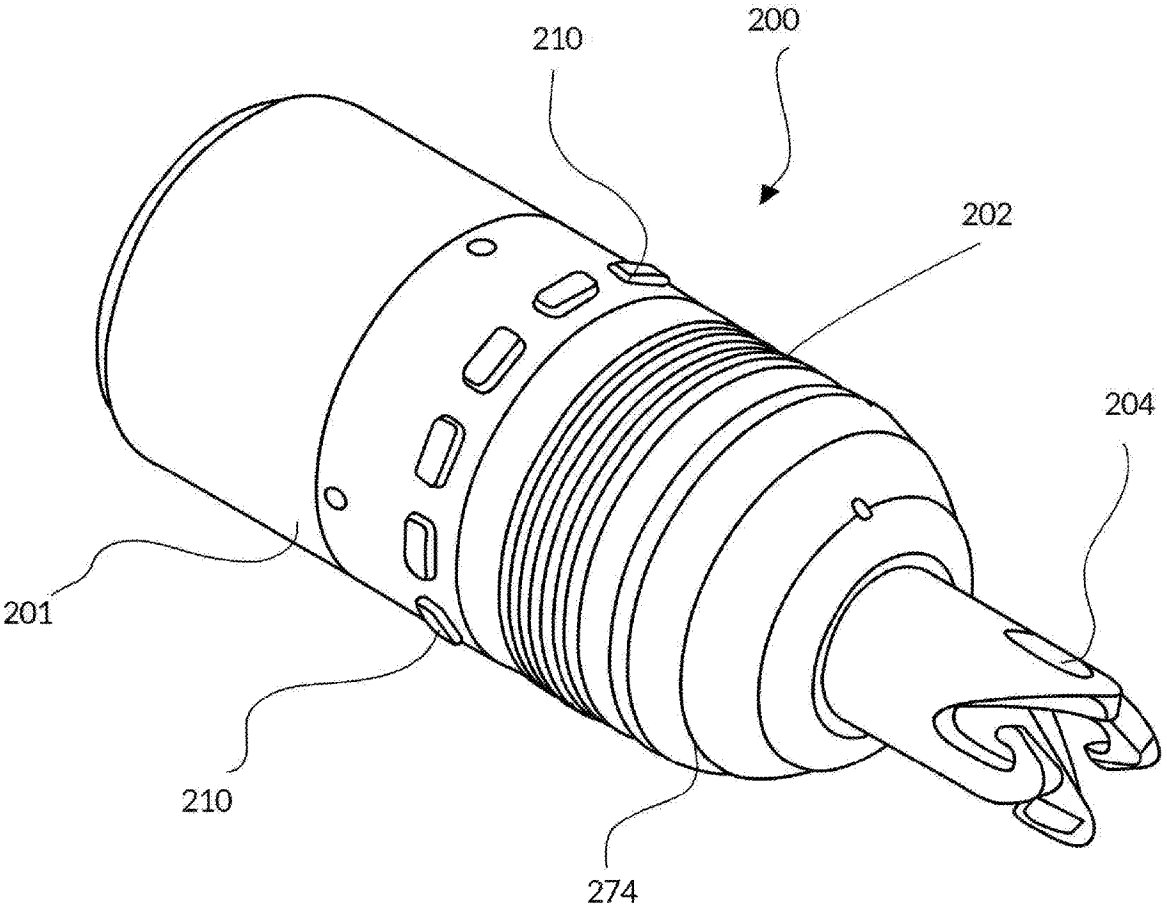
FIGS. 2A-2M are diagrammatic representations of one embodiment of a wellbore dart.

The dart body 201 comprises collapsible annular protrusion that extends radially outward from the dart body. In the embodiment of FIG. 2A, a set of dogs 210 that extend outward from the dart body through a set of protrusion holes set radially around the dart body provide the annular protrusion. The plurality of dogs 210 can be spaced apart to allow fluid to flow between adjacent dogs when dogs 210 are in the extended position. The dogs may be disposed on a c-ring, collet fingers or other structure.

When the dogs 210 of indexing dart 200 are not locked in an extended state (e.g., when they are in a collapsible configuration that allows them to collapse within the dart body 201), indexing dart 200 can pass through frac sleeve assemblies 158 (or other components having dart seats). In contrast, when locked in an extended position, dogs 210 provide an effective outer diameter that is greater than the inner diameter of a dart seat, thus allowing dogs 210 to land on (i.e., engage with) a dart seat such that indexing dart 200 cannot pass the dart seat upon which it has landed.

As noted above, in the embodiment illustrated in FIG. 2A, the annular protrusion is effectively formed by a plurality of spaced dogs 210. However, the annular protrusion can be provided by any suitable structure, including, but not limited to, a c-ring, spring loaded detents, a collet, dogs or other structures, made from metal alloy (including, but not limited to copper alloys), dissolvable metals or other materials.

In the embodiment of FIG. 2, indexing dart 200 also includes a latch tool extending from the nose section. As discussed in more detail below, latch tool 204 can be used to recover other indexing darts.

Figure 2B:
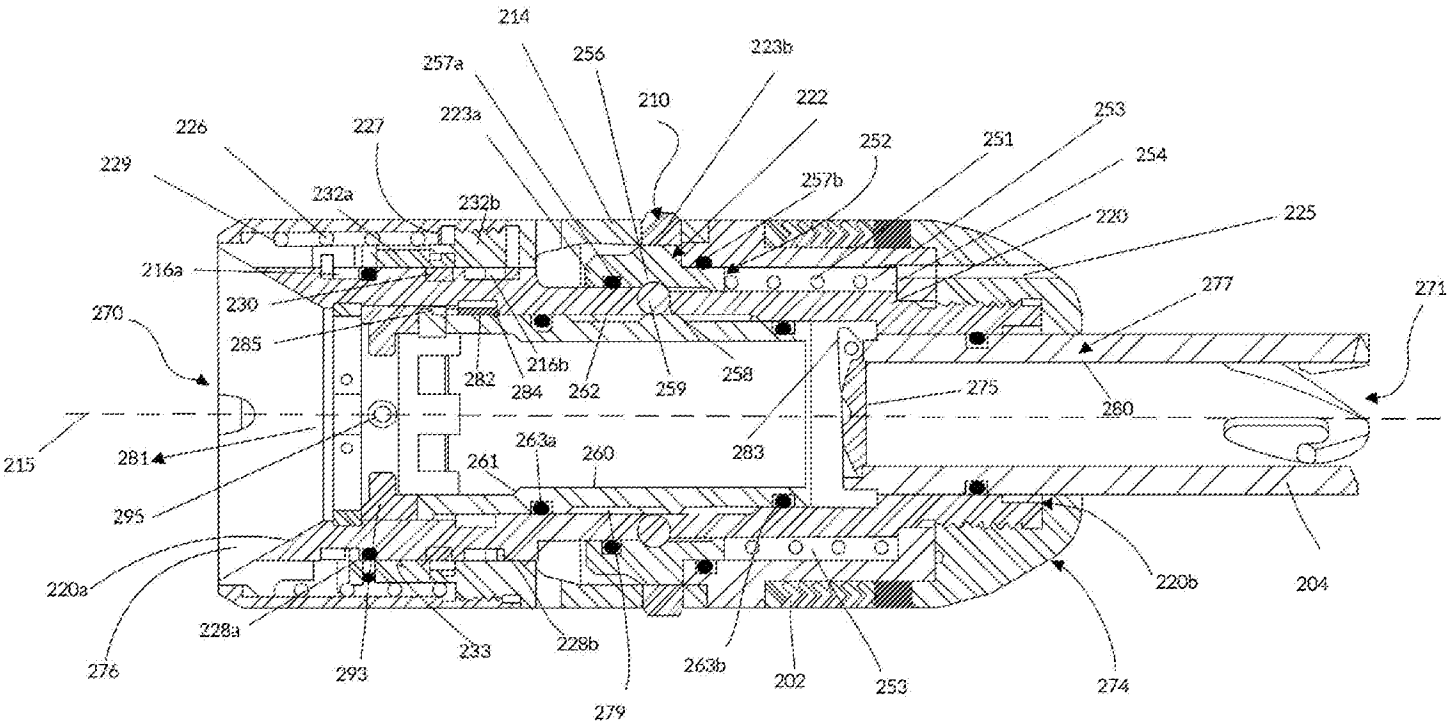

With reference to FIG. 2B, indexing dart 200 can further comprise a control mechanism that controls locking of the annular protrusion (e.g., dogs 210) so that indexing dart 200 can target a particularly selected dart seat. The control mechanism permits indexing dart 200 to change from a "run in hole" or "run in" configuration in which indexing dart 200 can pass through dart seats (e.g., because dogs 210 can collapse when passing through non-targeted dart seats) to a "locked out" configuration in which the dogs 210 are locked in a protruded position to engage the indexing dart 200 with a particular targeted dart seat.

The control mechanism may comprise a mechanical indexing mechanism 212 having a reciprocating sleeve 214, or other reciprocating member, that can reciprocate a controlled distance along the longitudinal axis of the dart 215. The indexing mechanism may further comprise guide slots 216 (e.g., upper guide slot 216*a* and lower guide slot 216*b*) configured to cause rotation of reciprocating sleeve 214 as it translates. According to one embodiment, the indexing mechanism guide slots 216 may comprise j-slots. A j-slot may be continuous, sometimes referred to as a walking j-slot, extending about the circumference of a guide member. While indexing dart 200 is illustrated in FIG. 2B as having two guide slots 216, a dart may have a single guide slot or additional guide slots. As reciprocating sleeve 214 translates longitudinally, the guide slots 216 induce relative angular displacement about the longitudinal axis of indexing dart 200. Rotation of reciprocating sleeve 214 may occur on the back stroke or forward stroke (or both). As shown in FIG. 2, the indexing mechanism 212 is entirely mechanical and provides the advantages of mechanical devices, such as dependability and durability, within the wellbore environment.

The control mechanism can be further configured so that reciprocating sleeve 214 activates a locking mechanism (as described more fully herein) to lock the annular protrusion in an extended position when reciprocating sleeve 214 has actuated a particular number of times, rotated a particular radial distance or achieved another desired configuration set by the operator. In some embodiments, the control mechanism is entirely mechanical such that the indexing mechanism mechanically activates the locking mechanism (e.g., by releasing a locking member when the reciprocating sleeve 214 has actuated a certain number of times or rotated a certain distance). In other embodiments, while the indexing mechanism is entirely mechanical, the control mechanism electrically activates the locking mechanism (e.g., by tripping a switch).

The control mechanism may further include a contact feature (e.g., as a portion of reciprocating sleeve 214) that causes reciprocating sleeve 214 to actuate responsive to contact with dart seats.

As discussed below in FIGS. 2B-2D, in one embodiment, dogs 210 disposed about a protrusion support 222 provide the contact feature. Protrusion support 222 can be provided by any suitable structure. In the illustrated embodiment, protrusion support 222 is provided by a protrusion support sleeve movable along mandrel 220. In other embodiments, the protrusion support 222 may be defined on the surface of mandrel 220 or provided by another suitable structure. As shown, protrusion support 222 is wedge shaped to provide areas of varying outer diameter (e.g., ledge 223*a* and ledge 223*b*). Dogs 210 can translate over a radially outer surface of protrusion support 222 to collapse as they move rearward and extend as they translate forward.

In a run-in configuration, dogs 210 can translate from ledge 223*b* to ledge 223*a* in response to contact with a dart seat, thereby collapsing so that indexing dart 200 can pass through the dart seat. In a locked out configuration, translation of dogs 210 can be locked (by the locking mechanism) so that dogs 210 cannot translate off of ledge 223*b*. Translation of dogs 210 may be limited by shoulders or other features.

In the embodiment illustrated in FIG. 2, dogs 210 extend through or are otherwise operatively coupled to reciprocating sleeve 214 such that longitudinal translation of dogs 210 causes reciprocating sleeve 214 to actuate back. A biasing member 226, such as a spring compressed between rear facing surface 227 of reciprocating sleeve 214 and a forward facing surface 229, may bias reciprocating sleeve 214 forward when the rearward force on reciprocating sleeve 214 is insufficient to overcome the bias. The biasing member 226 can be disposed in a chamber connected to the inner bore of the tubular through one or more passages that allow fluid to flow into and out of the chamber as the reciprocating sleeve moves. Thus, both the upper side of reciprocating sleeve 214 and the lower side are at essentially the same pressure so that the biasing member does not have to overcome pressure differences.

Figure 2C:
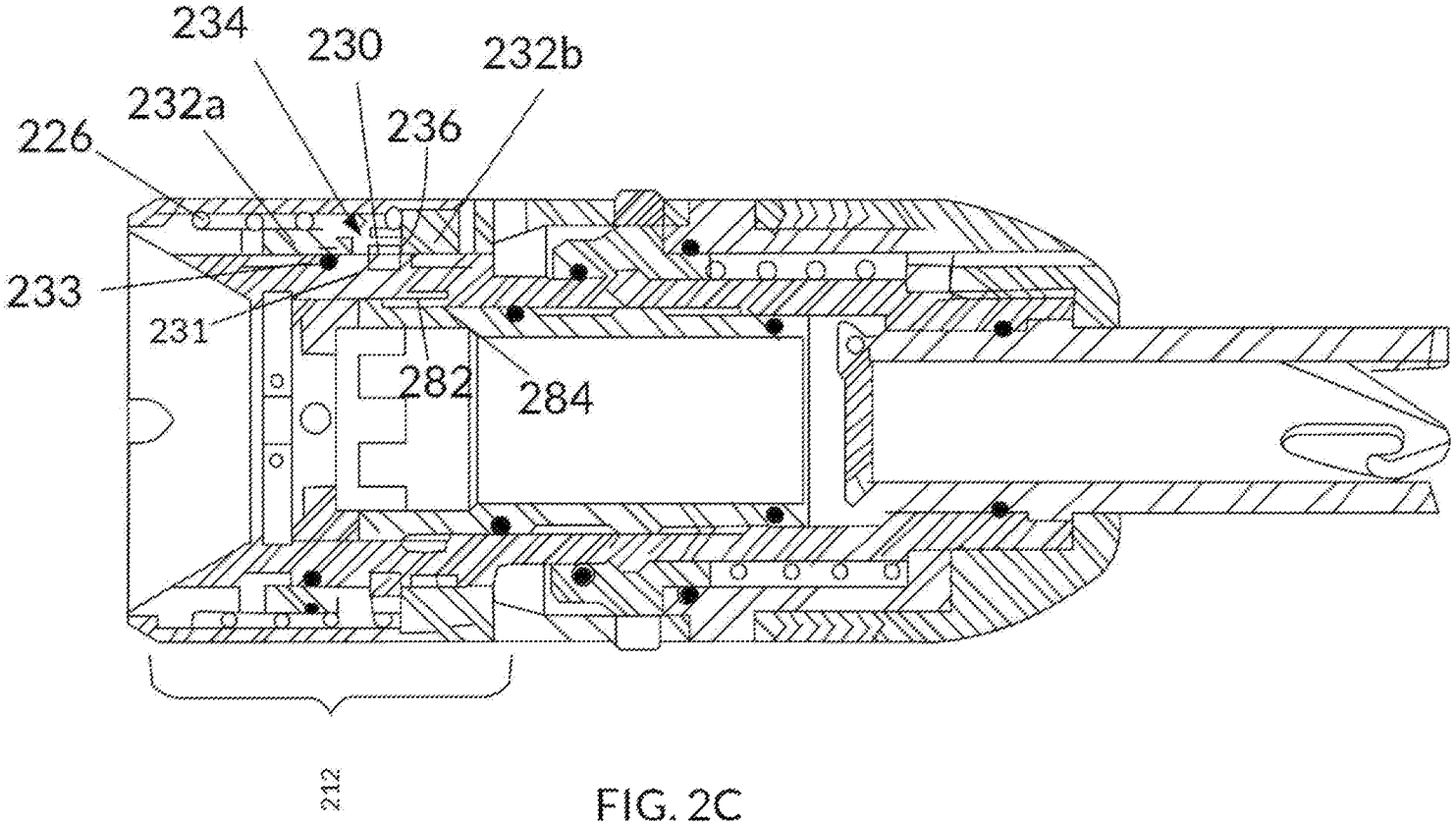
Figure 2D:
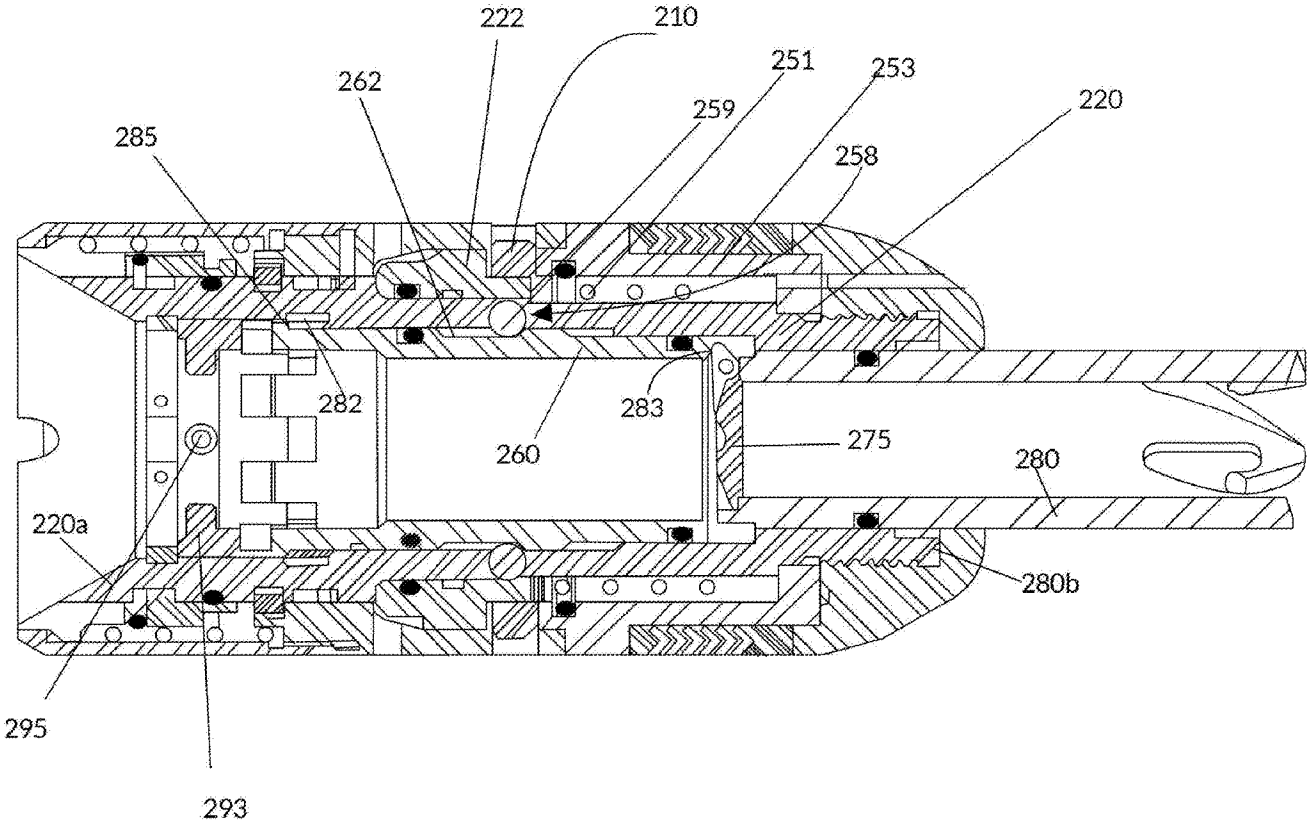

As illustrated in FIG. 2, as dogs 210 contact dart seat when in a run-in configuration, the force will cause dogs 210 to translate back along protrusion support 222, thereby collapsing dogs 210 and actuating reciprocating sleeve 214 back (e.g., as shown in FIG. 2C). As indexing dart 200 passes through the dart seat, the inner bore of the dart seat may hold dogs 210 radially inward for a period of time. However, when dogs 210 have passed through this area and are no longer held in the collapsed position, the force from biasing member 226 can push reciprocating sleeve 214 forward, thereby returning dogs 210 to an extended position (e.g., as shown in FIG. 2B).

Reciprocating sleeve 214 can include index pins 228 (e.g., upper index pin 228*a* and lower index pin 228*b*) extending radially inward so that the ends reside in a respective guide slot 216 disposed on the outer circumference of a guide member. As reciprocating sleeve 214 translates longitudinally, the guide slots 216 cause relative rotation about the longitudinal axis between reciprocating sleeve 214 and the guide member carrying guide slots 216. In some cases, reciprocating sleeve 214 may be prevented from actually rotating (e.g., due to friction between dogs 210 and the inner bore of a sleeve) and consequently the guide member can rotate to provide the relative rotation. Rotation may occur on the back stroke, forward stroke or both. In this embodiment, relative rotation occurs each time reciprocating sleeve 214 actuates, and as such, the relative angular displacement depends on the number of dart seats (or other features within the tubing string that trigger the index mechanism) contacted. The control mechanism can be configured so that reciprocating sleeve 214 activates a locking mechanism to lock dogs 210 in an extended position when reciprocating sleeve 214 has actuated a particular number of times, rotated a particular radial distance or achieved another desired configuration.

Indexing dart 200 may include one or more locks, as desired, to lock dogs 210 in an extended position once the desired indexing position has been achieved (e.g., once the correct number of dart seats have been passed). For example, a lock may be provided to resist reciprocating sleeve 214 from moving backward, thereby preventing dogs 210 from collapsing. According to one embodiment, a sleeve locking member 230 (e.g., c-ring, spring loaded detent or other locking member) is seated in a recess 231 (recess 231 is labeled in FIG. 2C). In the run-in configuration, sleeve locking member 230 is held in recess 231 such that it does not impede translation of reciprocating sleeve 214. Responsive to indexing mechanism 212 reaching a configuration corresponding to the target dart seat count, the sleeve locking member 230 is released to prevent dogs 210 from collapsing.

With further reference to the specific embodiment illustrated in FIGS. 2B-2F and 2M, the locking mechanism of FIG. 2 will be described in greater detail. Reciprocating sleeve 214 may include an upper indexing sleeve 232*a* and lower indexing sleeve 232*b* that can separate to form an open space 234 (shown in FIG. 2C). As the sleeves separate, lower indexing sleeve 232*b* shifts dogs 210 to an extended position while the rear edge of the inner surface of lower indexing sleeve 232*b* moves forward of the recess 231 allowing sleeve locking member 230 to shift at least partially into the open space 234 behind lower indexing sleeve 232*b*. In this arrangement of FIG. 2C, sleeve locking member 230 prevents lower indexing sleeve 232*b* from translating rearward. For example, sleeve locking member 230 can be a c-ring that acts between one side of recess 231 and shoulder 236 of lower indexing sleeve 232*b* to prevent backward movement of lower indexing sleeve 232*b*, thereby locking dogs 210 in a locked out configuration.

According to one embodiment, upper indexing sleeve 232*a* and lower indexing sleeve 232*b* separate when they achieve a particular rotational orientation relative to each other (a "separation orientation"). For example, the indexing sleeves can be keyed or otherwise configured so that they can only separate when a key on one of the indexing sleeves is aligned with a key slot on the other. As shown, upper guide slot 216*a* and lower guide slot 216*b* can be configured to induce different amounts of angular displacement in upper indexing sleeve 232*a* and lower indexing sleeve 232*b* as reciprocating sleeve 214 actuates, resulting in relative rotation between upper indexing sleeve 232*a* and lower indexing sleeve 232*b*. If the key and key slot are not angularly aligned, that is upper indexing sleeve 232*a* and lower indexing sleeve 232*b* are not in a separation orientation, the relative rotation between upper indexing sleeve 232*a* and lower indexing sleeve 232*b* will cause the angular displacement between the key and key slot to decrease each time reciprocating sleeve 214 actuates. The relative rotation between upper indexing sleeve 232*a* and lower indexing sleeve 232*b* with each actuation will eventually bring the indexing sleeves to the separation orientation (e.g., where the key and key slot are aligned so that the indexing sleeves can separate).

When the key and key slot are aligned, biasing member 226 can push lower indexing sleeve 232*b* forward, separating the indexing sleeves to create open space 234 and release sleeve locking member 230. A friction member 233, such as an O-ring, can provide friction against upper indexing sleeve 232*a* to help prevent upper indexing sleeve 232*a* from following lower indexing sleeve 232*b* as they separate.

Figure 2E:
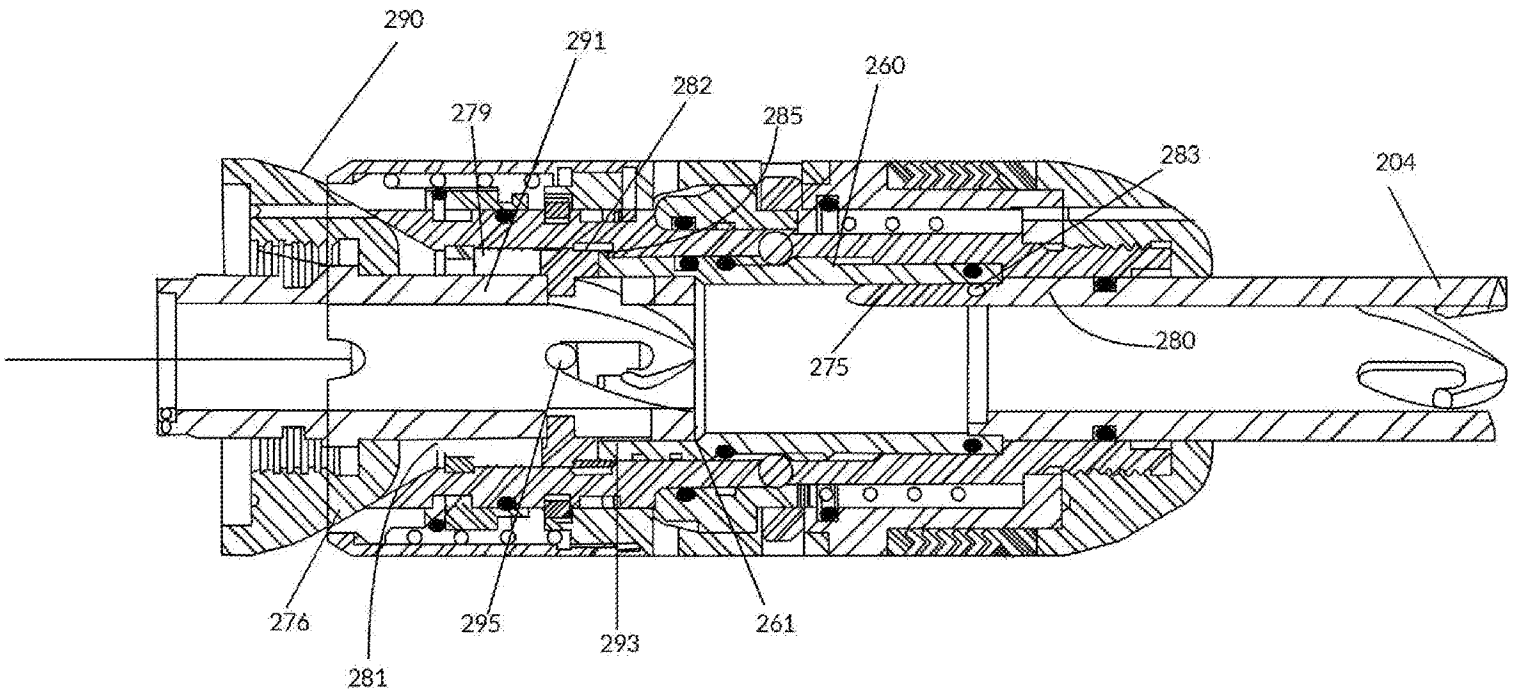
Figure 2F:
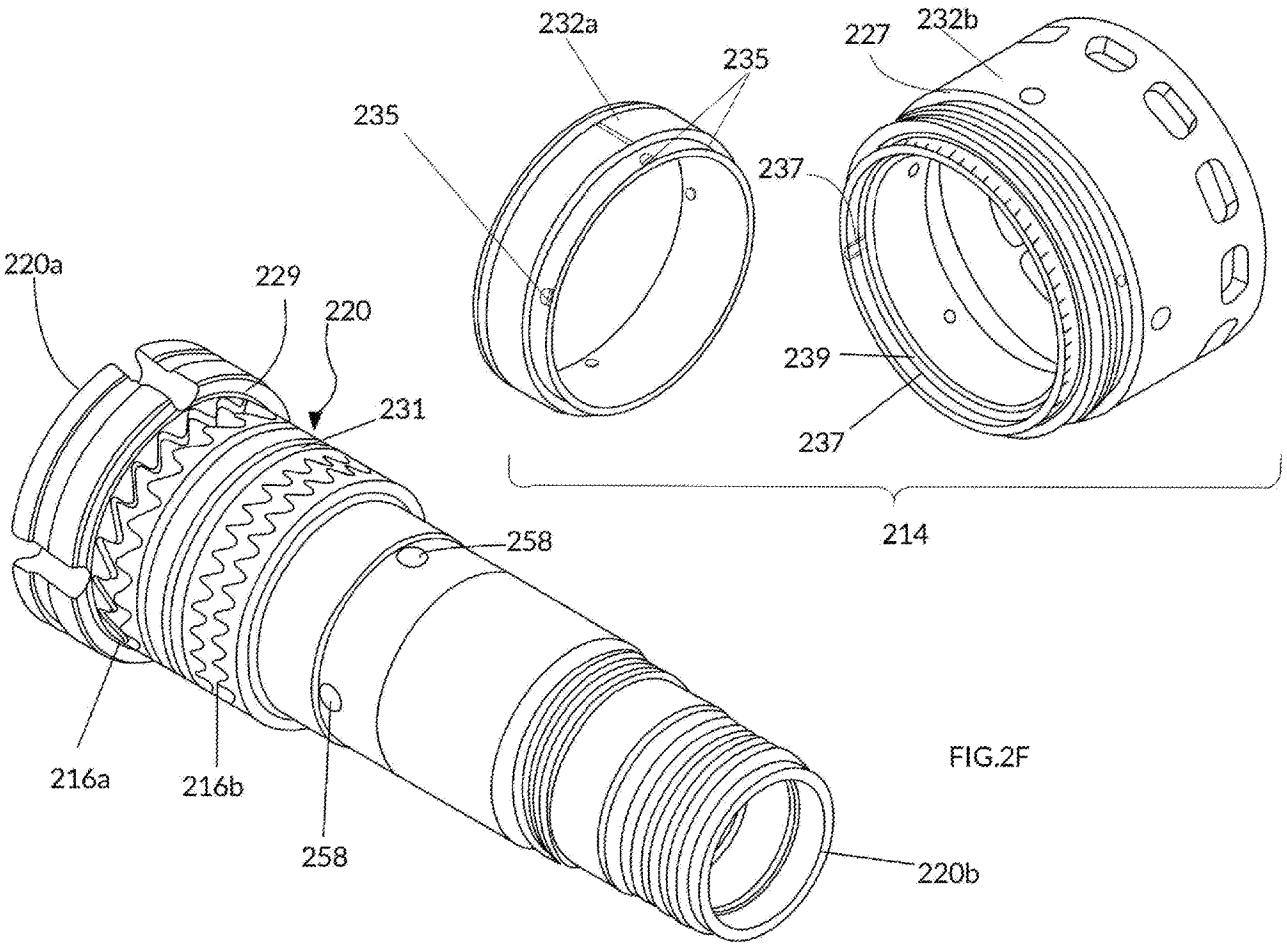

In the embodiment of FIG. 2F, for example, a lower end portion of upper indexing sleeve 232*a* may include projections 235 (e.g., keys) that project radially outward to ride in a groove 239 defined in the upper end portion of lower indexing sleeve 232*b*. A set of longitudinal channels 237 (e.g., key slots) extend from groove 239 to the upper end of lower indexing sleeve 232*b* and are spaced so that they can align with projections 235. When projections 235 are not aligned with channels 237, they are held in groove 239 such that the indexing sleeves 232*a* and 232*b* translate together. However, when projections 235 align with channels 237 the indexing sleeves can separate.

Upper guide slot 216*a* and lower guide slot 216*b* can be configured to induce different amounts of angular displacement in upper indexing sleeve 232*a* and lower sleeve 232*b* such that the indexing sleeves rotate relative to each other as reciprocating sleeve 214 actuates. If projections 235 and channels 237 begin in positions in which they are not rotationally aligned, the relative rotation between upper indexing sleeve 232*a* and lower indexing sleeve 232*b* will cause the angular displacement between projections 235 and channels 237 to decrease each time reciprocating sleeve 214 actuates. When reciprocating sleeve 214 has actuated a sufficient number of times (e.g., corresponding to the target seat), projections 235 and channels 237 will be aligned so that the indexing sleeves can separate, releasing locking member 230 (as shown in FIG. 2C). An example of this process is explained in more detail in conjunction with FIG. 3. Additional views of an embodiment of the indexing mechanism are illustrated in FIG. 2M.

In operation, the targeted dart seat for indexing dart 200 can be configured by setting reciprocating sleeve 214 at the correct starting position(s) in the guide slot(s) 216. If, for example, a fourth dart seat is the target dart seat, upper pin 228*a* and lower pin 228*b* of FIG. 2A can be set to appropriate positions in guide slots 216*a* and 216*b* respectively, such that the relative rotation between upper indexing sleeve 232*a* and lower indexing sleeve 232*b* with each actuation results in the indexing sleeves achieving the separation orientation when indexing dart 200 registers three dart seat contacts. In this embodiment, the indexing sleeves can separate after dart 200 passes through the third dart seat.

Returning to FIG. 2F, upper guide slot 216*a* includes 20 "Js" and lower guide slot 216*b* includes 30 "Js". This results in upper indexing sleeve 232*a* and lower indexing sleeve 232*b* rotating six degrees relative to each other per cycle. This means that, in the configuration illustrated, the indexing mechanism can count up to sixty stages (e.g., because there are sixty increments of six degrees at which indexing sleeve 232*a* and lower indexing sleeve 232*b* can align before they rotate fully relative to each other). In other embodiments, the guide slots may be configured to provide more or fewer stages.

Moreover, while guide slots 216 are both illustrated in FIG. 2F as j-slots, the guide slots may have a variety of configurations. For example, one of the upper or lower guide slots 216 may be a straight longitudinal guide slot while the other is a j-slot such that only one of the sleeves rotates. For example, FIG. 2I illustrates a mandrel 220 with an upper guide slot 216*a* configured to induce rotation in an upper indexing sleeve and a straight lower guide slot 216*b*. Moreover, while guide slots 216 are shown as having a generally repeating pattern in FIG. 2F, guide slots may a different pattern at select points. For example, a portion of a guide slot may correspond to a target seat and may have profile that allows additional longitudinal translation of a sleeve at that point so that the sleeve can trigger the locking mechanism.

Furthermore, while two guide slots 216 are illustrated in the embodiment of FIG. 2, in another embodiment the indexing mechanism may include a single guide slot disposed on mandrel 220 (or other guide member) and a single reciprocating sleeve. In yet another embodiment, the indexing mechanism may include more than two guide slots. Other embodiments of reciprocating sleeves may also be used, including a single sleeve or a sleeve that includes multiple rotating indexing sleeves.

In addition, upper indexing sleeve 232*a* and lower sleeve 232*b* may also be coupled in any suitable manner. For example, in one embodiment, upper indexing sleeve 232*a* and lower indexing sleeve 232*b* can be coupled with a snap fit or the like such that they can be separated by a sufficient force asserted by biasing member 226. In this embodiment, for example, guide slot 216*a* can be configured to capture index pin 228*a* at a certain point in the rotation of upper indexing sleeve 232*a* such that upper indexing sleeve 232*a* is prevented from translating forward with lower indexing sleeve 232*b*, thereby causing separation of the sleeves. Thus, while a particular mechanical control mechanism is described above, it should be understood that other arrangements of control mechanisms may also be used.

Returning to FIG. 2B, indexing dart 200 may include any suitable disengagement mechanism so that dogs 210 can be disengaged. In the embodiment illustrated, protrusion support 222 is provided by a movable protrusion support sleeve carried by mandrel 220. A biasing member 251 can bias protrusion support 222 rearward into an area formed between an inner surface of reciprocating sleeve 214 and mandrel 220 so that dogs 210 can collapse into an area in front of protrusion support 222. For example, a compressed spring may contact shoulder 252 of protrusion support 222 and a facing surface 254 to bias protrusion support 222 rearward. In any event, with dogs 210 collapsed, indexing dart 200 can be pushed or pulled through dart seats.

Biasing member 251 may be disposed in a chamber 253 that is in communication with the wellbore in front of sealing element 202, such as through port 255. On the other hand, the area above protrusion support 222 may be in communication with the wellbore behind sealing element 202. Upper and lower protrusion support sealing members 257*a* and 257*b* (e.g., O-rings or other protrusion support seal types) can provide seals so that the area above protrusion support is not in communication with the wellbore in front of sealing element 202 and chamber 253 is not in communication with the wellbore behind sealing element 202 (when sealing element 202 is sealed). As such, there may be a pressure differential across protrusion support 222 acting against biasing member 251. In one embodiment, these areas may be brought into pressure equilibrium so that biasing member 251 does not have to push against a pressure differential.

A releasable protrusion support locking member 259, such as a detent or other locking member, can prevent translation of protrusion support 222 and disengagement of dogs 210 until disengagement is desired. In a protrusion support locking configuration, protrusion support locking member 259 is partially disposed in recess 256 in the inner surface of protrusion support 222 and opening 258 in the outer surface of mandrel 220. In this position, protrusion support locking member 259 acts on the walls of recess 256 and opening 258 to prevent translation of protrusion support 222.

Indexing dart 200 can include a release mechanism to release protrusion support locking member 259. In the embodiment illustrated in FIG. 2D, opening 258 extends through a wall of mandrel 220. An inner sleeve 260, one embodiment of which is illustrated in FIG. 2G, is translatable in the bore of mandrel 220. In the embodiment of FIG. 2, inner sleeve 260 includes a recess 262 on its outer surface that is positioned to pass under protrusion support locking member 259. When this occurs, protrusion support locking member 259 is radially biased inward to drop into recess 262 so that it is no more than flush with the outer diameter of mandrel 220 at opening 258. As such, in the protrusion support release configuration, protrusion support locking member 259 no longer prevents translation of protrusion support 222. Accordingly, as shown in FIG. 2D, protrusion support 222 can shift to a position that allows dogs 210 to collapse.

According to one embodiment, sleeve 260 may shift forward based on a pressure differential. When indexing dart 200 has landed on a seat (e.g., at a sleeve assembly 158 of FIG. 1 or other tool providing a dart seat), sealing element 202 forms a seal on the seat allowing pressure to build above the dart creating a differential pressure across the dart. According to one embodiment, a sufficient pressure differential can cause sleeve 260 to shift.

In the embodiment illustrated, upper and lower inner sleeve sealing members 263*a* and 263*b* (e.g., O-rings or other sealing members having different sealing diameters) can be disposed about inner sleeve 260 to create a seal between the outer surface of inner sleeve 260 and the inner surface of mandrel 220. The area between the inner sleeve sealing members 263 may be fluidly connected to the wellbore below sealing element 202. For example, opening 258, locking member 259 and protrusion support 222 can be configured to create a flow passage from recess 262 to chamber 253, which in turn is open to the wellbore below sealing element 202 through port 255. Consequently, as pressure is increased above indexing dart 200, a differential pressure is established between fluid above dart 200 and recess 262 (e.g., due to recess 262 being fluidly connected to the wellbore below sealing element 202). The differential pressure can result in a force sufficient to shift sleeve 260 forward to a position that allows protrusion support locking member 259 to drop into recess 262.

Inner sleeve 260 may include a releasable setting device, such as a shear pin, a collet or a spring that holds inner sleeve 260 in place until the holding force of the setting device is overcome. With reference to FIG. 2C, a c-ring 282 acts as a shear ring. A shear ring portion 284 of c-ring 282 extends radially inward into a groove on the outer surface of inner sleeve 260. When sufficient force is applied, such as when a threshold differential pressure is created, shear ring portion 284 can shear off allowing inner sleeve 260 to shift forward (see FIGS. 2D, 2J-2K). As shown in FIG. 2D, when the holding force is overcome (e.g., when shear ring portion 284 shears off), inner sleeve 260 can translate from a first position where recess 262 is not aligned with protrusion support locking member 259 to a disengagement position in which recess 262 is aligned with protrusion support locking member 259 so that protrusion support locking member 259 releases. While recess 262 may have shape that allows inner sleeve 260 to translate even further forward, such further forward movement of inner sleeve 260 may be limited by shoulders or other features. For example, c-ring 282 may act against a shoulder 285 to prevent further forward movement of inner sleeve 260.

It can be noted that the differential pressure across protrusion support 222 may hold protrusion support 222 in place even if protrusion support locking member 259 has released. Consequently, protrusion support 222 may remain in its initial position until the pressure above and below the dart approaches equilibrium. As the pressure approaches equilibrium, biasing member 251 can push protrusion support 222 to allow dogs 210 to collapse. In a wellbore stimulation operation, pressure equilibrium will typically occur shortly after the fracture stimulation pressure is bled down and or when the next lower treatment zone begins to produce.

Alternatively, in the embodiment illustrated in FIG. 2E, a tool 290 (e.g., a recovery tool run-in from surface (such as a coiled tubing tool, threaded tugging tool), a dart or other tool) can push on the inner sleeve shoulder 261 or features 295 to cause the inner sleeve 260 to shear ring 282 and shift down. This function may, at the same time, open the valve 275 to allow circulation through and around the dart which may be useful to loosen debris or free an obstruction. Thus, even if the dart sealing element 202 does not seal and the pressure is the same all around the dart, the dogs 210 can still be released from their locked out position. Other disengagement strategies may also be used. For example, in an alternative embodiment, dogs 210 may be made of a material that dissolves over time in the operating environment (thus, over time the indexing dart 200 will no longer be engaged with dart seat because dogs will have dissolved entirely or to a point that extraction of indexing dart 200 can be readily achieved). Similarly, protrusion support 222, protrusion support locking member 259, inner sleeve 260 or other components can be made of a dissolvable metal such that dogs 210 naturally disengage over time.

Returning to FIG. 2B, indexing dart 200 can include a central bore extending forward from a rear opening 270. The central bore may be plugged or may extend through indexing dart 200 to a front opening 271 to provide a fluid flow bore through which fluid can pass. In the latter case, an internal valve 275 can be provided, where valve 275 seals the central bore. The central fluid flow bore provides a mechanism to allow fluid to be circulated through the dart during recovery (e.g., to clear dunes, etc. in tubing string 110).

The central bore may have any desired configuration. According to one embodiment, the central bore has a rear or upper portion 276 proximate to rear opening 270 that transitions to a second portion 279 (e.g., at rear portion front opening 281) extending forward from rear portion 276 that has a smaller diameter than rear opening 270. The rear portion 276 may continuously narrow from the rear opening 270 to the rear portion front opening 281 to create a bowl, funnel shape or other desired profile. The walls of rear portion 276 may have one or more openings to allow fluid to circulate out of rear portion 276. Furthermore, in one embodiment, rear portion 276 may be shaped to form a friction fit with a nose of a tool (recovery tool run-in from surface, other dart or other tool) to create a preferential flow path through the central bore, as discussed below.

According to one embodiment, valve 275 is a flapper valve (or other valve) that opens under back pressure/back flow. In particular, valve 275 can be configured to open to allow flow should sand off occur. Sand off typically occurs when more proppant is directed to a zone than can be injected into the zone causing a column of proppant to collect in the tubing string that prevents a subsequent plug (e.g., such as an indexing dart) conveyed down the tubing string from reaching its intended seat. For example, if sand off occurs at Stage 4 of FIG. 1, the proppant collected in tubing string 110 may prevent indexing dart 150*b* from reaching sleeve assembly 158*c*. However, back pressure may build in Stage 4. Valve 275 can open under back pressure/back flow so that sand/fluid can flow up through the indexing dart allowing the sand off to clear. Valve 275 may include a biasing member such that a threshold back pressure is required to open valve 275.

In another embodiment, valve 275 may be locked in a closed position until selectively opened by a valve actuator. Once in the open position, valve 275 may be locked open until indexing dart 200 is recovered and reconfigured or valve 275 may be selectively closable when in the well.

Indexing dart 200 can include a central flow passage formed as described. As shown in FIG. 2B, mandrel 220 includes an inner bore that extends from a mandrel upper end 220*a* to a mandrel lower end 220*b* and forms at least a portion of the central flow passage. A nose section 274, such as a nose cone, is coupled to mandrel 220 and includes a longitudinal opening 277 that aligns with the inner bore of mandrel 220. A tubular member 280 having an inner bore extends from the inner bore of mandrel 220 through nose section 274 to a front opening 271. In the embodiment of FIG. 2B, the mandrel inner bore and tubular member inner bore cooperate to form the central flow passage such that the inner bore of mandrel 220 can be in flow communication with the inner bore of the tubing string below indexing dart 200. Valve 275 may be disposed in the inner bore of mandrel 220 at an upper end of tubular member 280 to seal the central bore.

According to one embodiment, smart dart 200 includes a valve actuator that is adapted to move from a first actuator position to a second actuator position to selectively open internal valve 275. Referring to FIGS. 2D and 2E, inner sleeve 260 forms an actuator sleeve that can slide forward from its release position to a valve open position to actuate arm 283, latch or other feature to mechanically actuate valve 275. In the illustrated example, inner sleeve 260 has an inner bore having a greater diameter than tubular member 280 such that inner sleeve 260 may slide over a portion of tubular member 280 when it is in the valve open position.

While in the embodiment of FIG. 2, the valve actuator is provided by sleeve 260 having a lower end that actuates valve 275, the valve actuator can be provided by other suitable structures. For example, the valve actuator may include a valve actuation member that acts in cooperation with the actuator sleeve to provide a valve actuator. Other structures may also be used.

It may be desirable in some cases to require a threshold amount of force to move inner sleeve 260 to the valve open position. A releasable setting device may prevent inner sleeve 260 from moving forward from the disengagement position until the holding force is overcome. Any suitable setting mechanism may be used. In the embodiment illustrated, a c-ring 282 or other feature may be provided that restricts forward motion of inner sleeve 260 after protrusion support locking member 259 has dropped into recess 262. C-ring 282 acts on shoulder 285 to prevent inner sleeve 260 from moving to the valve open position. However, shoulder 285 may be disposed on collet fingers or other structure that can flex radially inward to pass c-ring 282 when enough force is applied to inner sleeve 260, thus allowing inner sleeve 260 to shift to the valve open position. In another embodiment, as discussed below, c-ring 282 may be forced into a groove on the inner surface of mandrel 220 allowing sleeve 260 to move forward.

Figure 2H:
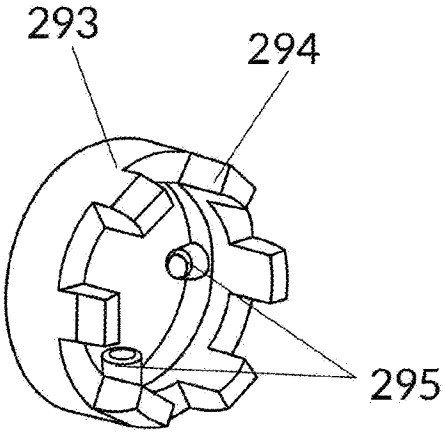
Figure 2G:
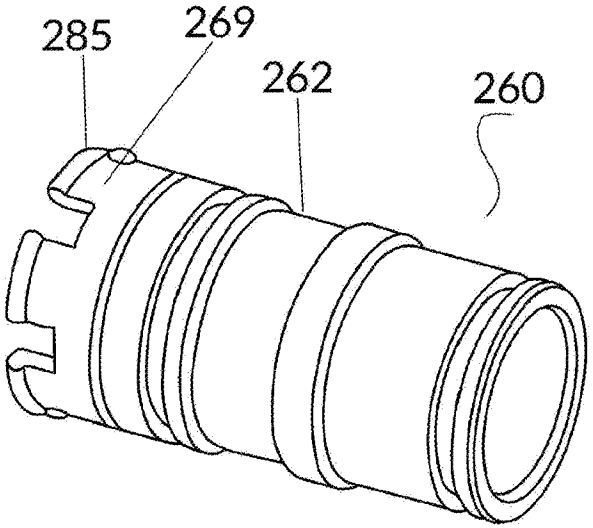
Figure 2I:
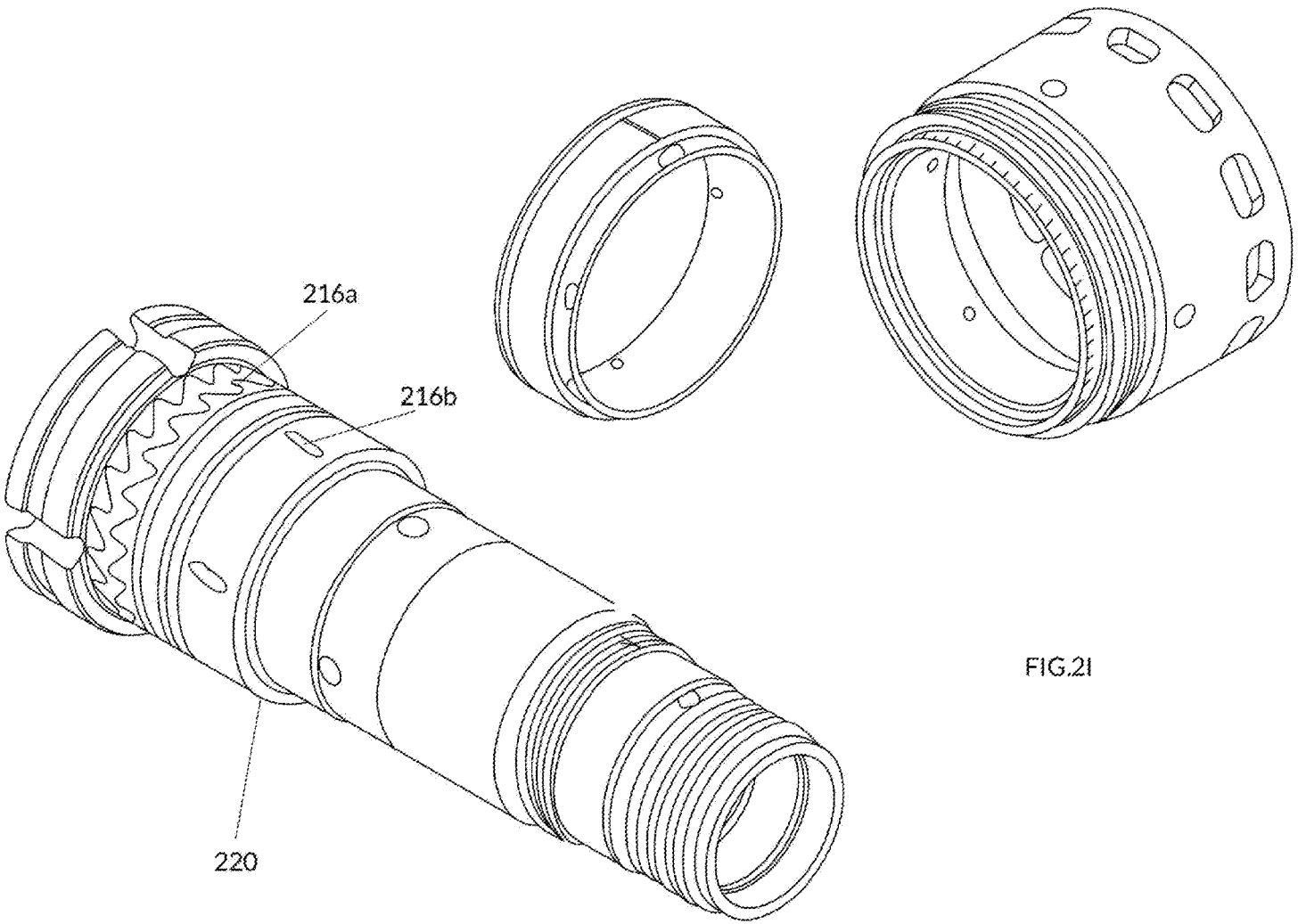

Indexing dart 200 further includes a latch sleeve 293, one embodiment of which is illustrated in FIG. 2H, disposed in the inner bore of mandrel 220 behind inner sleeve 260. As shown in FIGS. 2G, 2K, 2L, the lower end portion of latch sleeve 293 can include fingers 294 that can fit between complementary fingers 269 on inner sleeve 260. The ends of fingers 294 can form ramps. When latch sleeve 293 moves forward, fingers 294 force c-ring 282 into a groove on the inner surface of mandrel 220 so that shoulders 285 of inner sleeve can pass. Accordingly, inner sleeve 260 can shift forward to a valve open position.

Latch sleeve 293 comprises a latch keeper feature 295, such as latch lugs, pins or other feature with which a latch tool can engage. As shown in FIGS. 2E, 2L, for example, keeper feature 295 can be adapted for engagement by a j-slot latch tool 291 that is configured to accept and hook over keeper feature 295. While, in FIG. 2, the latch tool engagement mechanism (e.g., keeper 295) is provided by latch sleeve 293, the latch tool engagement feature may be provided by any suitable structure. In another embodiment, for example, the inner surface of mandrel 220 may include keeper feature 295. In yet another embodiment, inner sleeve 260 may include keeper feature 295.

With further reference to FIG. 2E, a tool 290 (e.g., a recovery tool run-in from surface (such as a coiled tubing tool, threaded tugging tool), a dart or other tool) may be used to open valve 275. Tool 290 can be shaped so that a portion of tool 290 can enter the inner bore of mandrel 220 and push inner sleeve 260 forward. This movement causes inner sleeve 260 to actuate an arm 283, latch or other feature to mechanically actuate valve 275.

In the embodiment illustrated, tool 290 includes a latch tool 291 that engages latch sleeve 293 and pushes latch sleeve 293 and inner sleeve 260, thereby actuating valve 275. Latch tool 291 can enter the inner bore until keeper feature 295 contacts the back end of the j-slots of latch tool 291. Latch tool 291 can push on keeper feature 295 or other feature of latch sleeve 293 with sufficient force to move latch sleeve 293 forward.

Figure 2J:
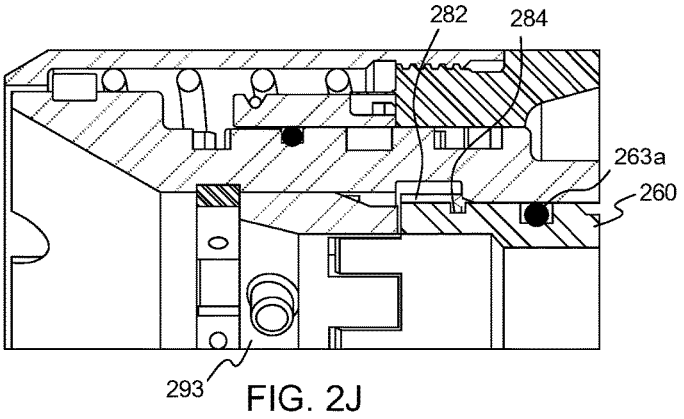
Figure 2K:
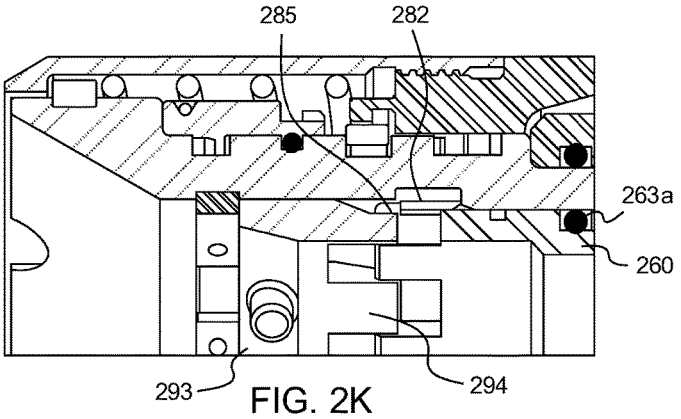
Figure 2L:
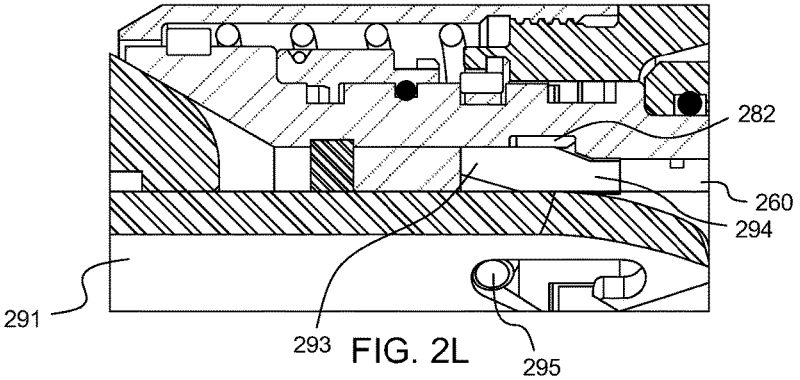
Figure 2M:
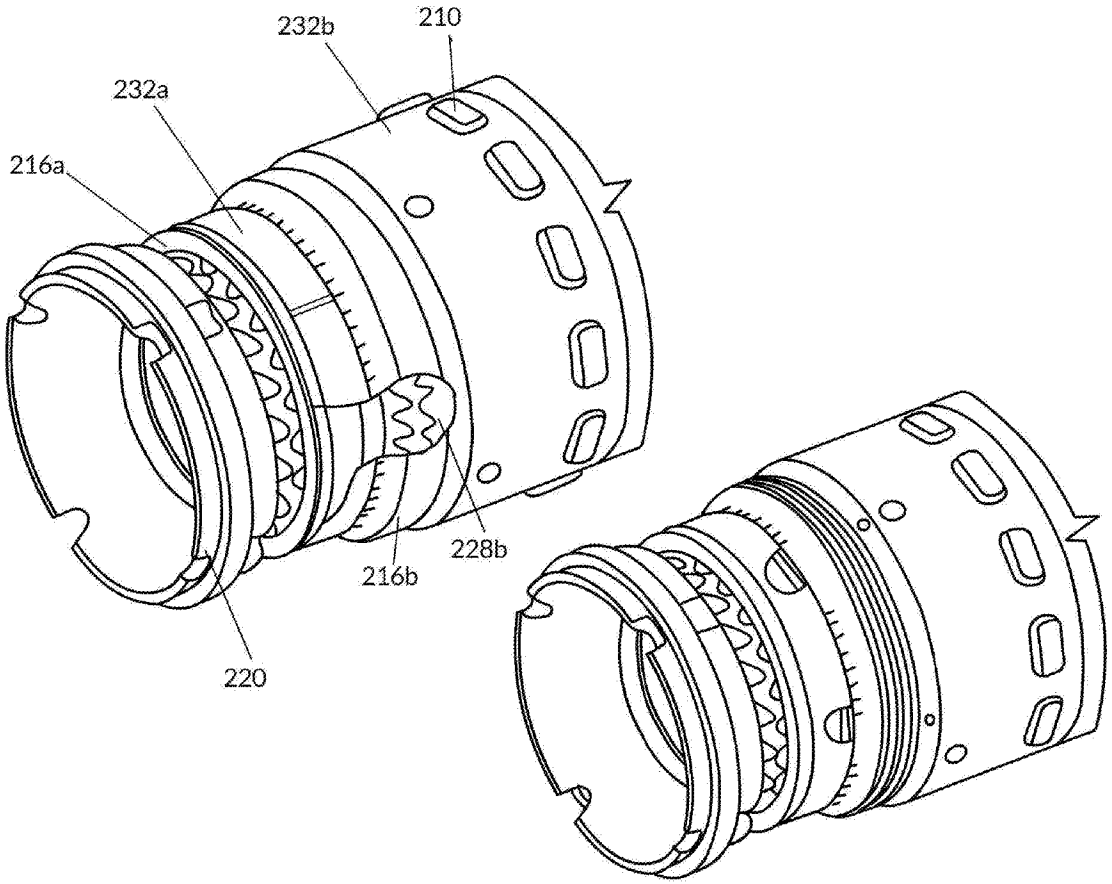

As discussed above, inner sleeve 260 may have already moved forward (due to differential pressure or application of force from tool 290) such that shoulder 285 of inner sleeve comes to rest on the c-ring 282 (see FIGS. 2J and 2K). But, at this point, valve 275 is not yet activated. Application of sufficient force to latch sleeve 293 by tool 290 shifts latch sleeve 293 forward. As it moves forward, latch sleeve fingers 294 force c-ring 282 into the groove on the inner surface of mandrel 220 so that c-ring 282 no longer obstructs shoulders 285 (see FIG. 2L). Thus, application of sufficient force on latch sleeve 293 can cause latch sleeve 293 to slide under c-ring 282 and expand c-ring 282 into the groove on the inner surface of mandrel 220 to allow inner sleeve 260 to be pushed to a valve open position as shown in FIGS. 2E and 2L.

Indexing dart 200 may include alignment features to help align latch tool 491 with latch sleeve 293. For example, a concave or funnel shape of the inner bore of mandrel 220 at rear portion 276 can help guide latch tool 291 into second portion 279 and to latch sleeve 293.

As can be seen in FIG. 2E, with valve 275 open, a continuous flow passage is formed from tool 290 through indexing dart 200. Accordingly, fluids can be circulated through indexing dart 200 to clear dunes, etc. as indexing dart 200 is pushed and/or pulled by tool 290. Tool 290 and indexing dart 200 can be configured so that the preferential flow path for fluids circulated through tool 290 will be through the central bore of indexing dart 200 when tool 290 is inserted in indexing dart 200 and valve 275 is open. For example, the shape of rear portion 276 of the central bore can be selected to create a friction fit with the nose of tool 290. In some embodiments, tool 290 may seal with indexing dart 200.

In one embodiment, nose section 274 and latch tool 204 of indexing dart 200 can have a configuration similar to the nose section and latch tool of tool 290. Thus an indexing dart 200 can be pushed down the tubing string to engage another dart with latch tool 204. In this example, the first dart can be used to push or pull the next dart. It can be noted any number darts can be pushed/pulled together.

Each indexing dart 200 may cause a valve in the next dart to open, thereby opening a continuous flow passage from tool 290 through the darts connected to tool 290. Accordingly, a continuous flow passage can be formed from tool 290 through the darts connected to tool 290 so that fluid can be circulated through multiple darts. Fluid circulated through one or more darts can be used to clear sand dunes or for other purposes.

While the latch tool 204 illustrated comprises a j-slot latch tool, other configurations of latch tools may be used. For example, indexing dart 200 may comprise a collet latching tool or other tool. Moreover, while indexing dart 200's latch tool 204 is similar to latch tool 291, indexing dart 200 may comprise a latch tool having a different configuration than the tool used to recover indexing dart 200. For example, indexing dart 200 may be configured to be recovered by latch tool 291, but may include collet latch tool or other tool extending from its nose. Thus, in some cases, indexing dart 200 may be configured to recover a dart having a different configuration than itself. Moreover, while recovery of indexing dart 200 is described in terms of using a recovery tool, in other embodiments, indexing dart 200 may be flowed back to surface.

In operation of the embodiment of FIG. 2, the control mechanism can be configured to target particular stage/seat in a tubing string. Indexing dart 200 can be deployed down the tubing string where it will autonomously engage with the target dart seat. If indexing dart 200 forms a seal, pressure may be increased above indexing dart 200 to activate a stage, actuate a tool, isolate a portion of the well or for other purposes.

Then, if it is desired to seat an indexing dart in another dart seat, another indexing dart 200 configured to land in the target dart seat can be launched. Since an indexing dart may block the tubing string inner bore, the indexing darts may be launched in an order corresponding to the positions of their target dart seats in the tubing string. For example, the indexing dart targeted to the lowest seat may be launched first, followed by the indexing dart for the next sleeve to be engaged (e.g., the next closest dart seat/sleeve to the surface or any other dart seat/sleeve above an already seated indexing dart) and followed by the indexing dart that is the third to be engaged (e.g., for the sleeve/dart seat that is next closest to surface), and so on.

In a fracture treatment operation, pressure can be increased behind a seated indexing dart 200 to actuate a tool (e.g., to open frac ports, etc.) to fracture a particular stage. After a stage is fractured, the next dart can be launched and the fracturing process repeated. This process can be repeated to successively fracture multiple stages. Using coil or threaded pipe or other tools, indexing dart 200 can be retrieved to the surface or pushed to bottom. According to one embodiment, a recovery tool may be used to push/pull an indexing dart through the tubing string.

FIGS. 3A-3F (collectively FIG. 3) illustrate the operation of one embodiment of an indexing mechanism 300 for an indexing dart. The various embodiments of indexing darts described herein may use an indexing mechanism as described in FIG. 3, or other indexing mechanism.

Indexing mechanism 300 comprises a contact feature that actuates a reciprocating sleeve 314 in response to contact with a dart seat. In this embodiment, the contact feature is provided by a set of dogs that effectively creates an annular protrusion. Each of dogs 310 extends through a reciprocating sleeve 314 (made transparent in FIG. 3). The dogs 310 can translate over a protrusion support 322 to collapse and extend.

In the embodiment illustrated, reciprocating sleeve 314 comprises an upper indexing sleeve 332*a* and a lower indexing sleeve 332*b*. One or more guide pins 328*a* extend radially inward from upper indexing sleeve 332*a* such that the other ends reside in an upper guide slot 316*a*. Similarly, one or more guide pins 328*b* extend radially inward from lower indexing sleeve 332*b* such that the other ends reside in lower guide slot 316*b*.

Guide slots 316 of FIG. 3 comprise walking j-slots. Each walking j-slot can be configured such that, in a first portion of a translation, the sleeve guided by that slot does not rotate, but in a second portion of the translation, the sleeve undergoes an angular displacement as it translates. The upper guide slot 316*a* and lower guide slot 316*b* may have different configurations such that upper indexing sleeve 332*a* and lower indexing sleeve 332*b* undergo a different amount of angular displacement over a single longitudinal translation. That is, one of the j-slots may walk faster than the other. Thus, the rotational orientation of the upper indexing sleeve 332*a* and lower indexing sleeve 332*b* relative to each other will change as reciprocating sleeve 314 translates.

Upper indexing sleeve 332*a* and lower indexing sleeve 332*b* can be keyed or otherwise configured to separate when a particular rotational orientation is achieved. In the embodiment illustrated in FIG. 3, an upper portion of lower indexing sleeve 332*b* has an inner diameter that is greater than the outer diameter of a lower portion of upper indexing sleeve 332*a*. Accordingly, a portion of upper indexing sleeve 332*a* may be inserted into a portion of lower indexing sleeve 332*b*. The lower portion of upper indexing sleeve 332*a* includes projections 335 that project radially outward. Projections 335 may be trapped by a shoulder or edge of lower indexing sleeve 332*b* through a range of rotational orientations so that upper indexing sleeve 332*a* and lower indexing sleeve 332*b* cannot separate. However, as shown, the upper portion of lower indexing sleeve 332*b* includes channels 337 through which the projections 335 can pass. Accordingly, when projections 335 are aligned with channels 337, the upper and lower indexing sleeves can separate.

Figure 3A:
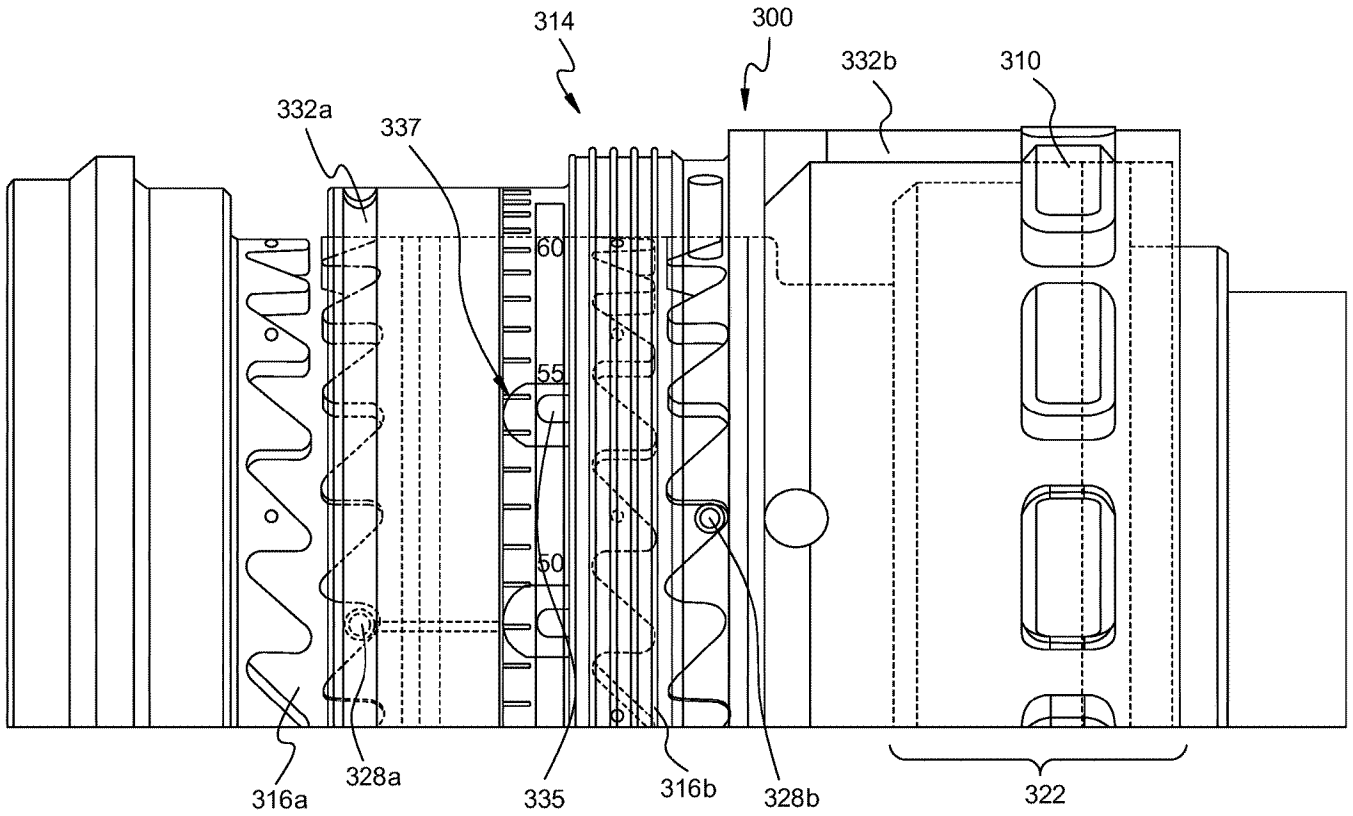
FIGS. 3A-3F are a diagrammatic representations of one embodiment of a selective engagement mechanism for an indexing dart in various states of operation.
Figure 3B:
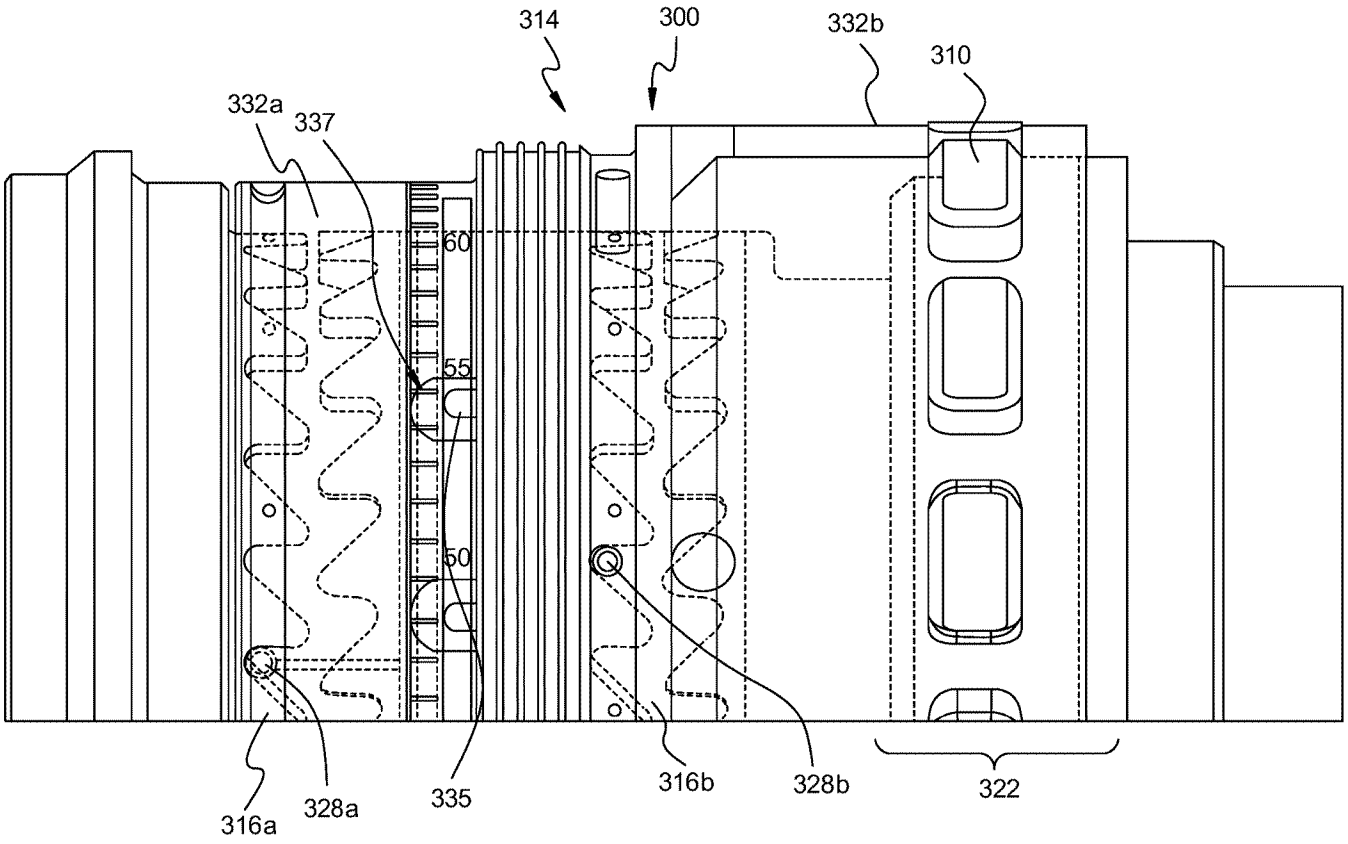
Figure 3C:
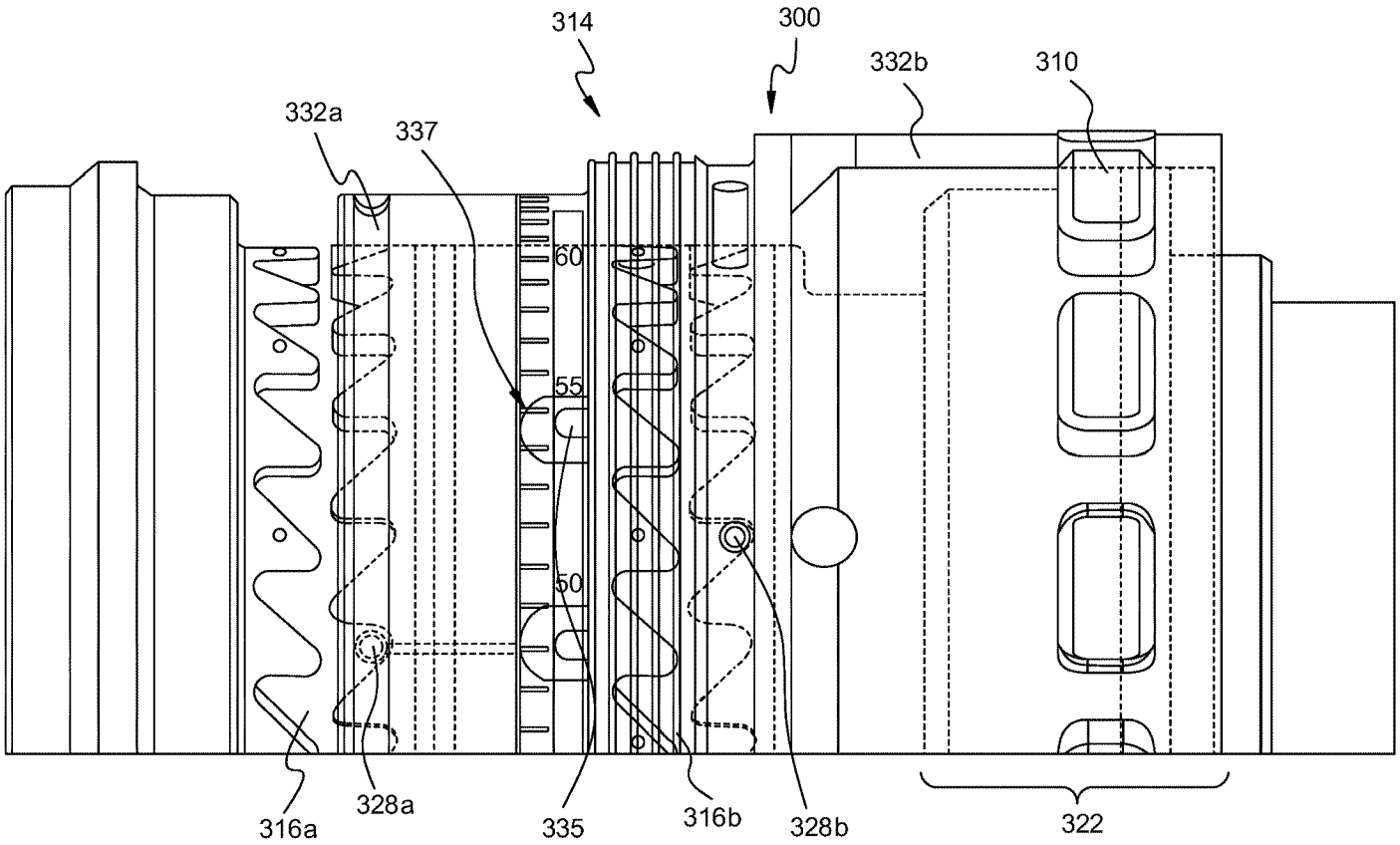

Because indexing sleeves 332*a* and 332*b* undergo different angular displacements as reciprocating sleeve 314 actuates, the indexing sleeves 332*a* and 332*b* rotate relative to each other. The starting angular displacement between projections 335 and channels 337 will determine how many times the sleeve must actuate before projections 335 and channels 337 are aligned and indexing sleeves 332*a* and 332*b* can separate. The indexing dart of FIG. 3 can be configured to target a particular dart seat by placing the guide pins 328 of upper indexing sleeve 332*a* and lower indexing sleeve 332*b* at appropriate starting places in guide slots 316*a* and 316*b*, respectively. Reciprocating sleeve 314 may include index markings that indicate to the operator the dart seat to which the indexing dart is targeted or how many dart seats the indexing dart will pass through before activating an engagement feature. In the example of FIG. 3A, the indexing mechanism is set so that the dogs engage after the second seat to land at the next dart seat (e.g., at sleeve assembly 158*c* of FIG. 1 when the indexing dart is run in from the surface).

In operation, dogs 310 are initially extended and reciprocating sleeve 314 is in a forward position. When dogs 310 contact the first dart seat in a tubing string 110, dogs 310 shift back along protrusion support 322, thereby collapsing to allow the indexing dart to pass through the first dart seat and actuating reciprocating sleeve 314 back. Pins 328*a*, 328*b* move in the respective guide slots 316*a*, 316*b* to the positions illustrated in FIG. 3B. The longitudinal translation of reciprocating sleeve 314 results in upper indexing sleeve 332*a* rotating a greater amount than lower indexing sleeve 332*b*, bringing projections 335 and channels 337 relatively closer to one another.

When force is released from dogs 310, a biasing member (not shown) can bias reciprocating sleeve 314 forward to move dogs 310 over protrusion support 322 so that they extend. As reciprocating sleeve 314 translates forward, pins 328*a*, 328*b* move to the positions illustrated in FIG. 3C, thereby causing upper indexing sleeve 332*a* and lower indexing sleeve 332*b* to rotate relative to each other. Again, the angular distance between projections 335 and channels 337 decreases.

When dogs 310 contact the next dart seat (e.g., the second dart seat) in a tubing string, dogs 310 can shift back along protrusion support 322, again actuating reciprocating sleeve 314 back and collapsing dogs 310. Pins 328*a*, 328*b* move in the respective slots 316*a*, 316*b* to the positions illustrated in FIG. 3D. Movement of pins 328*a* and 328*b* in guide slots causes upper indexing sleeve 332*a* and lower indexing sleeve 332*b* to rotate relative to each other to a rotationally aligned orientation in which projections 335 and channels 337 are now aligned with one another.

Figure 3D:
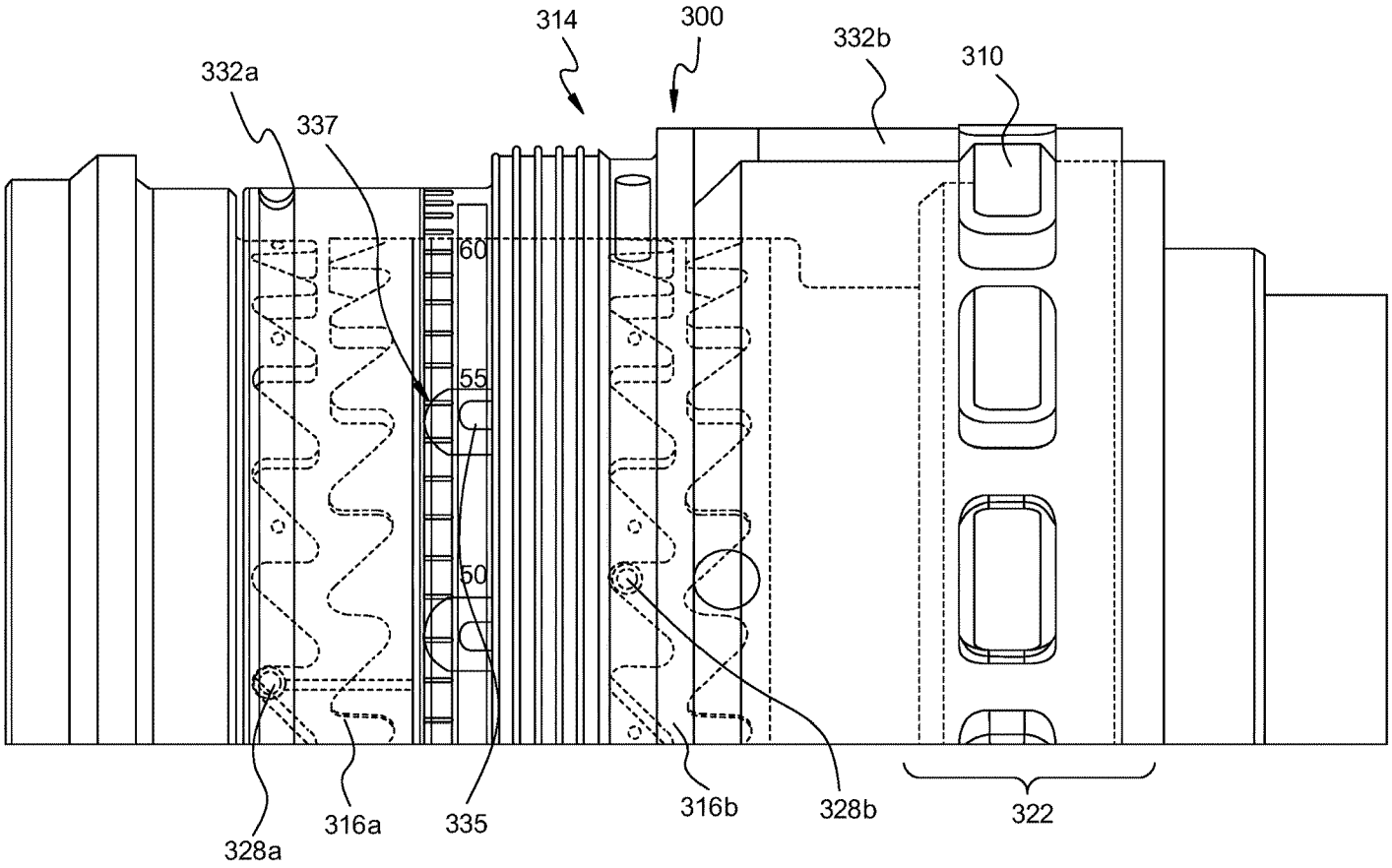
Figure 3E:
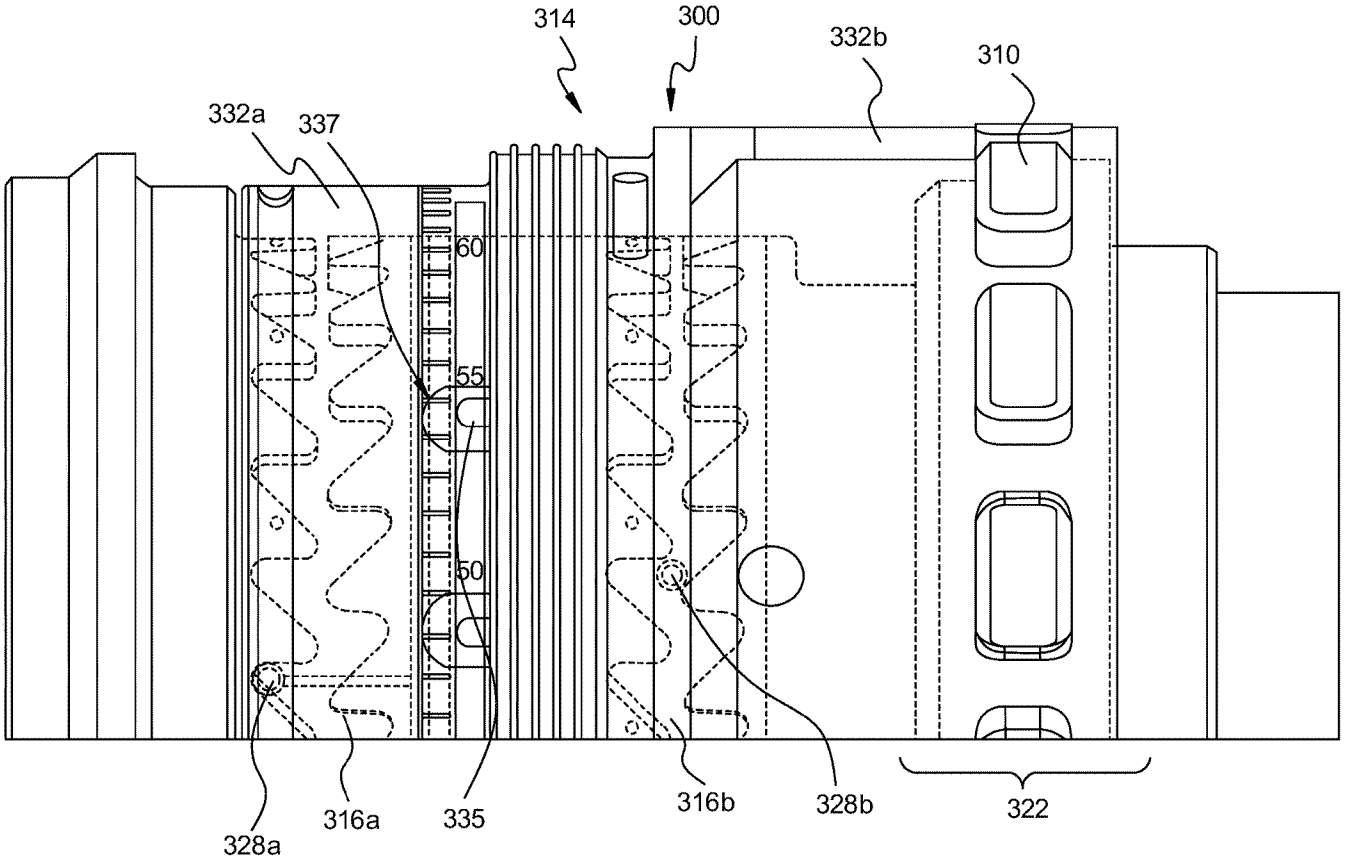
Figure 3F:
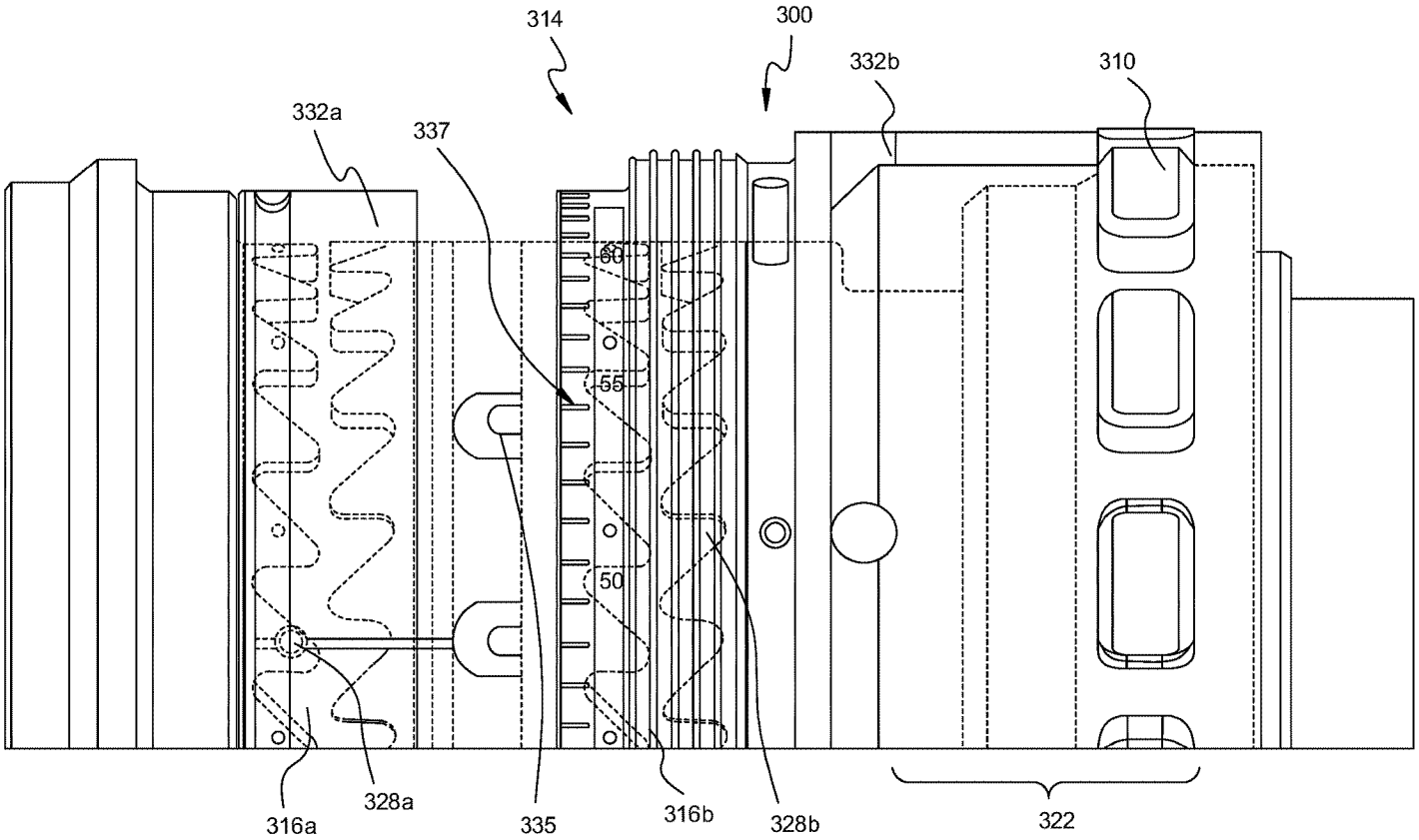

Referring to FIG. 3D, when force is released from dogs 310, the biasing member (not shown) can bias the lower indexing sleeve 332*b* forward. Because projections 335 are aligned with channel 337, lower indexing sleeve 332*b* can separate from upper indexing sleeve 332*a* as illustrated in FIGS. 3E-3F. As discussed in conjunction with FIG. 2, the separation of the indexing sleeves results in activating a locking mechanism that locks the protrusions in an extended position, thus engaging the indexing dart at the targeted dart seat.

It can be noted that the guide slots 316*a* and 316*b* can be configured to cause indexing sleeves 332*a* and 332*b* to rotate particular amounts to achieve a desired relative rotation between them each time they actuate. For example, j-slots can be configured such that upper indexing sleeve 332*a* rotates 18 degrees (9 degrees on each of the forward and back strokes) and lower indexing sleeve 332*b* rotates 12 degrees (6 degrees on each of the forward and back strokes) each cycle such that the relative angular displacement between projections 335 and channels 337 is 6 degrees each cycle (3 degrees on each of the forward and back strokes). In an arrangement such as illustrated in FIG. 2 where the indexing sleeves will only separate after the end of rearward stroke (e.g., due to the positioning of the biasing member 226), this means that the sleeves rotate 6 degrees relative to each other between each point at which they can potentially separate (e.g., upper indexing sleeve 332*a* and lower indexing sleeve 332*b* rotate six degrees relative to each other between FIGS. 3B and 3D). Since there are sixty increments of six degrees before upper indexing sleeves 332*a* and lower indexing sleeve 332*b* rotate fully relative each other, the indexing mechanism can be configured to count up to sixty stages. If the relative change is reduced from 6 degrees to 4 degrees, indexing mechanism 300 can be configured for up to 90 stages. Similarly, if the relative change is reduced to 3 degrees, indexing mechanism can be configured for up to 120 stages, and so on. Moreover, for a configuration in which there is a six degree relative rotation per cycle, the stage count can be increased to 120 by configuring the indexing sleeves such that they can separate on either the rear or forward stroke. Similar relative changes in relative rotation can reduce or increase the number of stages that can be activated using the indexing darts.

As would be appreciated by the skilled artisan, darts used in fracturing and other wellbore operations may operate under extreme conditions. Fracturing equipment, for example, may operate over a range of pressures and injection rates, including pressures that exceed 10,000 psi and in some cases exceed 15,000 psi and injection rates that exceed 200 liters per second and in some cases exceed 250 liters per second. The use of multiple j-slots in an indexing mechanism within an indexing dart facilitates a robust mechanical design capable of handling high pressure with a high number of stages.

More particularly, to increase the resolution of a single circumferential j-slot—that is, to decrease the angular displacement induced in a follower per cycle—the number of "Js" typically increases. For example, a single walking j-slot that induces an 18 degree rotation in a follower per cycle may have 20 Js while a single walking j-slot that achieves a 12 degree rotation in a follower per cycle may have 30 Js and a single walking j-slot that achieves a six degree rotation per cycle in a follower may have 60 Js. As the number of Js on a given diameter increases to achieve a finer resolution, the width of the j-slot must decrease to fit the Js. Accordingly, a j-slot with a finer resolution will use a thinner pin than a j-slot having more Js about the same diameter. This typically means that as the resolution increases, the mechanical integrity of the pin decreases (assuming similar materials, etc.)

The arrangement of FIG. 3, however, provides a physically stronger indexing mechanism than a single j-slot having the same number of segments. In arrangement of FIG. 3, a slot that has 20 Js (e.g., to achieve 18 degrees rotation per cycle) and a slot that has 30 Js (e.g., to achieve 12 degrees rotation per cycle) can be used together to achieve a relative rotation of six degrees per cycle, effectively achieving the same resolution as single j-slot having 60 Js, while maintaining the ability to use thicker pins than could be used with the single 60 j-slot. Accordingly, the arrangement of FIG. 3 is able to operate under higher pressures than a single j-slot embodiment having the same resolution.

It can be noted that the foregoing discussion regarding j-slots having a particular number of Js was provided by way of explanation and not limitation. The guide slots of the various embodiments (e.g., guide slots 216, 316, etc.) may include any number of Js. Moreover, the guide slots may have profiles other than Js to create desired motion in a follower (e.g., reciprocating sleeves 214, 314).

While the embodiment of FIG. 3 illustrates two j-slots, other embodiments of an indexing mechanism may use a single j-slot. For example, upper or lower guide slot 316 may be a longitudinal slot while the other guide slot is a j-slot or other guide slot that induces rotation. In yet another embodiment, there may be only a single guide slot. Still other embodiments may include more guide slots. For example, an indexing mechanism could use three j-slots and three interlocked rotating sleeves.

In some embodiments, a dart may include a mechanism to pack off the dart. For example, the dart can include a mechanism to energize sealing element 202 or other sealing element. The mechanism may be energized by hydraulic pressure, a tool or other energy source to pack off the dart to ensure a high pressure seal. FIGS. 4A-4E (collectively FIG. 4) are diagrammatic representations of another embodiment of an indexing dart 500 is similar to indexing dart 200, but with some additional features, including a pack off mechanism to energize annular sealing element 540 to seal with an inner bore of a dart seat.

Indexing dart 500 may include an annular seal that can be energized. According to one embodiment, annular seal 540 can be a flexible seal that creates an interference fit with the bore of a dart seat. Annular seal 540 can be configured to provide a sufficient seal with an inner bore of a dart seat prior to energizing so that pressure can be increased above indexing dart 500 to create a pressure differential across indexing dart 500. A piston 544 is operatively coupled to seal 540 so that seal 540 can be compressed to bulge radially outward when the piston actuates. In the embodiment illustrated, for example, the forward end of seal seat 542 is formed by a first piston face 545. A second piston face 546 is in communication, for example through port 574, with a central bore of indexing dart 500. Accordingly, when indexing dart 500 is seated and pressure is increased behind indexing dart 500, the pressure can cause piston 544 to actuate longitudinally, thereby compressing seal 540 longitudinally and causing seal 540 to bulge laterally to create a tighter seal. Energizing the seal allows indexing dart 500 to maintain a seal under higher pressures, for example, greater than 20,000 psi in some embodiments. Furthermore, by having a way to energize the seal, the indexing dart 500 can have a wide variety of seal designs and can potentially be used with a larger bore and larger number of environments than an otherwise similar dart having a seal that cannot be energized.

FIG. 4 also illustrates that the valve actuator may further include a valve actuation member 582 disposed in the inner bore of mandrel 520 in front of inner sleeve 560. In the embodiment illustrated, there is a gap between the lower end of inner sleeve 560 and the upper end of valve actuation member 582. Inner sleeve 560 may translate forward to the position shown in FIG. 4C in which locking mechanism 559 has dropped into recess 562 and inner sleeve 560 contacts valve actuation member 582. Inner sleeve 560 may continue to translate forward, pushing valve actuation member 582 to actuate valve 575. Valve actuation member 582 can also be configured such that it can be shifted by a tool independently of inner sleeve 560. Therefore, valve 575 can be opened without shifting inner sleeve 560 (e.g., such that valve 575 can be opened without inner sleeve 560 disengaging annular protrusion 510).

Whether shifted by a tool or pushed by inner sleeve 560, valve actuation member 582 can translate forward from a first position to a second position. During this translation, valve actuation member 582 can contact an arm 583, latch or other feature to mechanically actuate valve 575. In some cases, actuation member 582 may have an inner bore having a greater diameter than latch tool 580 or other tubular member such that actuation member 582 may slide over a portion of latch tool 580. Actuation member 582 may also include setting features to lock valve 575 in an open position.

Figure 4A:
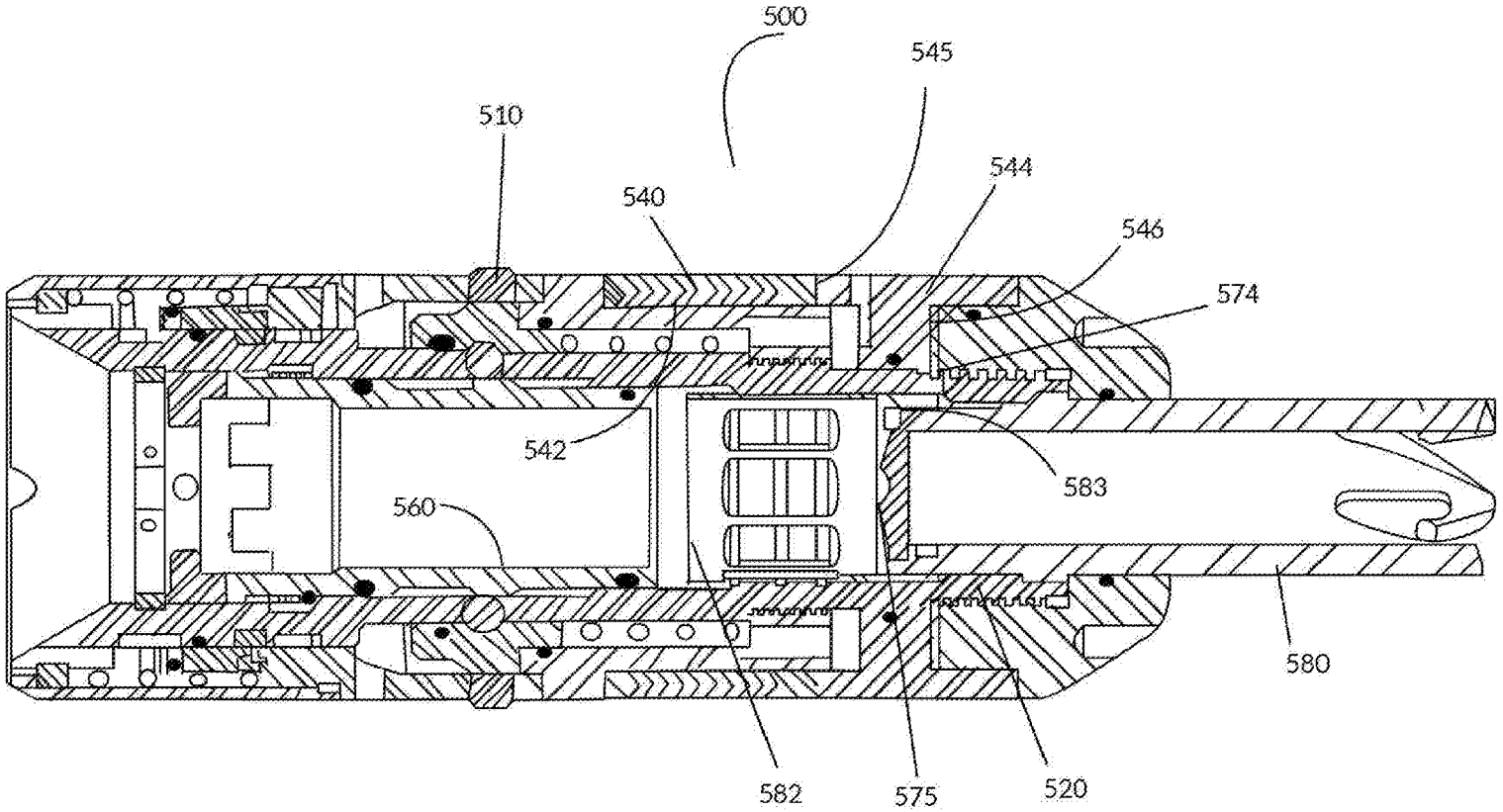
FIGS. 4A-4F are diagrammatic representations of another embodiment of a wellbore dart.
Figure 4B:
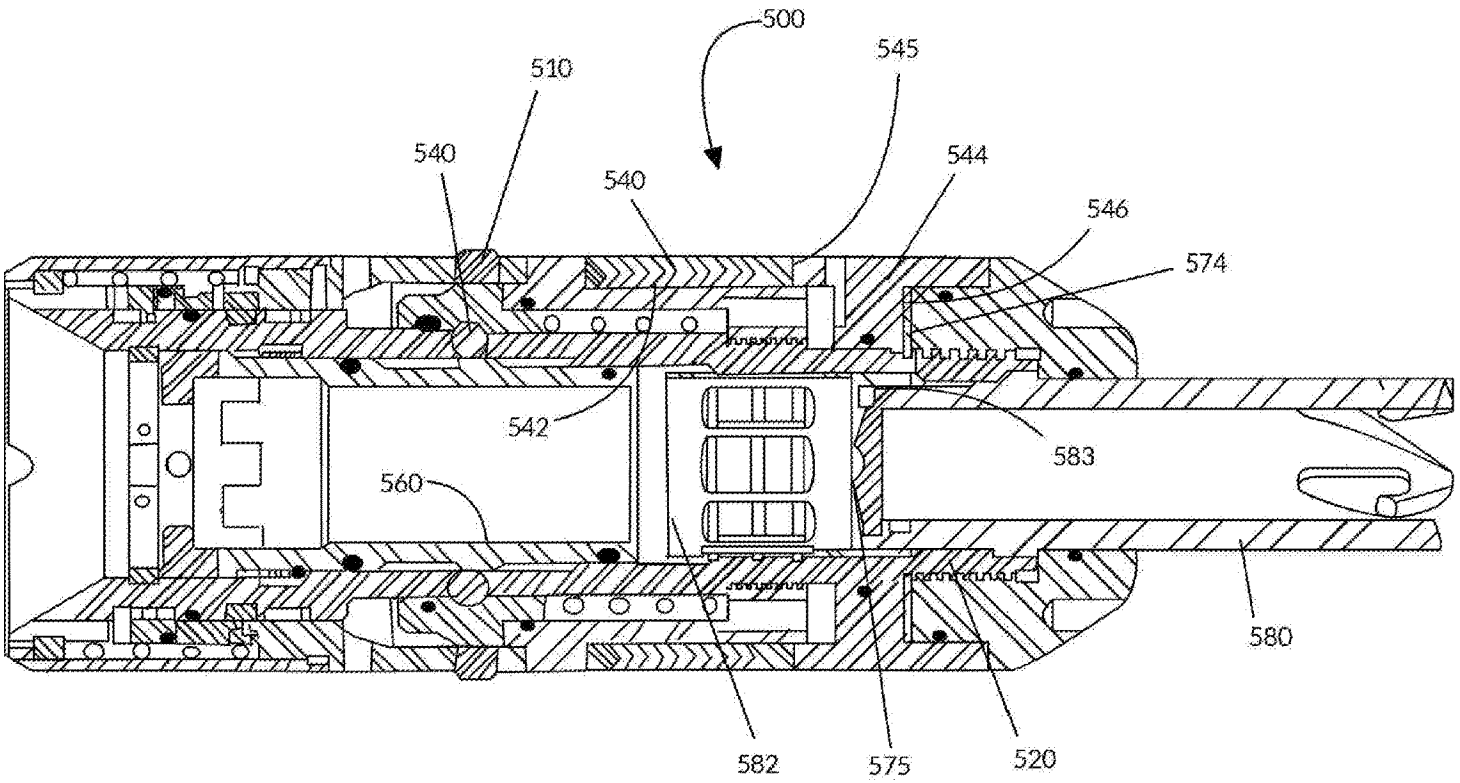
Figure 4C:
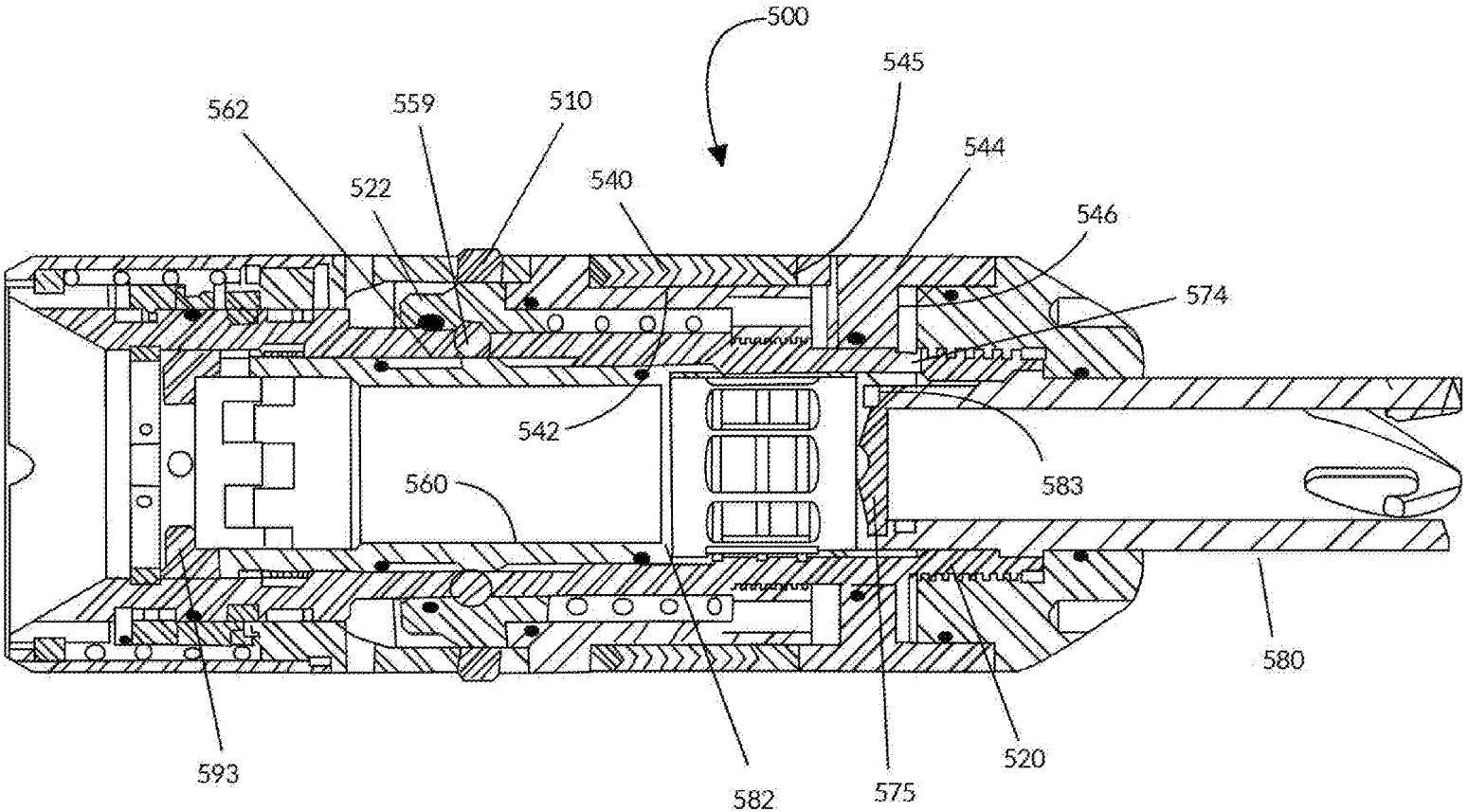

FIG. 4A illustrates indexing dart 500 in a run-in configuration in which annular protrusion 510 can collapse to a position that allows indexing dart 500 to pass through dart seats in the tubing string. In this configuration, seal 540 is not activated. FIG. 4B illustrates indexing dart 500 in a locked out configuration in which annular protrusion 510 extends to engage indexing dart 500 at a dart seat within the tubing string. Seal 540 may create a seal with the dart seat such as through an interference fit. Pressure can be increased to create a pressure differential across indexing dart 500 to energize seal 540. More particularly, because the area below piston is connected to a higher pressure area (e.g., the central bore of indexing dart 500), piston 544 can been energized to longitudinally compress seal 540 as illustrated in FIG. 4C. This causes seal 540 to bulge out, thereby increasing the sealing force between seal 540 and the dart seat. Furthermore, the pressure differential can cause sleeve 560 to shift forward to a release position that releases protrusion support locking member 559. However, differential pressure across protrusion support 522 can continue to prevent protrusion support 522 from moving.

Figure 4D:
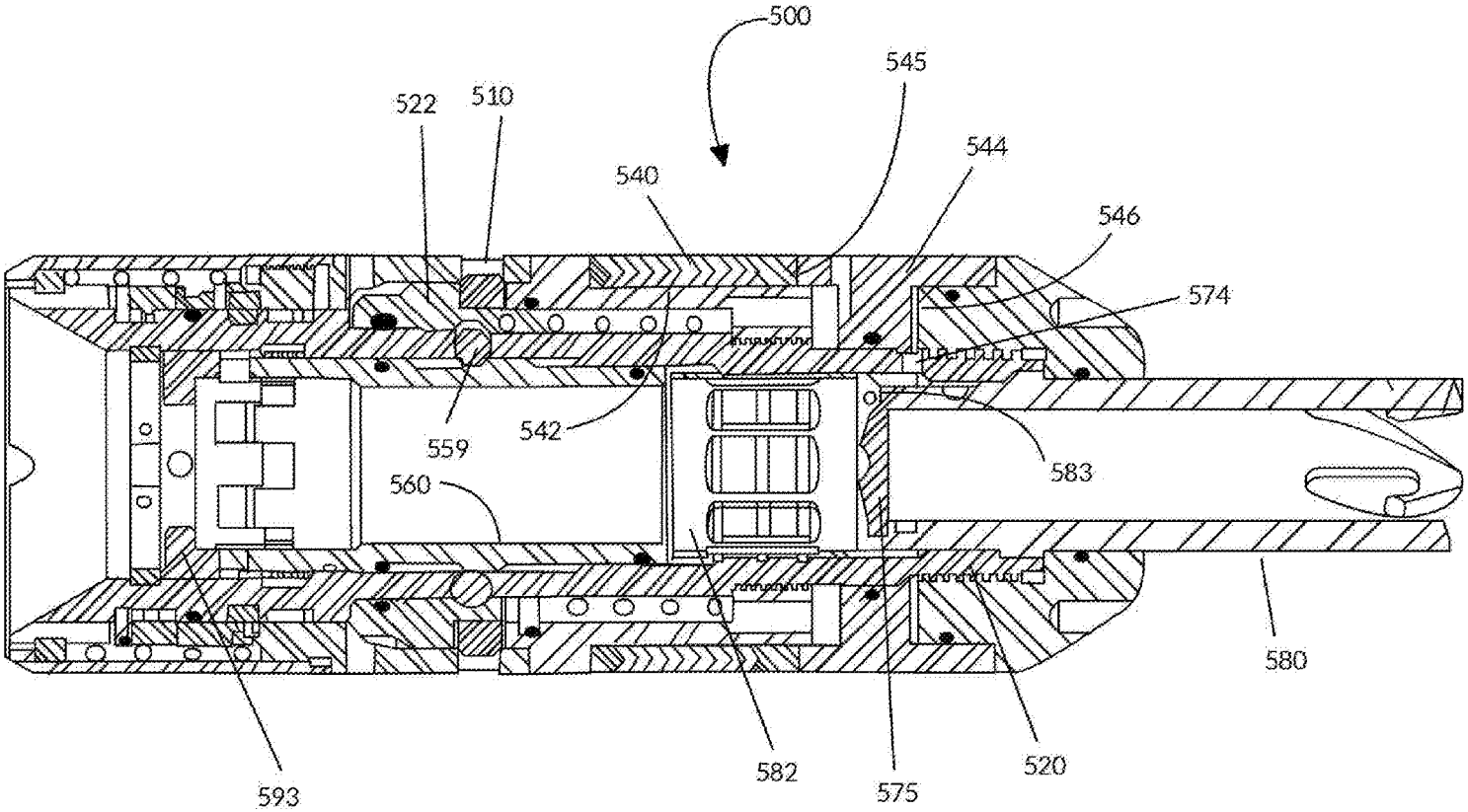
Figure 4E:
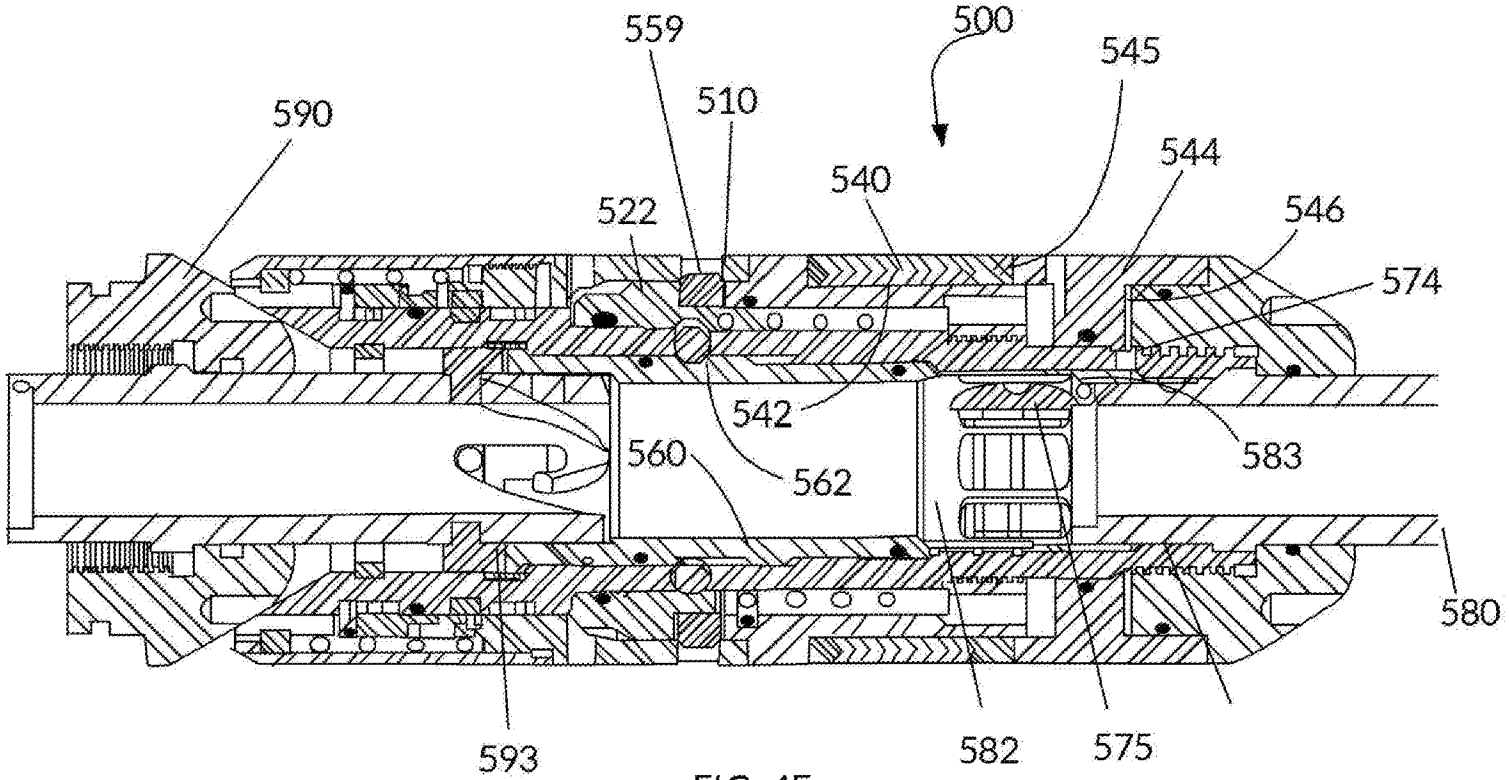
Figure 4F:
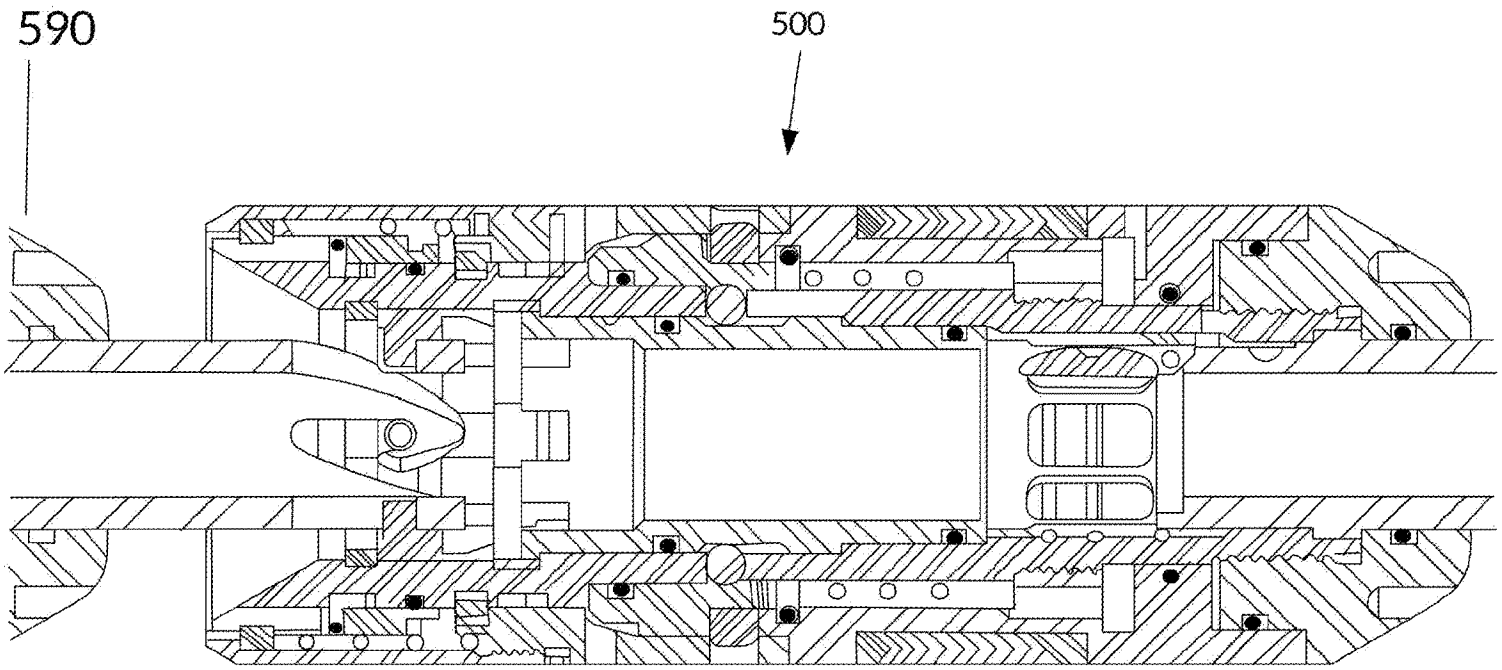

When pressure equalizes across indexing dart 500 (e.g., such as when stimulation pressure bleeds off or a zone begins producing), protrusion support 522 can shift so that annular protrusion 510 collapses as shown in FIG. 4D. In addition, piston 544 can been deactivate as also shown in FIG. 4D.

Tool 590 can be used to open valve 575 in a manner similar to that discussed in conjunction with FIG. 2, except that in the embodiment of FIG. 4, latch sleeve 593 pushes inner sleeve 560, which in turn pushes actuation member 582, causing the valve 575 to open. Tool 590 can then pull indexing dart 500 up the well (e.g., as shown in FIG. 4F) or push indexing dart 500 down the well.

FIGS. 5A-5D (collectively FIG. 5) illustrate an indexing dart 600 similar to indexing dart 200 but having another example of a valve actuator. In the embodiment of FIG. 5, a valve actuation member 684 is disposed in inner sleeve 660. Valve actuation member 684 may include a releasable setting device, such as a collet or a spring that holds valve actuation member 684 in place in inner sleeve 660 until the holding force of the setting device is overcome, such as by a force asserted by a tool. When the holding force is overcome, valve actuation member 684 moves forward until valve actuation member 684 engages inner sleeve 660. For example, valve actuation member may include detents, shoulders or other features that engage with recesses, shoulders etc. on the inner surface of inner sleeve 660. In this configuration, a portion of valve actuation member 684 can overhang the front of inner sleeve 660. Continued application of force can overcome a holding force holding inner sleeve 660 in place, allowing inner sleeve 660 and valve actuation member 684 to translate such locking member drops into recess 662 and the end of valve actuation member 684 actuates valve 675.

FIG. 5 also illustrates another embodiment of a latch sleeve. In this embodiment, inner sleeve 660 acts as a latch sleeve and includes a keeper feature 695 (e.g., pin, boss or other feature) with which a latch tool can engage.

Figure 5A:
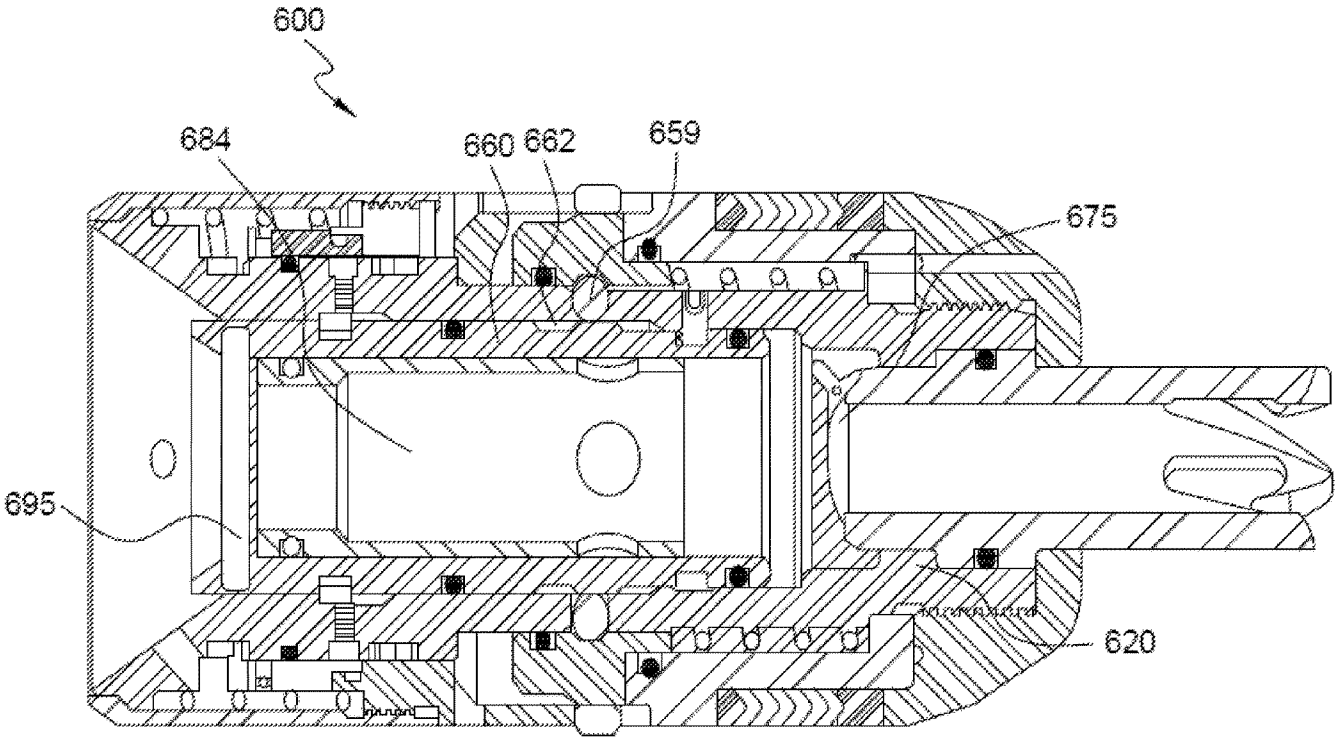
FIGS. 5A-5D are diagrammatic representations of another embodiment of a wellbore dart.
Figure 5B:
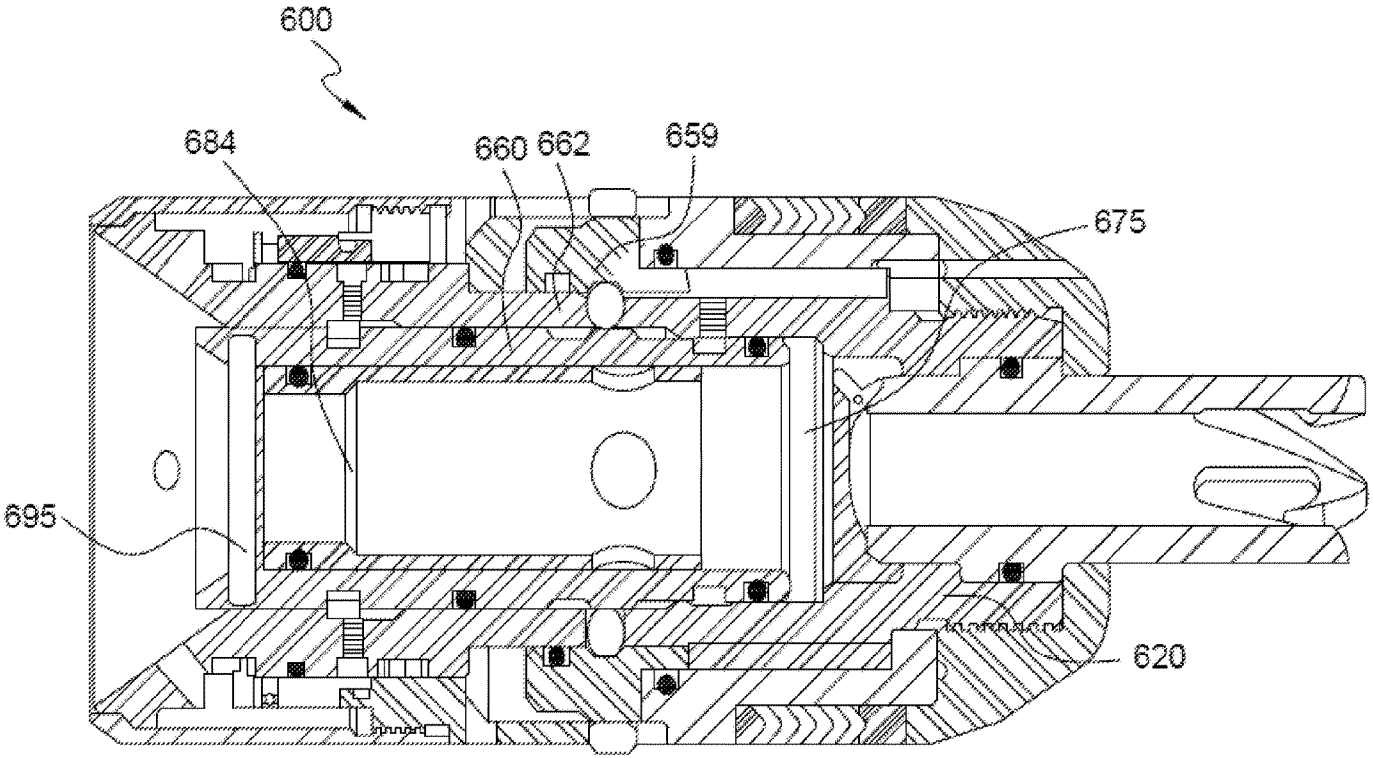
Figure 5C:
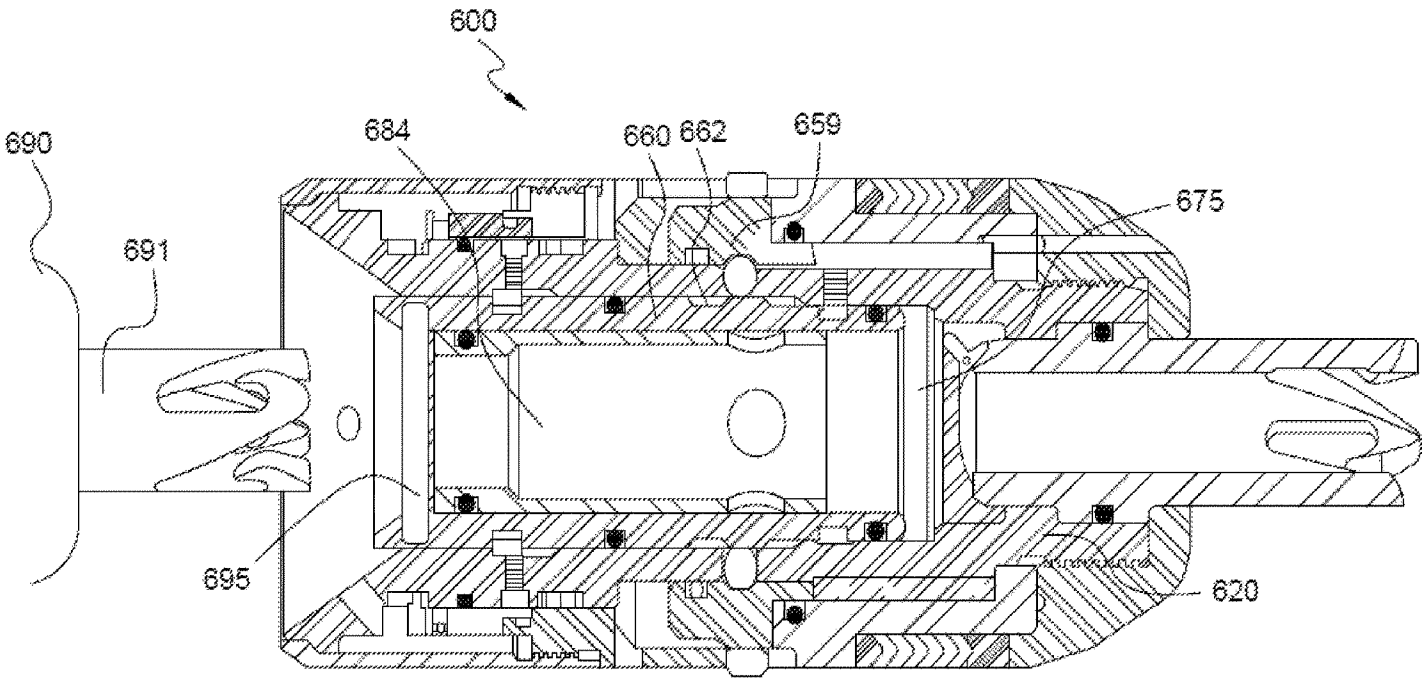
Figure 5D:
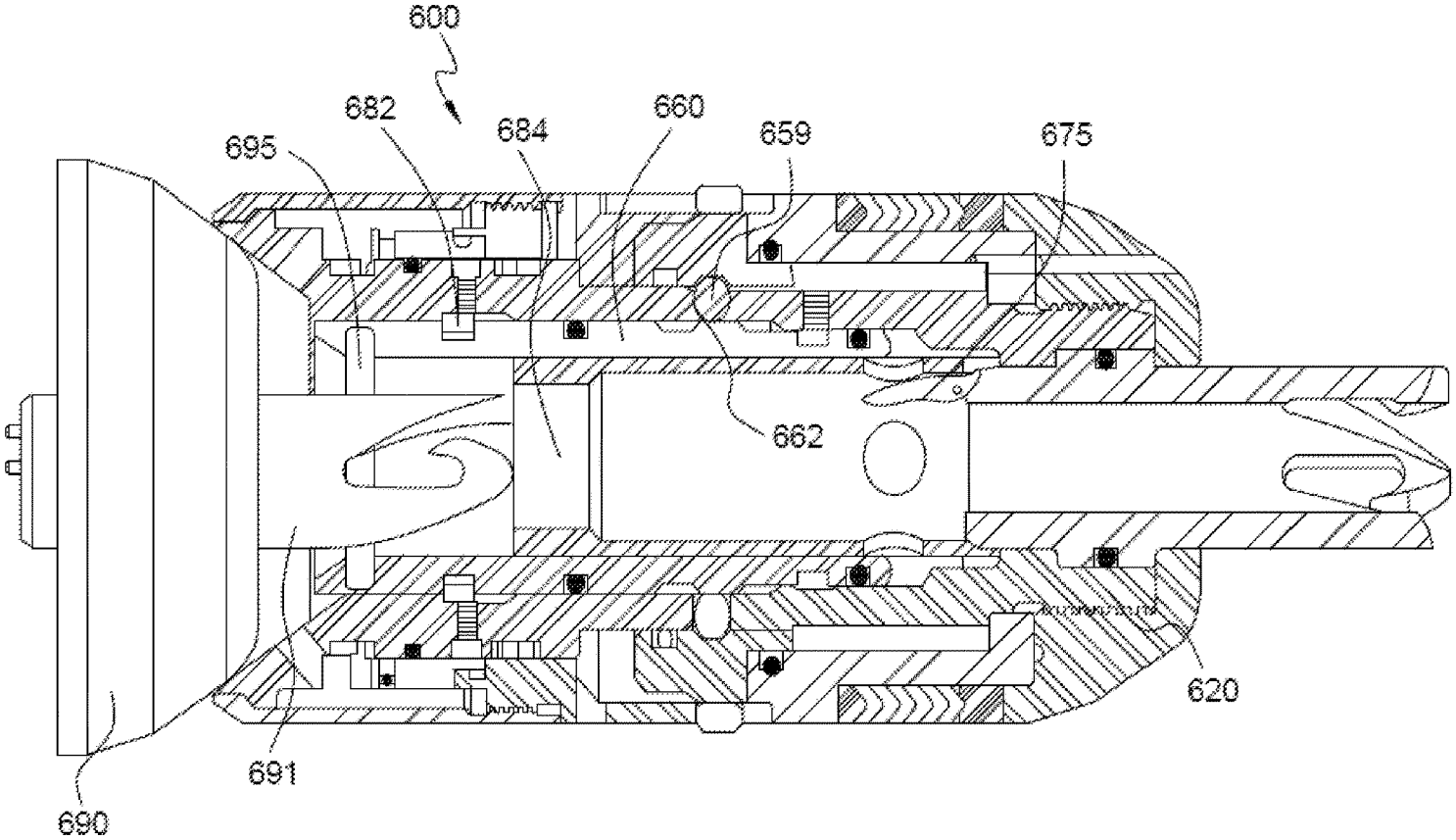

With reference to FIGS. 5C and 5D, the end of a latch tool 691 can enter inner sleeve 660 and push valve actuation member 684 forward. The end of j-slots in the latch tool 691 can come in contact with keeper feature 695 disposed in inner sleeve 660. Latch tool 691 can push both inner sleeve 660 and valve actuation member 684 forward. Inner sleeve 660 can continue to move forward so that recess 662 releases locking member 659. Valve actuation member 684 can move forward to actuate valve 675. According to one embodiment, valve actuation member 684 and inner sleeve 660 are configured so that valve actuation member 684 actuates valve 675 as or before locking member 659 drops into recess 662. In other embodiments, they are configured so that locking member 659 releases before valve 675 begins to open.

The tool 691 may also engage keeper feature 695 to pull inner sleeve 660. A locking feature, such as c-ring 682 acting against a shoulder of mandrel 620 and groove in inner sleeve 660 may limit the backward motion of inner sleeve 660 in mandrel 620. Accordingly, the tool may pull indexing dart 600 out of the tubing string. Tool 690 can push/pull indexing dart 600 to a desired location in the string.

Figure 6:
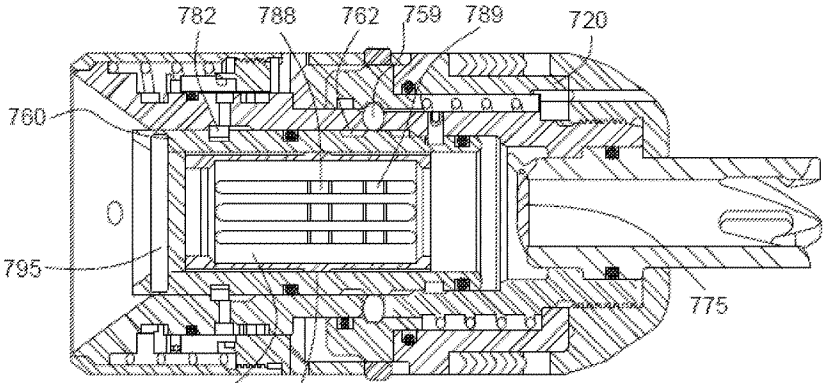
FIG. 6 is a diagrammatic representation of another embodiment of a wellbore dart.

FIG. 6 illustrates an embodiment of an indexing dart 700 similar to indexing dart 600 but having a different design of valve actuation member. Valve actuation member 784 may include a releasable setting device, such as a collet or a spring, which holds valve actuation member 784 in place in inner sleeve 760 until the holding force of the setting device is overcome, such as by a force asserted by a tool. In the embodiment illustrated, valve actuation member 784 comprises a collet or other mechanism to bias protrusions 786 radially outward so that the protrusions 786 seat in an upper recess 788 on the inner surface of inner sleeve 760. When the holding force is overcome, valve actuation member 784 moves forward until protrusions 786 engage lower recess 789 on the inner surface of inner sleeve 760. In this configuration, a portion of valve actuation member 784 can overhang the front of inner sleeve 760. Continued application of force can overcome a holding force holding inner sleeve 760 in place, allowing inner sleeve 760 and valve actuation member 784 to translate such that the end of valve actuation member 784 actuates valve 775.

In the embodiment illustrated in FIG. 6, the end of a latch tool can move valve actuation member 784 to a forward position relative to inner sleeve 760. The latch tool may then contact keeper feature 795 (e.g., pin, boss or other feature) disposed in inner sleeve 760, pushing inner sleeve 760 forward so that recess 762 aligns with locking member 759 and valve actuation member 784 actuates valve 775. According to one embodiment, valve actuation member 784 and inner sleeve 760 are configured so that valve actuation member 784 actuates valve 775 as or before locking member 759 drops into recess 762 on the outer surface of inner sleeve 760. In other embodiments, inner sleeve 760 and valve actuation member 784 are configured so that locking member 759 releases before valve 775 begins to open.

The tool may also engage keeper feature 795 to pull inner sleeve 760. A locking feature, such as c-ring 782 acting against a shoulder of mandrel 720 and groove in inner sleeve 760 may limit the backward motion of inner sleeve 760 in mandrel 720. Accordingly, the tool may pull indexing dart 700 out of the tubing string.

Figure 7:
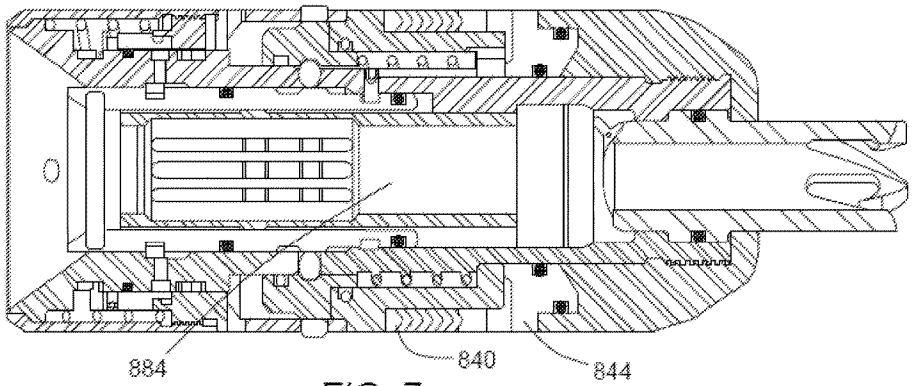
FIG. 7 is a diagrammatic representation of another embodiment of a wellbore dart.

FIG. 7 is a diagrammatic representation of an indexing dart 800 that is similar to indexing dart 700 but has a seal 840 and piston 844 that can be energized similar to seal 540 and piston 544 of indexing dart 500 of FIG. 4. Valve actuation member 884 is similar to valve actuation member 784 but is extended to compensate for a longer dart. (The valve actuation mechanism operates similarly as described in FIG. 6).

Figure 8A:
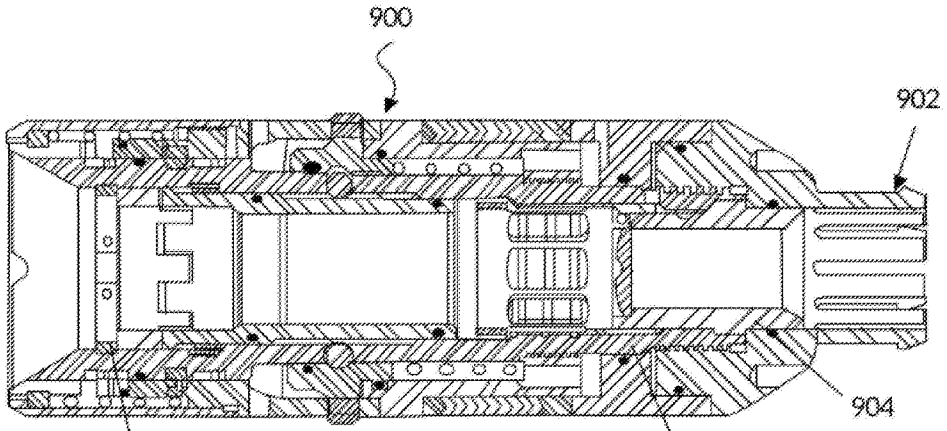
FIGS. 8A-8B are diagrammatic representations of another embodiment of a wellbore dart.
Figure 8B:
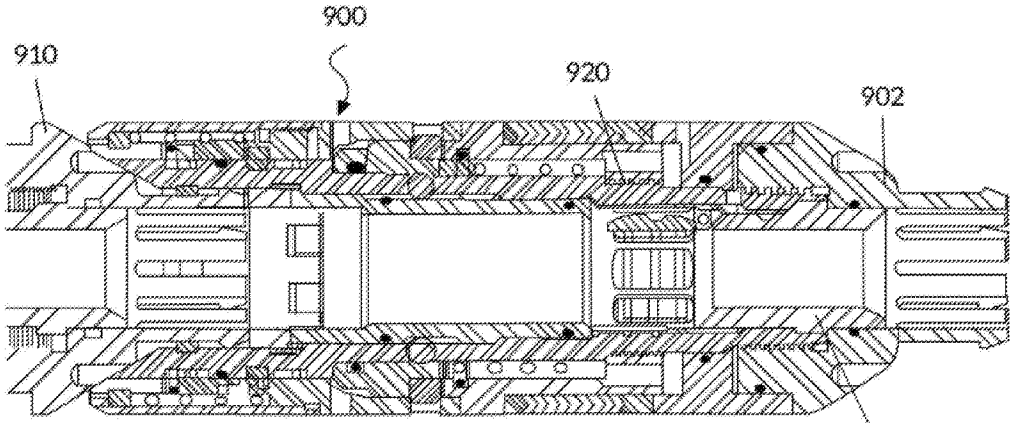
Figure 9:
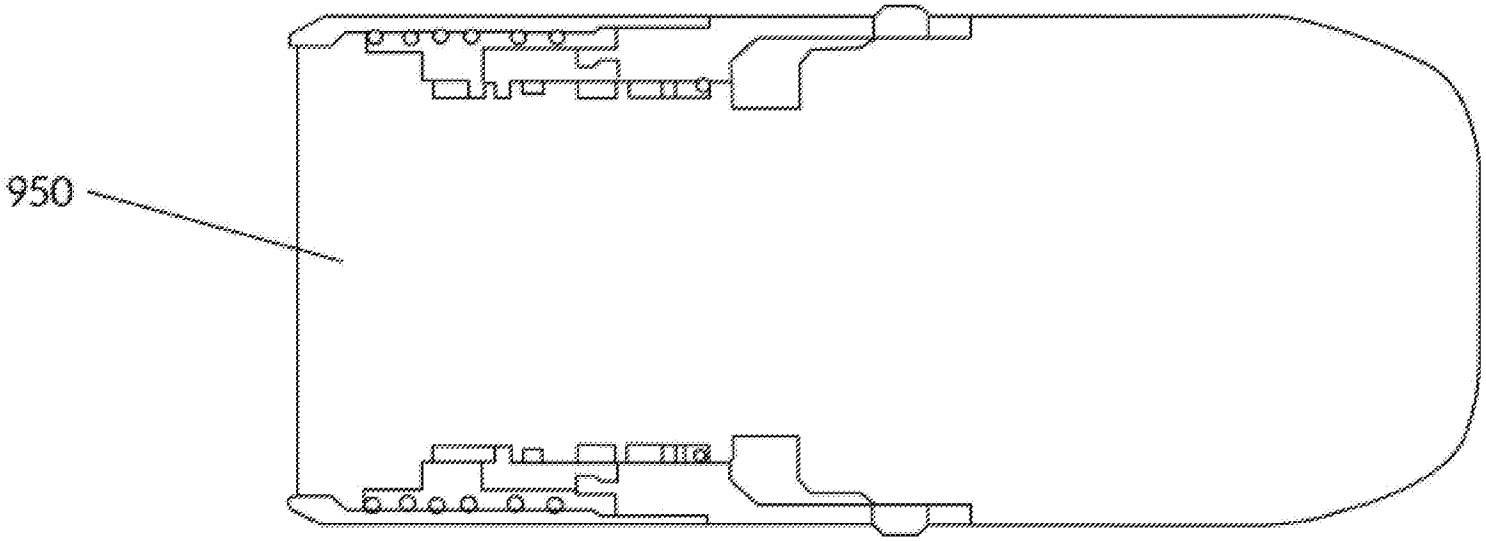
FIG. 9 is a diagrammatic representation of another embodiment of a wellbore dart.

FIGS. 2 and 4-7 above illustrate a particular example of a latch tool that extends extending from the nose section of the indexing darts. However, indexing darts may include a variety of recovery tool structures. FIGS. 8A and 8B, for example, illustrate an embodiment of indexing dart 900 similar to indexing dart 500, except that indexing dart 900 includes a collet latch tool 902. Moreover, rather than passing through the nose section, latch tool 902 is disposed on the nose section of indexing dart 900. A tubular member 904 extends from the central bore of a mandrel 920 to the central opening through the nose section about which the latch tool 902 is disposed to create a flow passage through indexing dart 900. Other latching tools, such as j-slot latching tools, may also be arranged in this or other suitable manners.

FIG. 8 also illustrates that indexing darts may be configured to be recovered by a variety of latching tools. In this example, indexing dart 900 includes a latch sleeve 906 with features that can be engaged by a tool 910 (including another indexing dart) having a collet latching tool. Thus, as illustrated in FIG. 8, a dart may be configured with a variety of latching tools and features to facilitate recovery.

Figure 10:
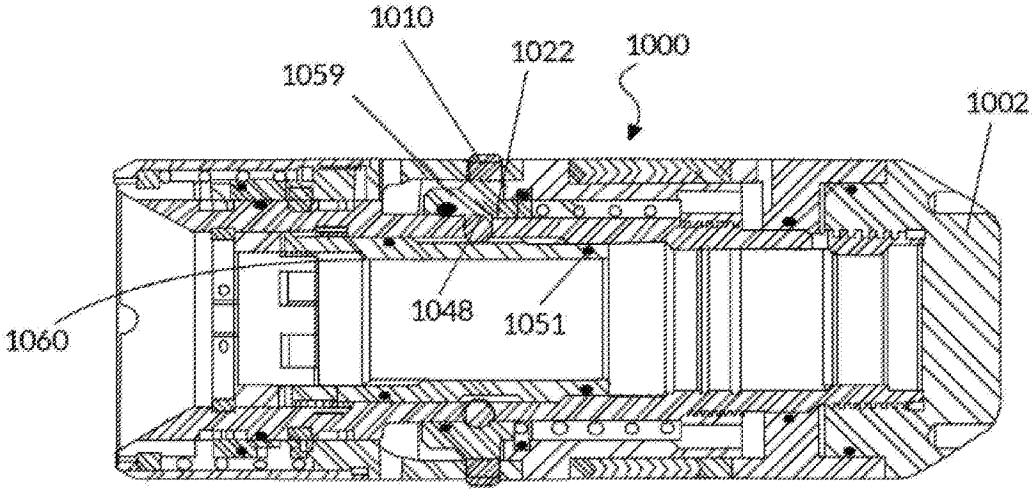
FIG. 10 is a diagrammatic representation of another embodiment of a wellbore dart.
Figure 11:
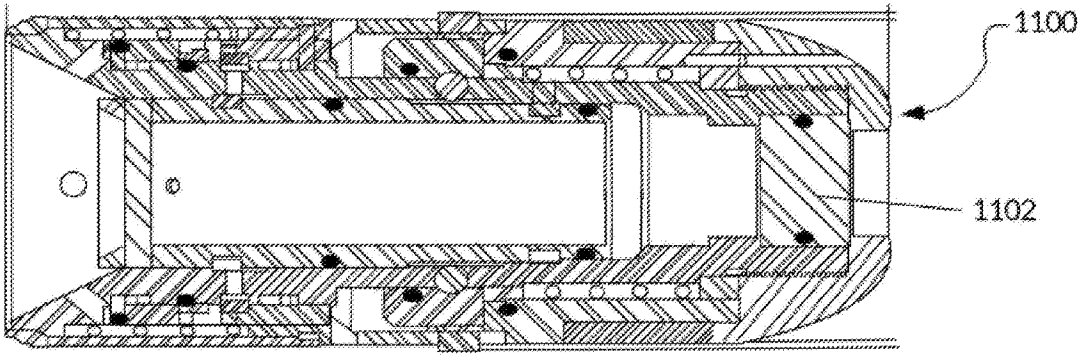
FIG. 11 is a diagrammatic representation of another embodiment of a wellbore dart.

Moreover, FIGS. 2 and 4-8 illustrate embodiments of indexing darts having a center flow bore through the darts. However, other embodiments of indexing darts may not include a central flow bore. For example, an indexing dart may have a solid body, such as indexing dart 950 of FIG. 9 having a solid mandrel. In other embodiments, the central bore may be plugged. FIGS. 10 and 11 illustrate that embodiments of indexing darts discussed above may be easily reconfigured to be plugged. For example, in FIG. 10, nose cone 1002 acts as the plug. In FIG. 11, a plug 1102 replaces a recovery tool (e.g., the recovery tool of indexing dart 600).

It can be noted that indexing darts 1000, 1100 do not include a valve. Such darts without a valve may be better adapted to flow back to surface than darts with valves that can open under back pressure. In some embodiments, an indexing dart, such as indexing dart 1000, 1100, that doe s not include a central flow bore/valve may be run in before darts that include valves that can open under back pressure. The dart without a central flow bore/valve can be used to help back flow the darts with valves to surface. It can be noted, however, that darts with valves may also be flowed back to surface if the valve has a sufficient closing force to stay closed under the back pressure required to flow the dart back to surface.

In any event, darts 1000 and 1100 can be further simplified by removing a valve actuator. With reference to FIG. 10, internal sleeve 1060 can be omitted. In this case, the opening 1048 holding locking member 1059 can be configured so that locking member 1059 cannot pass through it. The locking member 1059 can be formed of a material that dissolves to release protrusion support 1022.

Figure 16:
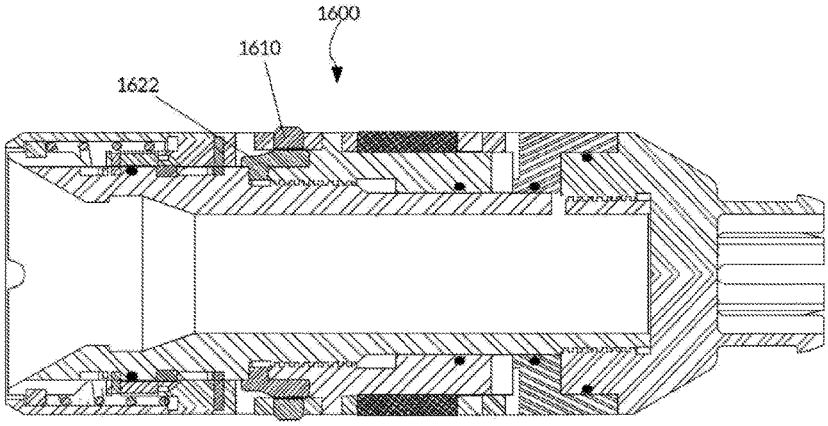
FIG. 16 is a diagrammatic representation of another embodiment of a wellbore dart.

Indexing dart 1000 can be further simplified by using a non-movable protrusion support 1022 and omitting biasing member 1051 and locking member 1059. Protrusion support 1022 or dogs 1010 (or other annular protrusion) can be formed of a dissolvable material. Similar simplifications can be made to indexing dart 1100. FIG. 16, for example, illustrates one embodiment of a simplified indexing dart 1600 with a dissolvable annular protrusion 1610 (e.g., dogs) and protrusion support 1622.

Figure 17:
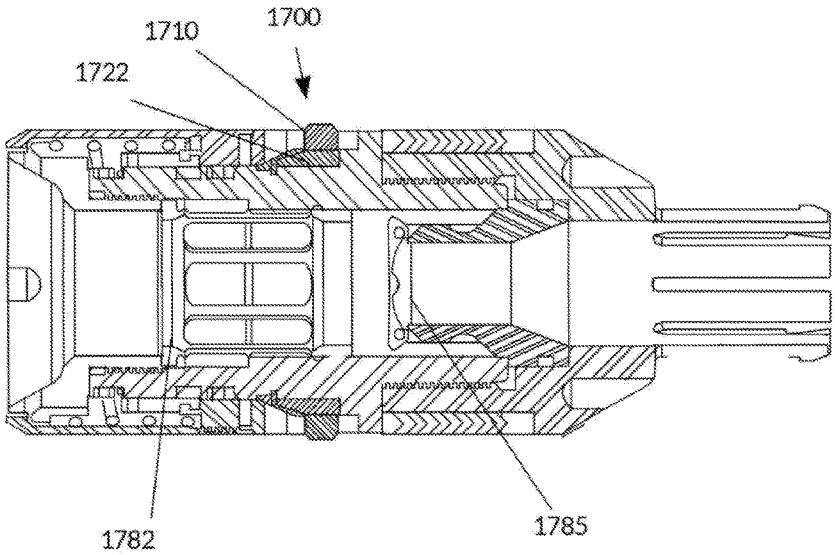
FIG. 17 is a diagrammatic representation of another embodiment of a wellbore dart.

FIG. 17 illustrates another embodiment of a simplified indexing dart 1700 with dissolvable annular protrusion 1710 and/or protrusion support 1722. FIG. 17 includes a valve actuation member 1782 that can be actuated by a tool (e.g., tool run in from surface or another dart) to open valve 1785 and lock valve 1785 in a valve open position.

Embodiments of indexing darts described herein can be configured for a variety of purposes including, but not limited to, delivery of tools, plugging a tubing string, actuating a tool or for other purposes. Indexing darts can have a robust mechanical indexing and engagement design that is stable across temperatures and is suitable for high pressures, including pressures above 15,000 psi and in some embodiments above 20,000 psi.

As discussed above, some embodiments may use a mechanical indexing mechanism to selectively engage an indexing dart with a target dart seat. The mechanical indexing mechanism provides a number of advantages over prior indexing systems. As one advantage, the indexing mechanism can be entirely contained on the indexing dart itself. Accordingly, indexing mechanisms are not required on tools in the tubing string, such as frac ports. This allows robust frac ports with thick walls and fewer parts to be used within the tubing string itself. Furthermore, the mechanical indexing system is not dependent on electronic sensors that can become unstable with high temperature and pressure. Nor is the mechanical indexing system dependent on batteries that run out over time. Thus, darts described herein can have a mechanical design that is stable across temperatures. Some embodiments, however, may include sensors as needed or desired.

Furthermore, embodiments of an indexing mechanism discussed above can be disposed entirely to the radial outer side of the mandrel so that the inner bore of the mandrel can be used for other purposes, such as providing a central flow path, carrying objects or any other purposes.

The indexing mechanism, in some cases, may be configured for a high stage count, for example, 60-90 stages, or more. In addition, a single indexing dart size can be used for all the stages within the tubing string. If desired, the dart sized can be selected to be as close to full bore as possible. Accordingly, pump volumes and predicting landing times may be made more accurate. This can help to eliminate launch error.

The mechanical indexing system described herein can be provided with features, such as visible index markings, so that the indexing dart's setting can be easily checked before deployment. Moreover, the mechanical indexing system may be field adjustable, allowing customization of treatment and other operations.

Furthermore, indexing darts can be configured so that they can be retrieved or shifted using a variety of tools, including coil or threaded pipe tools. According to one embodiment a recovery tool may be used to push/pull a dart through the tubing string. Each indexing dart can also include a latch tool portion so that it can latch onto other indexing darts. In some cases, the recovery tool and each successive indexing dart can allow the operator to circulate around and through the indexing darts to wash away sand dunes that may impede progress. Thus, circulation can be maintained and a liner or other tubing string cleared as indexing darts are moved to the toe of a well or to another location.

FIGS. 2-11 provide example embodiments of darts that can be used as an indexing dart 150 of FIG. 1. However, one of ordinary skill in the art would understand that various other configurations of darts may be used.

A tubing string (e.g., tubing string 110) may include a variety of components at which a dart may land including, but not limited to kobe subs, packers, liner hangers, wellbore isolation tools, circulation subs, pump out plug assemblies, cut-off subs, locate subs or other well components. FIGS. 12-13 illustrate specific examples of components that can accommodate an indexing dart. However, the skilled artisan will appreciate that any number of different components can be configured to seat an indexing dart.

Figure 12A:
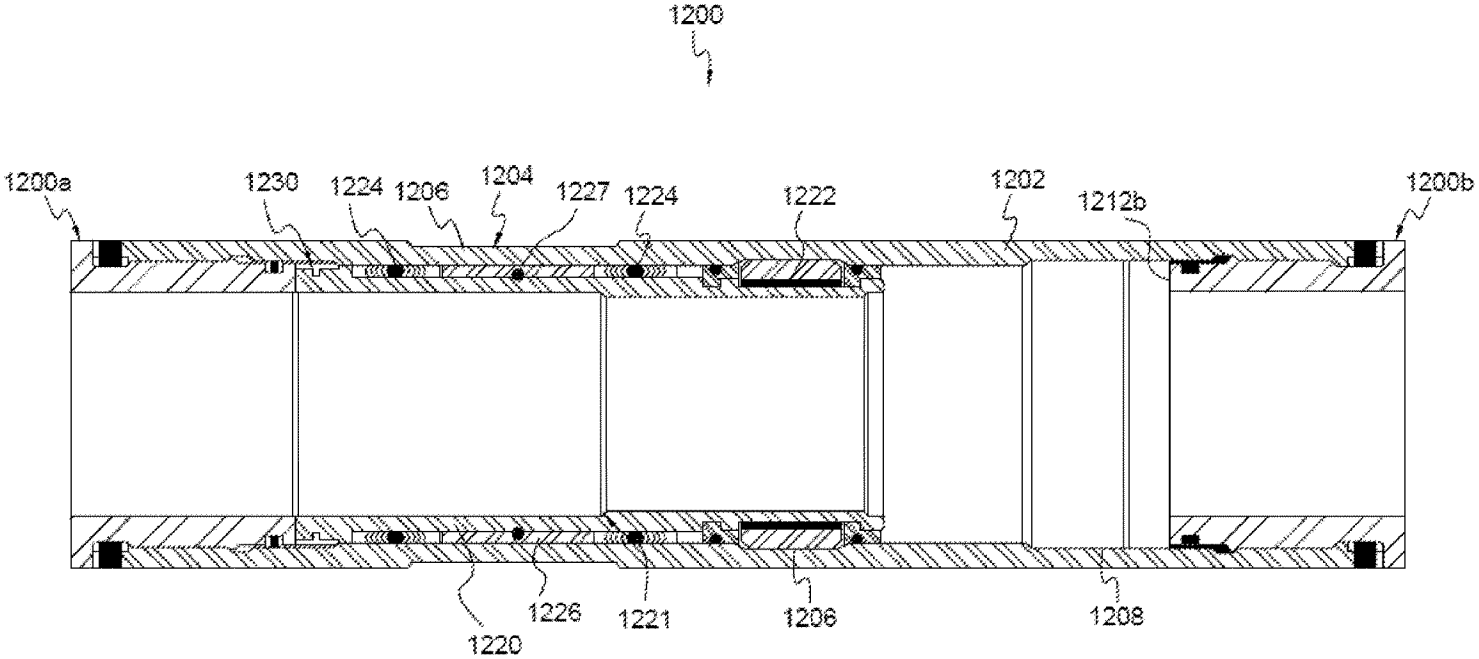
FIGS. 12A-12C are diagrammatic representations of one embodiment of a sleeve assembly.
Figure 12B:
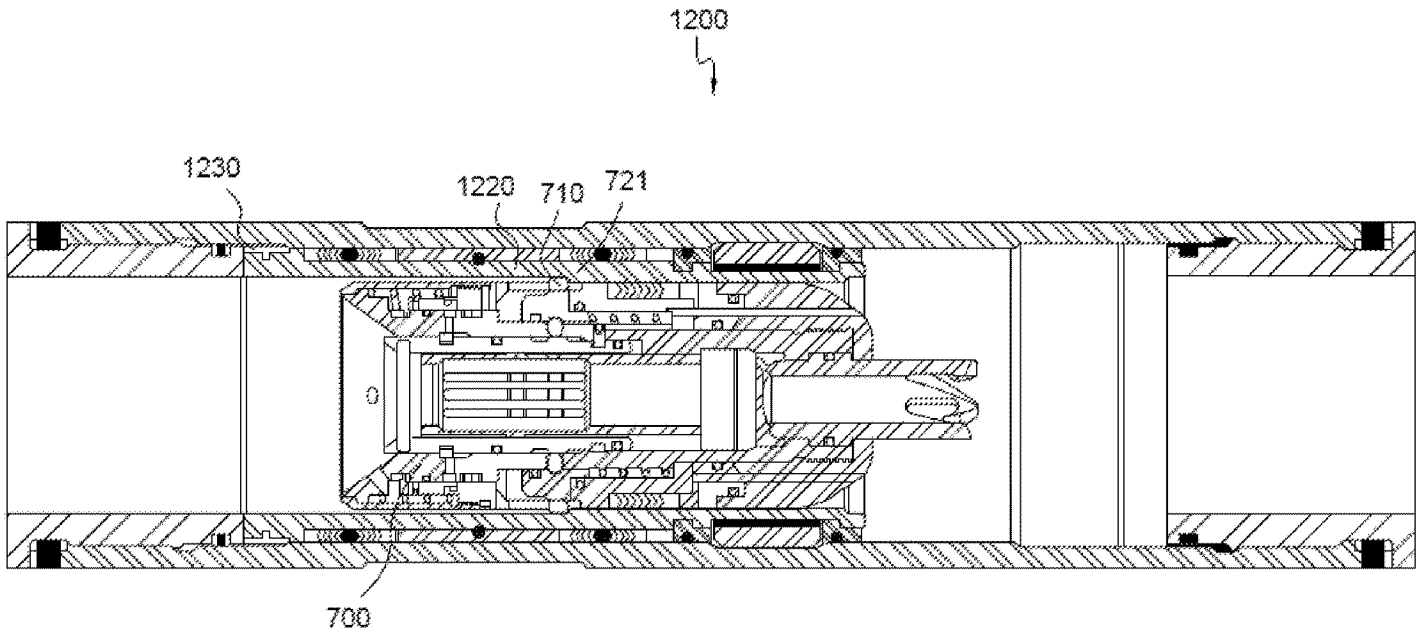
Figure 12C:
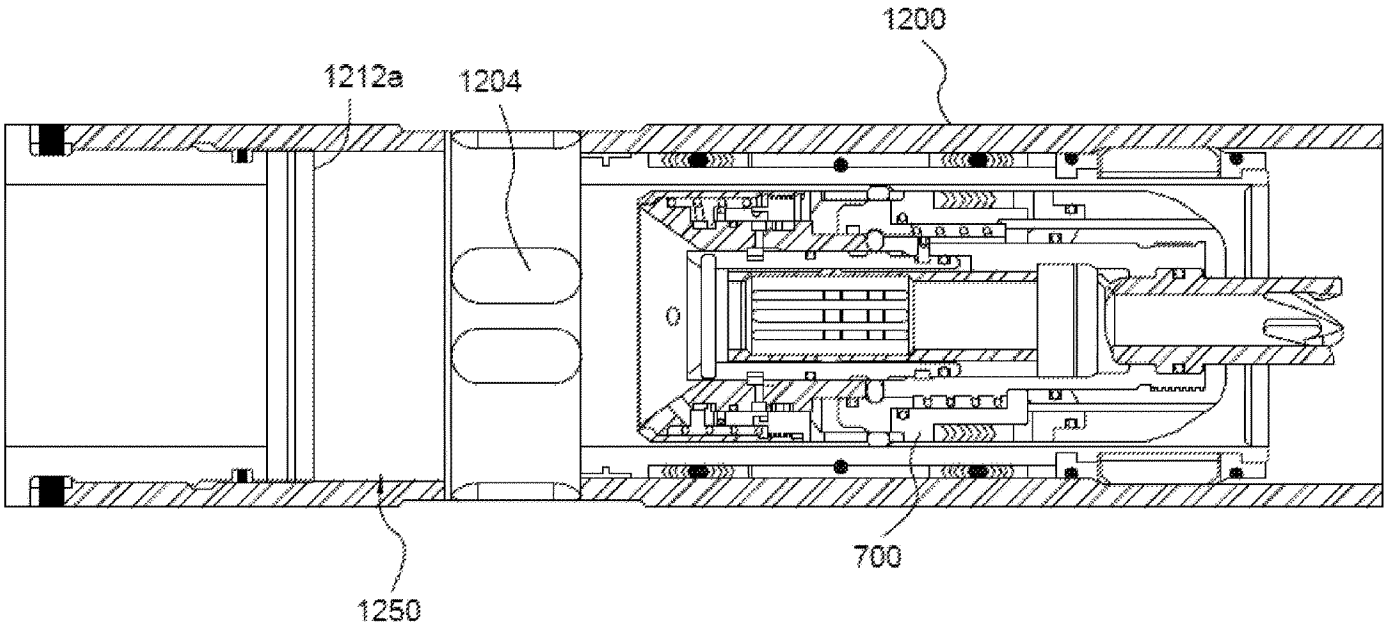

FIGS. 12A-C are diagrammatic representations of one embodiment of a sleeve assembly 1200 (e.g., an example of a sleeve assembly 158 of FIG. 1) and actuation thereof by an indexing dart. Sleeve assembly 1200 (or "sub 1200") may be threaded into or otherwise joined with other subs in a tubular string, such as tubing string 110 of FIG. 1.

Sub 1200 comprises a tubular component that defines an inner bore from an upper end 1200*a* to a lower end 1200*b*. Sub 1200 includes a frac port sub wall 1202 having one or more frac ports 1204 that pass through the frac port sub wall 1202. Sub 1200 may define a sleeve retaining area 1210 retaining a dart actuated port sleeve 1220. Sleeve retaining area upper shoulder 1212*a* and sleeve retaining area lower shoulder 1212*b* at the ends of dart actuation sleeve retaining area 1210 may limit the range of movement of port sleeve 1220. Sleeve retaining area upper shoulder 1212*a* and sleeve retaining area lower shoulder 1212*b* may be formed in any way as by casting, milling, etc. the wall material of the sub 1200 or by threading parts together, etc. Sub 1200 is preferably formed to hold pressure.

One or more seals 1224, such as O-rings or other seals, are disposed between port sleeve 1220 and frac port sub wall 1202 to substantially prevent fluid bypass between port sleeve 1220 and wall 1202. A metal spacer ring 1226 separates the upper and lower seals. A ring 1227 is confined in a groove to prevent them from sliding on sleeve 1220 and to define a seal gland. (e.g., for seals 1224) A dart actuated sleeve setting member, such as c-ring 1222, is coupled to and moves with port sleeve 1220. C-ring 1222 is a biasing member (exerts radial force outward) that holds the port sleeve in either the open or closed position with a determined amount of holding force.

In a closed port position, port sleeve 1220 is positioned adjacent to shoulder 1212*a*; also, c-ring 1222 is positioned in an upper annular groove 1206 defined on the inner surface of port sub wall 1202. Shear pins or a shear ring 1230 are held between frac port sub wall 1202 and port sleeve 1220 and provide a holding force that must be overcome to move port sleeve 1220 from a port closed position to a port open position.

In operation, a dart may be conveyed along a tubing string to sub 1200. If the dart is in a run-in configuration, the annular protrusion of the dart will contact shoulder 1221 of port sleeve 1220 and collapse, allowing the indexing dart to pass through port sleeve 1220. If the indexing dart is in a landing configuration, however, the annular protrusion of the dart will engage dart actuated sleeve shoulder 1221. A indexing dart may create a seal with the inner bore of port sleeve 1220 such that pressure can be increased above the dart to overcome the holding force (e.g., of shear ring 1230). Port sleeve 1220 can then move to the port open position in which it is positioned against sleeve retaining area lower shoulder 1212*b* with c-ring 1222 in lower sleeve retaining groove 1208. Thus, port sleeve 1220 acts as a dart seat on which indexing dart can be configured to land.

FIGS. 12B-12C (collectively FIG. 12) illustrate, an indexing dart 700 (FIG. 6) configured to target sub 1200 actuating port sleeve 1220 to open frac ports 1204. As illustrated in FIG. 12B, the annular protrusion 710 (e.g., formed by dogs or other structures) engages dart actuated sleeve shoulder 1221 and annular seal 702 forms a seal with the inner bore of port sleeve 1220. Pressure can be increased from surface to generate a pressure differential across port sleeve 1220, overcoming the holding force of shear ring 1230 and causing port sleeve 1220 to move to a port open position as illustrated in FIG. 12C. Fluid can now enter the annulus (e.g., annulus 164 of FIG. 1) through the open frac ports 1204 to stimulate a formation. After stimulation is complete, annular protrusion 710 can be released and indexing dart 700 pushed or pulled by a recovery tool as discussed above. As would be understood by a person of ordinary skill in the art, port sleeve 1220 can be closed using a shifting tool adapted to locate the shift gap 1240 (shown in FIG. 12C) between shoulder 1212*a* and port sleeve 1220, a shifting tool adapted to locate on the lower end of port sleeve 1220 or other shifting tool.

As can be appreciated from the discussion above, the same indexing dart may be targeted at any of the dart seats in a tubing string (e.g., any of sleeve assemblies 158 or other tool containing a dart seat) without the need for a specially sized dart for each seat. The dart seats can therefore have similar diameters. Thus, sleeve assemblies (or other tools) that are structurally similar (e.g., the same or similar inner diameter dart seats) can be used along a string as desired by the operator. For example, according to one embodiment, an identical sub 1200 can be run on every joint of casing in a liner system.

While FIG. 12A includes some example dimensions, these are provided by way of example to illustrate that indexing darts can facilitate the use of tubing string tools that retain near to the full tubing string bore. For example, some embodiments may include dart seats that retain near to the full tubing string bore (e.g., greater than 75%, including greater than 85% or 90% of the full liner bore). However, embodiments of tools can have any suitable configuration.

Sub 1200 provides a number of advantages. Sub 1200 has a simple design for low manufacturing costs. Moreover, the design can be used in a variety of wellbore configurations including, for example, open hole, cemented, vertical, horizontal, multilateral, SAGD, HPHT, monobore.

In addition, as discussed above, sub 1200 can retain the full bore with only minimal restriction, providing better conductivity and ability to pump at higher rates. Embodiments therefore more easily achieve maximum frac rates along the entire well and increase the frac length. Furthermore, the same design can be used to frac using coiled tubing, darts and other tools. Thus, the same design can be deployed in multiple well configurations. An additional benefit is that the port sleeve is integral with the seat. Since the seat does not need to be milled out, it can be made of higher strength material for a thinner wall and higher pressure rating.

FIGS. 13A-13D (collectively FIG. 13) are diagrammatic representations of one embodiment of a sleeve assembly 1300 that allows the stimulation ports to be screened so that the stimulation ports may also be used as screened production ports.

Sleeve assembly 1300 is configurable in a number of configurations including, but not limited to, a run-in configuration, a port-open or stimulation configuration, a port-screened or production configuration, and a port-reclosed configuration. The run-in configuration and port-reclosed configuration are both port-closed configurations in which the ports are closed so that fluid does not flow through the ports to/from an inner bore of the sleeve assembly 1300. In a port-open configuration or stimulation configuration, the ports are open and unobstructed by screens. This configuration can be used, for example, to inject stimulation fluid into a formation. In the port-screened configuration, screens are closed over the ports so that fluid flowing through the ports passes through the screens.

Figure 13A:
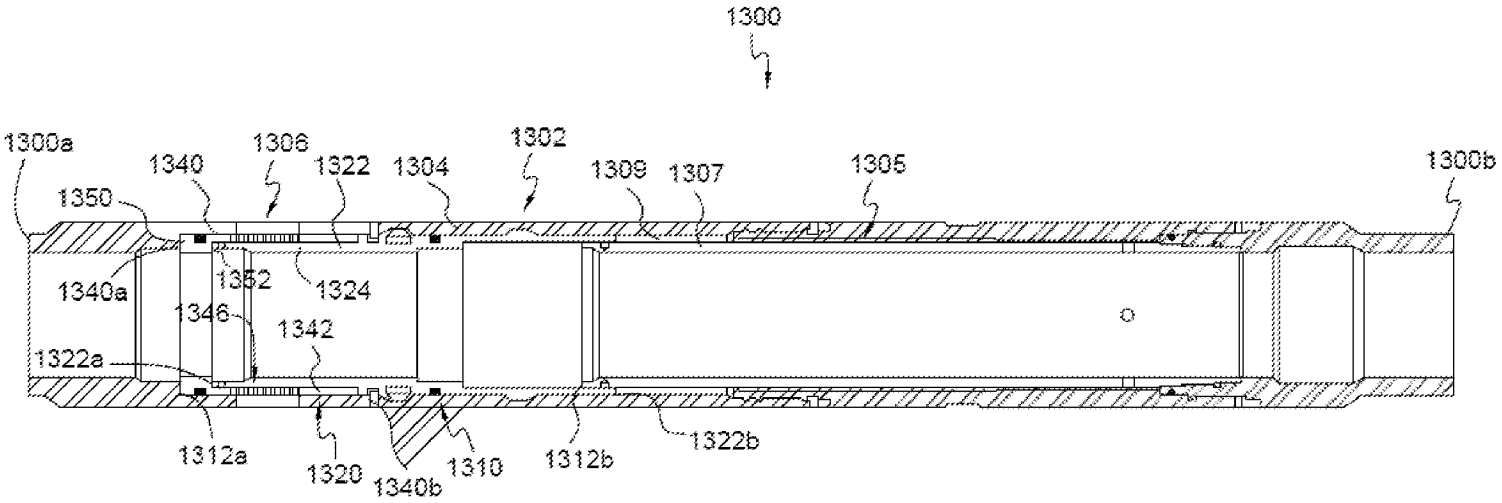
FIGS. 13A-13D are diagrammatic representations of another embodiment of a sleeve assembly.
Figure 13B:
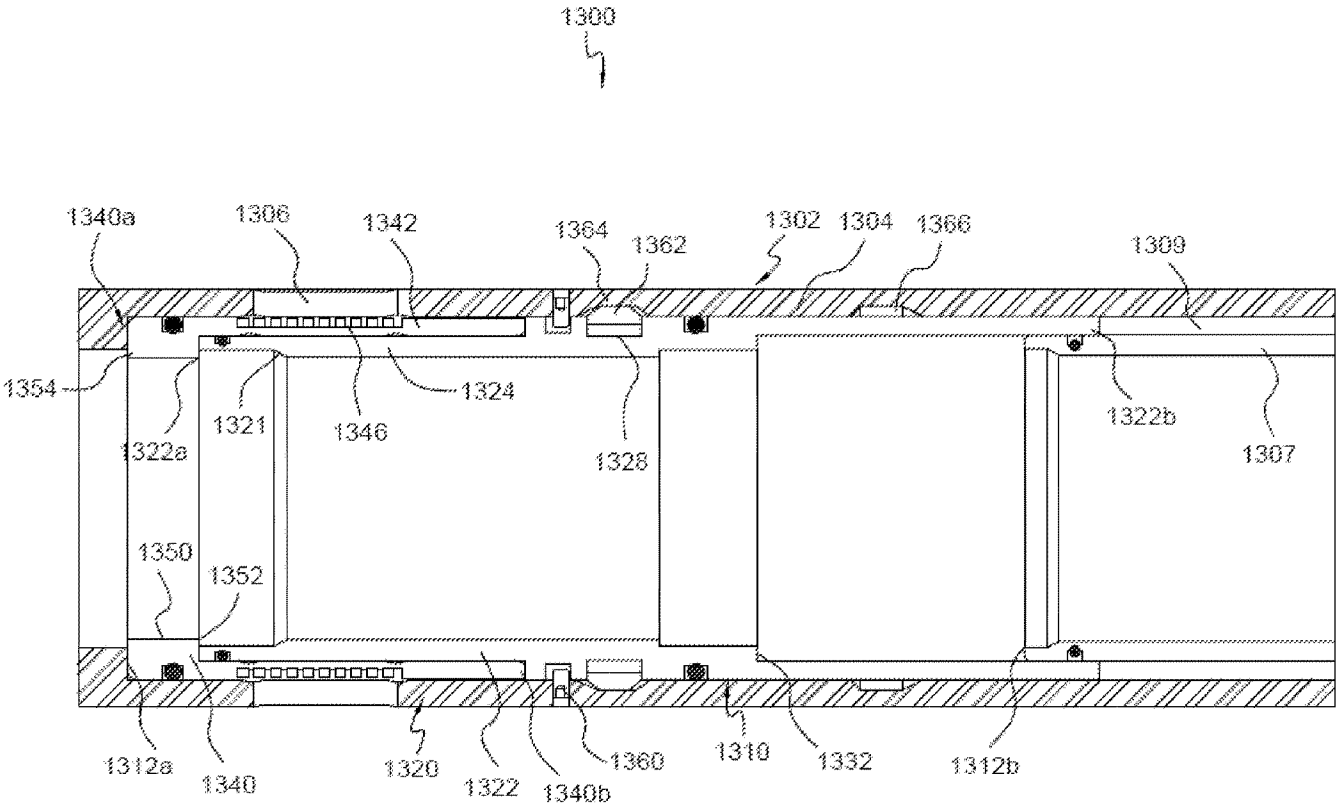

FIG. 13A is a diagrammatic representation of sleeve assembly 1300 in a run-in configuration. FIG. 13B illustrates portions of FIG. 13A in more detail. Sleeve assembly 1300 may be a sub comprising a tubular body (e.g., defined by one or more tubular members) defining an inner bore that extends from an upper end 1300*a* to a lower end 1300*b*. Sleeve assembly 1300 may be threaded into or otherwise joined with other subs in a tubing string.

In the embodiment illustrated, sleeve assembly 1300 includes an outer tubular member 1302 defining an outer wall 1304 of a sleeve retaining area 1310. One or more ports 1306 (referred to as "outer ports 1306) extend from the inner bore of sub 1300 through outer wall 1304. A port sleeve assembly 1320 is movable in the sleeve retaining area 1310 and is configurable such that sliding sleeve assembly 1300 can be configured in a port-closed configuration, a port-open configuration and a screened-port configuration. An upper sleeve retaining area shoulder 1312*a* and lower sleeve retaining area shoulder 1312*b* may limit the range of movement of port sleeve assembly 1320 in sleeve retaining area 1310.

According to one embodiment, port sleeve assembly 1320 includes a concentrically arranged port cover sleeve 1322 and screen sleeve 1340 with a portion of screen sleeve 1340 disposed in an annular space between port cover sleeve 1322 and the outer wall 1304 of sleeve retaining area 1310. Port sleeve assembly 1320 may be actuated to a port-open position using an indexing dart, a stimulation tool, plug or other tool. When stimulation through ports 1306 is complete (or at another time desired by the operator), screen sleeve 1340 can be closed to screen the outer ports 1306—that is, port sleeve assembly 1320 can be configured in a port-screened configuration—so that proppant or other debris do not flow back into sleeve assembly 1300. In one embodiment, a shifting tool may be used to move the screen sleeve 1340 from an open position to a port-screened position. C-rings, collets or other releasable setting mechanisms may be used to hold the screen sleeve 1340 in place in particular position, but allow for multi-position use. Port cover sleeve 1322 may be returned to a port-closed position to reclose ports 1306.

Screen sleeve 1340 extends from a screen sleeve upper end 1340*a* to a screen sleeve lower end 1340*b* and includes a screened port portion (screen holder 1342) adjacent to the inner surface of sleeve retaining area 1310. Screen holder 1342 comprises as set of screened ports 1346 positioned so that screened ports 1346 can create a flow with outer ports 1306 when screen sleeve 1340 is in a screen-closed position. In some embodiments, screened ports 1346 may be positioned to overlap and/or align with outer ports 1306.

Screened ports 1346 are screened with a mesh or other screen selected to prevent proppant from flowing back into sleeve assembly 1300. By way of example, but not limitation, the screens may comprise between 8 and 140 mesh (106 μm-2.36 mm), for example 16-30 mesh (600 μm-1180 μm), 20-40 mesh (420 μm-840 μm), 30-50 mesh (300 μm-600 μm), 40-70 mesh (212 μm-420 μm), 70-140 mesh (106 μm-212 μm) or other mesh. The mesh may be wrapped around or otherwise coupled to screen holder 1342 to screen ports 1346. The screened ports 1346 or positioned to allow flow with outer ports 1306 when screen sleeve 1340 is in a screen-closed position. For example, the screened ports 1346 can be positioned to align with or overlap outer ports 1306 when screen sleeve 1340 is in a screen-closed position.

One or more seals, such as O-rings, bonded seals or other seals, are disposed between screen sleeve 1340 and the outer wall 1304 of the sleeve retaining area 1310 and between screen sleeve 1340 and port cover sleeve 1322. The seals can help prevent fluid from bypassing between screen sleeve 1340 and outer wall 1304 or between screen sleeve 1340 and port cover sleeve 1322 when sleeve assembly 1300 is in a port-closed configuration.

Port cover sleeve 1322 extends from port cover sleeve upper end 1322*a* to port cover sleeve lower end 1322*b*. In the embodiment illustrated, the upper end 1322*a* of port cover sleeve 1322 has an inner diameter that is greater than that of upper end portion 1350 of screen sleeve 1340 to create a shoulder 1352 that may be used by a shifting tool to close screen sleeve 1340. A lower end of port cover sleeve 1322 may be disposed in an annular space 1309 between outer wall 1304 and an inner wall 1307 (e.g., defined by a tubular member 1305 that extends partially into sleeve retaining area 1310). Annular space 1309 may be in fluid communication with an area of the wellbore below an area where an isolation tool or plug is expected to seal at assembly 1300.

Port cover sleeve 1322 comprises a port cover 1324 that extends into the inner bore of screen sleeve 1340. According to one embodiment, the port cover 1324 is configured such that, when port cover sleeve 1322 is in a port closed position, port cover 1324 covers screened ports 1346. One or more seals, such as O-rings or other seals, are disposed between screen sleeve 1340 and port cover sleeve 1322 to prevent fluid from flowing out between the sleeves and through the ports when port sleeve assembly 1320 is in a port-closed configuration.

With reference to FIG. 13B, when port sleeve assembly 1320 is in the closed port configuration, the upper end 1340*a* of screen sleeve 1340 abuts shoulder 1312*a*. In this configuration, screened ports 1346 and port cover 1324 create a flow passage with outer ports 1306, but port cover 1324 closes to the radially inner side of screened ports 1346. Port cover 1324 and the various seals act in cooperation to prevent fluid flow through outer ports 1306.

A releasable setting device, such as a shear pin or other shear mechanism, a collet or a spring that holds port sleeve assembly 1320 in place can provide a holding force that must be overcome to prevent inadvertent opening of outer ports 1306. In the embodiment illustrated, shear pins 1360, a shear ring or the like are held between the inner surface of sleeve retaining area 1310 and port cover sleeve 1322 to provide the holding force. When the holding force is overcome, port sleeve assembly 1320 may move to a port-open position.

A releasable setting device may also be provided to prevent inadvertent closing of outer ports 1306. In the embodiment illustrated, a c-ring 1362 is partially disposed in groove 1328 in the outer surface of port cover sleeve 1322 and travels with port cover sleeve 1322. The C-ring is adapted to expand radially outward into upper recess 1364 and lower recess 1366 defined in the inner surface of outer wall 1304. When port cover sleeve 1322 is in a port-closed position, c-ring 1362 expands partially into upper recess 1364 and when port cover sleeve 1322 is in a port-open position, c-ring 1362 expands partially into a lower recess 1366 to prevent port cover sleeve 1322 from inadvertently closing. Other setting mechanisms may also be used.

Figure 13C:
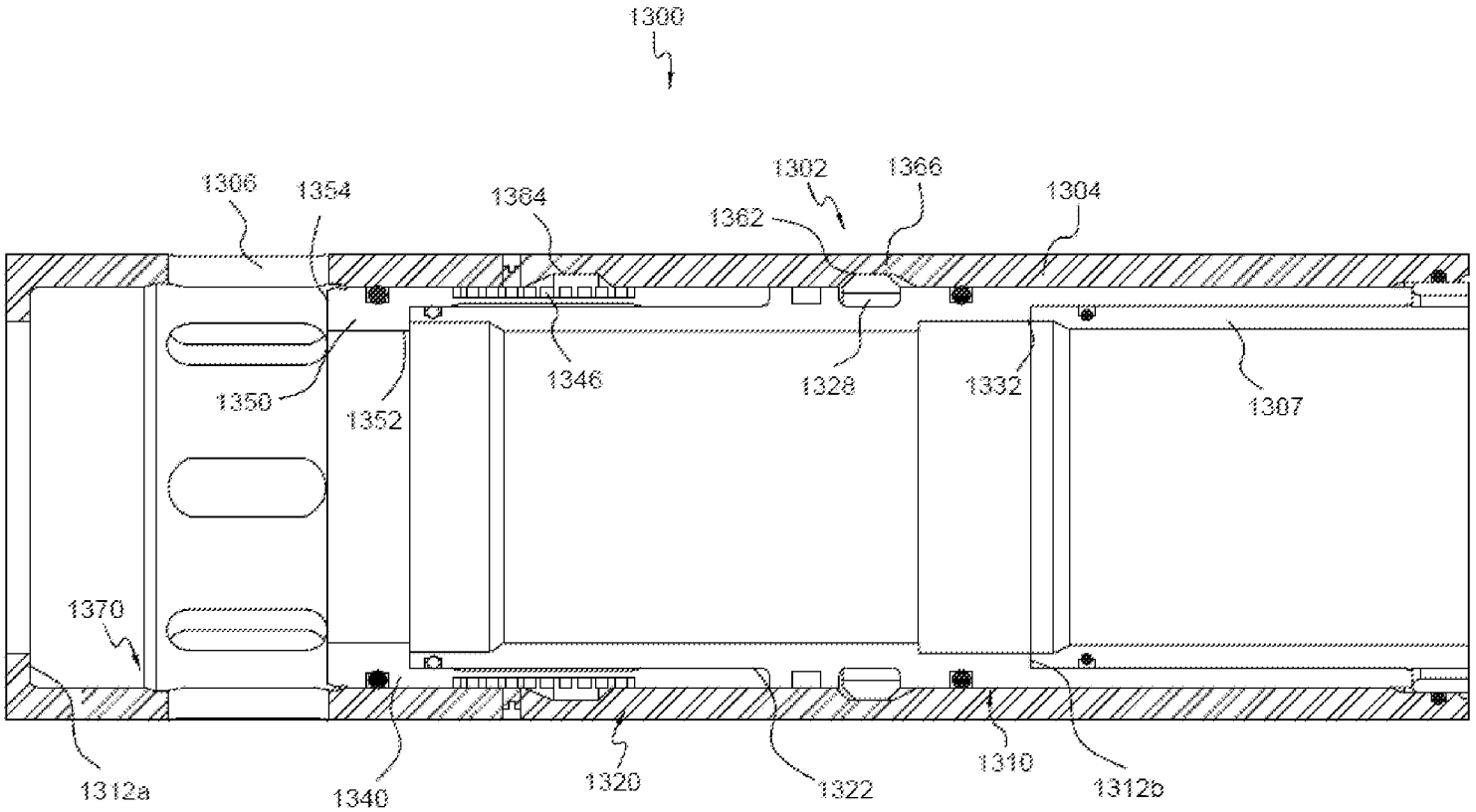

As illustrated in FIG. 13C, when the holding force is overcome (e.g., when the force created by differential pressure, a shifting tool, etc. is sufficient to shear off shear pins 1360), port sleeve assembly 1320 moves to the port-open position. In one embodiment, screen sleeve 1340 moves from a screen sleeve first position to a screen sleeve second position and port cover sleeve 1322 moves from a port cover sleeve first position to a port cover sleeve second position. Screen sleeve 1340 and port cover sleeve 1322 may move together. This may occur due to hydraulic pressure on each, friction between the sleeves, a holding member holding the sleeves together (e.g., a shear ring, snap fit or other holding mechanism). Shoulder 1312*b* or other structure can limit forward movement of port sleeve assembly 1320 in sleeve retaining area 1310. For example, shoulder 1332 may come in contact with shoulder 1312*b* to limit movement.

Port sleeve assembly 1320 can be moved to a port-open position in various ways such as, for example, by hydraulic pressure (by landing a plug on port cover sleeve 1322 (e.g., on shoulder 1321 or elsewhere), by pressuring up against an atmospheric chamber or against annular pressure, etc.). According to one embodiment, an isolation tool (e.g., a coiled tubing tool, threaded tubing tool or other tool) can be used to create a seal with the inner bore of tubular member 1305. Pressure can be increased above the seal to generate a pressure differential across port sleeve assembly 1320 (e.g., due to annular space 1309 being connected to a lower pressure area below the seal) to shift port sleeve assembly 1320 to a port fully open position. In another embodiment, a shifting tool may push or pull sleeve assembly 1320 to the port-open position.

In accordance with one embodiment, sleeve assembly 1320 may include a dart seat, a ball seat or other seat at which the plug can land. A dart or other plug configured to land on and seal at port sleeve assembly 1320 may be conveyed to sliding sleeve assembly 1300. Pressure can be increased behind a seated and sealed plug to generate a pressure differential across the plug, causing the plug to actuate port sleeve assembly 1320. For example, an indexing dart may be conveyed along a tubing string to assembly 1300. If the dart is in a run-in configuration, the annular protrusion of the dart will contact shoulder 1321 and collapse, allowing the dart to pass through port sleeve assembly 1320. If the dart is in a landing configuration, however, the annular protrusion of the dart may engage shoulder 1321. The dart may create a seal with the inner bore of port cover sleeve 1322 such that pressure can be increased above the dart to overcome the holding force (e.g., of shear pin 1360). The port sleeve assembly 1320 can then move to a port open position in which it is positioned against shoulder 1312*b* with c-ring 1362 in lower recess 1366 and neither the screened ports 1346 nor port cover 1324 covering the ports 1306.

Figure 13D:
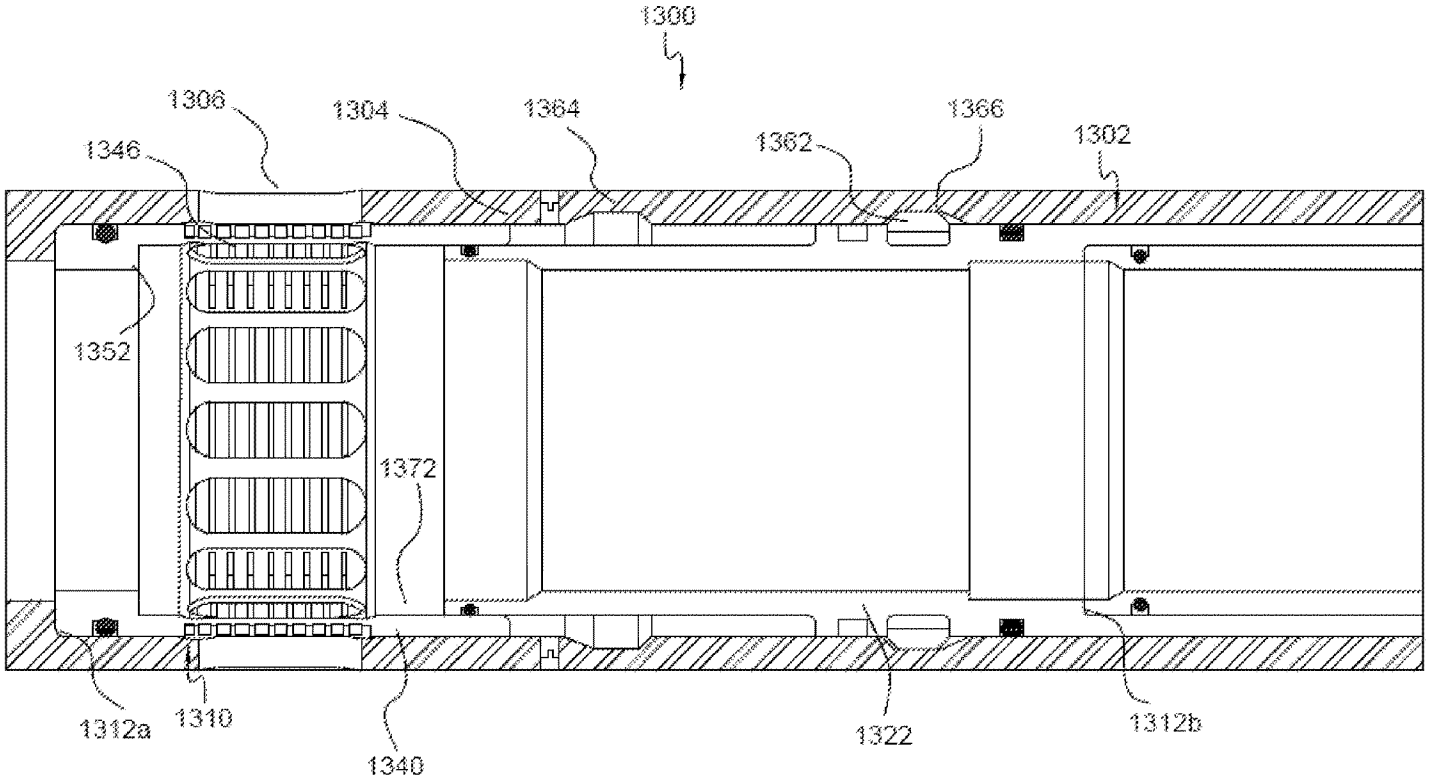

Outer ports 1306 can be screened by moving screen sleeve 1340 back to a closed position while port cover sleeve 1322 remains in an open position as illustrated in FIG. 13D. In this port-screened or production configuration, fluid flowing back into the tubing string will pass through screened ports 1346 to remove proppant or other debris.

According to one embodiment, a biasing member may bias screen sleeve 1340 upward to close over ports 1306. The biasing member can be selected to have a biasing force that will be overcome by stimulation pressures, but can close screen sleeve 1340 when the stimulation pressures are released. In other embodiments, screen sleeve 1340 may be closed by a shifting tool. A variety of shifting tools are known in the art and can be adapted to locate shift gap 1370 (shown in FIG. 13C) between shoulder 1312*a* and face 1354 (or other feature of sleeve assembly 1300), engage screen sleeve 1340 and move screen sleeve 1340 back to a closed position. The shifting tool may be a stimulation/isolation tool used to open sliding sleeve assembly 1300 or may be another tool entirely.

The ports of sleeve assembly 1300 can be fully reclosed by moving port cover sleeve 1322 back to the port-closed position through application of sufficient force to overcome c-ring 1362. As would be understood by one of ordinary skill in the art, port cover sleeve 1322 can be closed by any suitable tool. For example, in one embodiment, a shifting tool adapted to locate the shift gap 1372 (shown in FIG. 13D) between shoulder 1352 and the upper end 1322*a* of port cover sleeve 1322 or other feature can be used to shift port cover sleeve 1322 to a closed position, thereby changing sleeve assembly 1300 back to a port-closed configuration.

The ports of sleeve assembly 1300 can be fully reclosed by moving port cover sleeve 1322 back to the port-closed position through application of sufficient force to overcome c-ring 1362. As would be understood by one of ordinary skill in the art, port cover sleeve 1322 can be closed by any suitable tool. For example, in one embodiment, a shifting tool adapted to locate the shift gap 1372 (shown in FIG. 13D) between shoulder 1352 and the upper end 1322*a* of port cover sleeve 1322 or other feature can be used to shift port cover sleeve 1322 to a closed position, thereby changing sleeve assembly 1300 back to a port-closed configuration.

In operation, sleeve assembly 1300 can be run into a wellbore with the outer ports 1306 fully closed (e.g., a run-in configuration as illustrated in FIGS. 13A and 13B). When stimulation is desired, sliding sleeve assembly 1300 can be changed to a port-open configuration (e.g., illustrated in FIG. 13C). After stimulation is complete, screen sleeve 1340 can be moved back to a closed position to screen outer ports 1306 for production. If desired, outer ports 1306 can be closed by moving port cover sleeve 1322 back to a closed position.

Sleeve assembly 1300 allows the same ports to be used both as frac ports and production ports while providing screening for production ports. Moreover, sleeve assembly 1300 can be fully closed by moving port sleeve 1322 back to the closed port position.

FIGS. 12-13 are provided for context. One of ordinary skill in the art will recognize, however, that practically any sub that could accommodate a ball or other plug can be configured with a dart seat to accommodate an indexing dart, such as the indexing darts discussed above. Thus, a variety of subs may be used with indexing darts.

According to one embodiment, for example, a locate sub can be formed similar to sub 1200 but without ports through the outer wall. In such an embodiment, a stationary dart seat can be provided. Such a locate sub could be used to provide locations for darts to land along a string. Other subs that can be used with darts include, but are not limited to kobe subs, packers, liner hangers, wellbore isolation tools, circulation subs, pump out plug assemblies, cut-off subs, locate subs or other well components.

While the above embodiments primarily discussed in terms of using indexing darts to actuate sleeve valves, darts may be used for a variety of purposes. For example, a dart may be targeted at a sub to plug the sub for pressure testing during drilling. According to another embodiment, a sleeve or locate sub may be located relatively close to the surface, say within 20 meters or so and a dart targeted to the locate sub to plug the sub for well control, e.g., to facilitate operations to repair leaking wellheads or blowout preventers (BOP), pressure testing BOPs or other for other purposes.

As another example, a sleeve or locate sub may be located in or below a liner hanger (e.g., liner hanger 154 of FIG. 1). A dart can be targeted at the sub to plug the sub, thereby isolating liner 135 from upper string 130 so that upper string 130 can be more easily removed and replaced (e.g., to replace a run-in string with a fracking string, allow installation of production equipment without killing the well). As yet another example, a sleeve or locate sub near the surface could be used to place a dart as a surface safety valve. As yet another example, a sleeve or locate sub proximate to the wellhead could be used to for wellhead isolation.

As noted in conjunction with FIG. 1, surface equipment 112 may include a dart launcher. Darts can be launched and captured using any suitable dart launcher or trap. The configuration of the dart launcher or trap may depend on the wellbore configuration and operations being performed. FIGS. 14-15 provide some embodiments of dart launcher assemblies. Other embodiments may also be used.

Figure 14A:
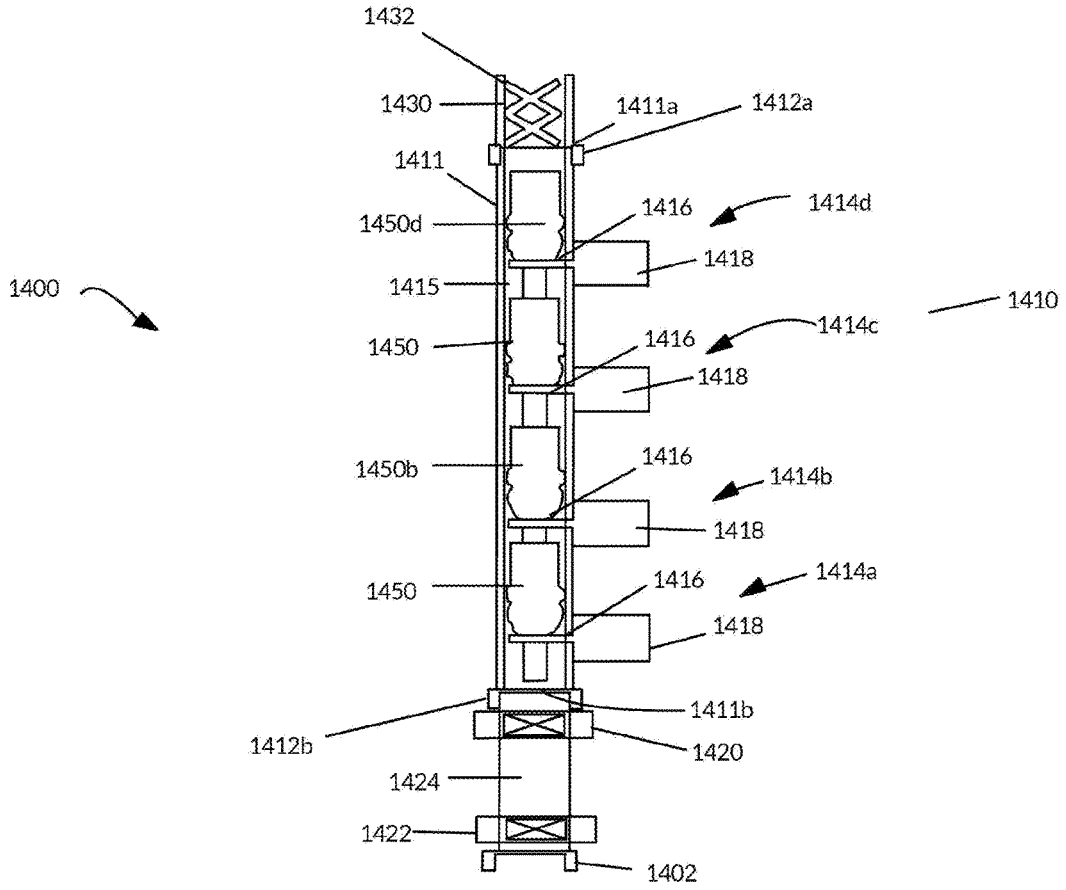
FIGS. 14A-14B are diagrammatic representations of one embodiment of a dart launch assembly.
Figure 15:
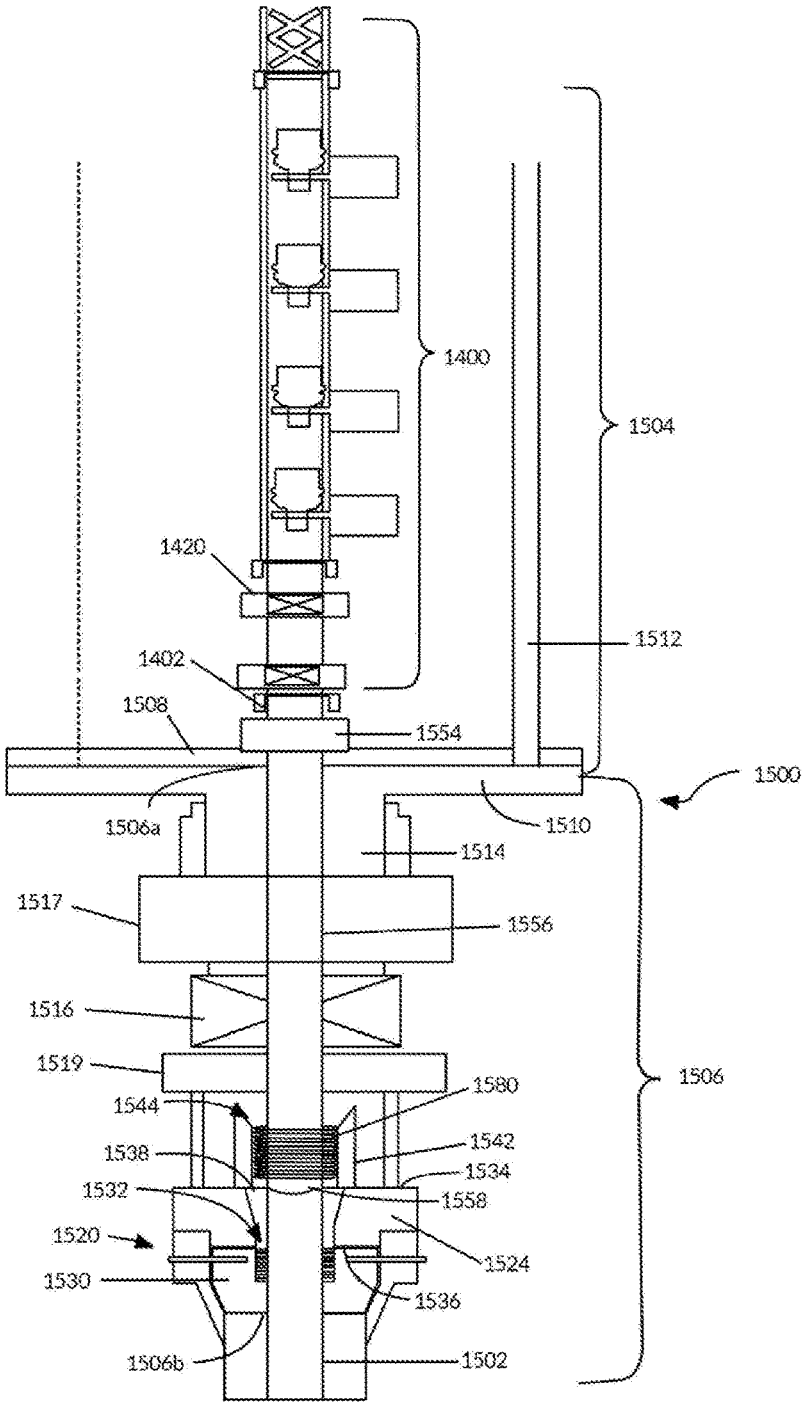
FIG. 15 is a diagrammatic representation of another embodiment of a dart launch assembly.

FIG. 14A is a diagrammatic representation of one embodiment of a dart launch assembly 1400. In the embodiment illustrated, dart launch assembly includes a coupler 1402 to couple dart launch assembly 1400 to another component, a dart magazine assembly 1410 to store and selectively release darts, and valves to selectively connect dart launch assembly 1400 (from a fluid flow perspective) to other components.

Dart launch assembly 1400 can be configured to mount on a wellhead component, such as a frac head or other component, so that one or more darts (e.g., indexing darts 1450*a* to 1450*d*) can be injected into the wellhead component. Therefore, the lower end of dart launch assembly 1400 may include threads or other features so that dart launch assembly 1400 may be secured to the component. As shown in FIG. 14, for example, a coupler 1402, such as a Bowen union or other coupler, can connect dart launch assembly 1400 to other components.

According to one embodiment, dart magazine assembly 1410 comprises a magazine housing 1411 that extends from an upper end 1411*a* to a lower end 1411*b*. The magazine housing upper end 1411*a* and magazine housing lower end 1411*b* may include threads or other features so that magazine housing 1411 may be secured to other components. For example, magazine housing 1411 may connect to other components by an upper magazine housing coupler 1412*a* and a lower magazine housing coupler 1412*b* (e.g., Bowen unions or other couplers). Magazine housing 1411 includes an inner bore that defines a dart holding area 1415 to hold one or more darts (e.g., indexing darts 1450*a* to 1450*d*) and connects the dart holding area 1415 to an opening in lower end 1411*b*.

Dart magazine assembly 1410 further comprises one or more actuator assemblies 1414 (e.g., actuator assemblies 1414*a* to 1414*d*) to selectively hold or release darts 1450. In one embodiment, the dart actuator assemblies 1414 include a dart holder 1416, such as a pin, fork, flap or other structure against which a portion of a dart 1450 can rest, and a dart holder actuator 1418, such as a hydraulic ram or other actuator, that can move the corresponding dart holder 1416 between a position in which the dart holder 1416 can hold a dart 1450 in place (a dart holding position) and a position in which a dart 1450 can pass the dart holder 1416 (a dart release position). By selectively controlling actuator assemblies 1414, an operator can selectively launch darts 1450*a* to 1450*d*.

A dart flow path is defined from the dart magazine assembly 1410 to an opening at the bottom end of dart launch assembly 1400 so that darts 1450 released from magazine housing 1411 may be directed to the component to which dart launch assembly 1400 is coupled. One or more valves are provided to selectively open the dart flow path or portion thereof to the other component. The dart flow path may also pass through any number of other components.

According to one embodiment, the valves include a magazine isolation valve 1420 to isolate the magazine 1410 from downstream components and a launcher isolation valve 1422 to isolate the launcher from downstream components. In the embodiment depicted, the launcher assembly also includes an upper intermediate valve 1425 and a lower intermediate valve 1426. According to one embodiment, a fluid injection area 1428 is defined between lower intermediate valve 1426 and launcher isolation valve 1422. A flow-T can connect fluid lines (e.g., lines 1429) to area 1428 so that fluid (e.g., stimulation fluid or other fluid) can be injected to help inject an indexing dart 1450 into a component below valve 1422. Although only two lines are depicted, other embodiments may have more lines (e.g., four lines or more) or a single line. Fluid may be injected at a desired angle (e.g., 45 degrees downward or other angle) to promote injection. A launch area 1424 can be defined between valve 1425 and valve 1426. A dart may be held here in a dart launch position until valve 1425 opens. A pressure line 1427 may be used to equalize pressure in dart launch area 1424 with fluid injection area 1428.

According to one embodiment, dart holding area 1415 and the dart path from the dart holding area to the bottom opening of dart launcher assembly 1400 have a diameter that allows indexing darts 1450 having a collapsible annular protrusion engagement feature (e.g., indexing darts 200, 500, etc.) to be held with the annular protrusion in an extended configuration. In other words, the diameters may be greater than the effective diameter provided by the collapsible annular protrusion (e.g., dogs 201, 310, etc.). Moreover, in some embodiments, the diameter of the dart path may match the inner diameter of the tubing string into which the dart will be launched (e.g., tubing string 110 of FIG. 1).

In operation, the darts 1450 can be stacked in magazine housing 1411 from bottom to top in order of decreasing target seat count. Thus, in FIG. 14A, indexing dart 1450*a* will be configured with a higher target seat count than indexing dart 1450*b*, dart 1450*b* will be configured with a higher target seat count than indexing dart 1450*c* and so on.

When the operator is ready to launch dart 1450*a*, the operator can open valve 1420 and valve 1425 and activate dart actuator assembly 1414*a* to move the respective dart holder to a dart release position. In the arrangement of FIG. 14A, dart 1450*a* will drop onto valve 1426. Valve 1425 can be closed to isolate magazine housing 1411 (valve 1425 may also be closed). Valve 1422 can be opened and fluid injected (e.g., through lines 1429). Pressure in dart launch area 1424 can be equalized through pressure line 1427. Valve 1426 can be opened to launch dart 1450*a* into the slipstream of the fluid injected in area 1428. The dart can be conveyed to the equipment below launcher 1400 (treatment head or other component). Valve 1426 (and potentially valve 1422) can be closed and the process repeated.

Dart launch assembly 1400 may also be used to trap darts. To this end, the upper end 1411*a* of magazine housing 1411 is coupled to cap 1430 housing a buffer spring 1432. Magazine assembly 1410 may also include one or more spring loaded check valves (not shown).

In operation, the spring loaded check valves can be closed. Valves 1420, 1426, 1425 and 1422 can be opened so that a dart conveyed up a tubing string can enter magazine housing 1411. The force of the dart hitting a check valve can open the check valve to allow the dart to pass. However, because the check valve is spring loaded, the check valve can close behind the dart. The dart will bounce up magazine housing 1411 until it contacts buffer spring 1432, at which point it can drop back down to land on a check valve that closed behind it.

Figure 14B:
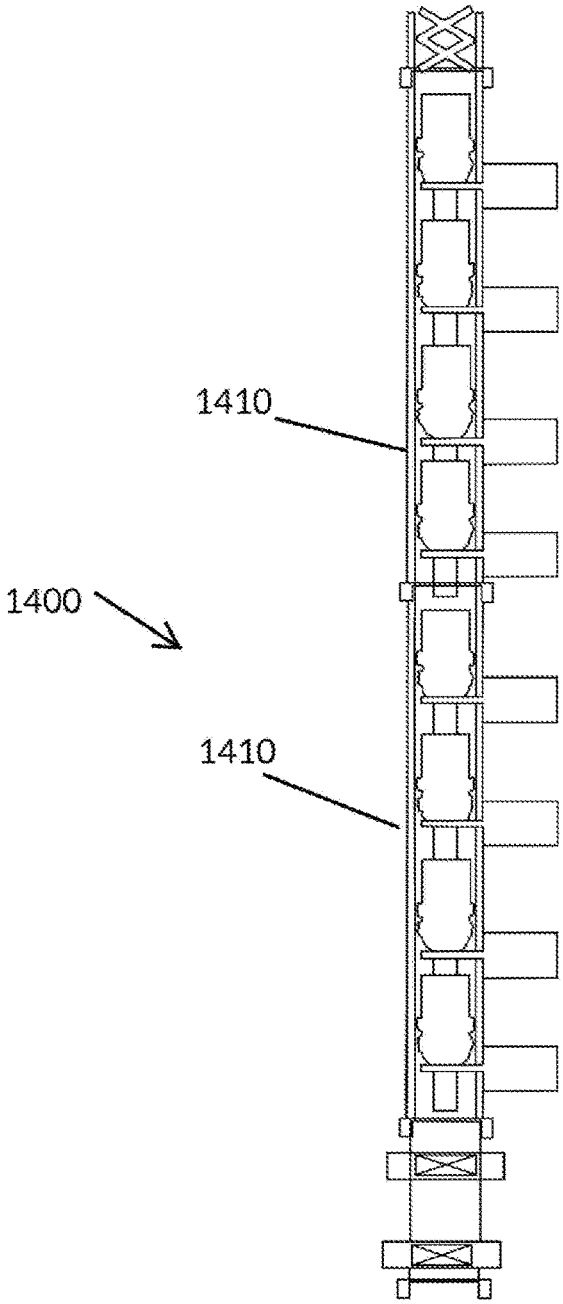

FIG. 14B illustrates that the capacity of a dart launch assembly 1400 to launch or trap darts can be increased by adding additional magazine assemblies 1410'.

FIG. 15 is a diagrammatic representation of one embodiment of a dart launch assembly 1500 incorporating an embodiment of dart launch assembly 1400 to launch darts 1450 into production tubing 1502 (e.g., tubing string 110 of FIG. 1).

In the embodiment of FIG. 15, assembly 1500 includes an upper component stack 1504 coupled to a support plate 1508 and a lower component stack 1506 coupled to a base plate 1510. Support plate 1508 that can be lowered onto or lifted off of a base plate 1510 by hydraulic rams 1512. When support plate 1508 and base plate 1510 are together, a continuous bore is formed from dart launch assembly 1400 to production tubing 1502.

With reference to lower stack 1506, lower stack 1506 extends from an upper end 1506*a* to a lower end 1506*b* and includes a stack of components coupled to the bottom of base plate 1510 (e.g., by a coupler 1514, such as a Bowen union or other coupler). In one embodiment, lower stack 1506 includes a master valve 1516 and a tubing head 1520. Lower stack 1506 may also include any number of other components such as valves, crosses, blowout preventers (BOPs), etc. (e.g., represented generally as lower stack components 1517 and 1519). Furthermore, lower stack 1506 may include components below tubing head 1520, such as a casing head and other components.

Production tubing 1502 is secured to lower stack 1506 using a tubing hanger 1530 secured in a tubing head 1520. In general, tubing hanger 1530 includes a cylindrical body that is shaped to seal with the walls of tubing head 1520. A tubing hanger central passage 1532 extends from the top end to the bottom end through the tubing hanger 1530 and a portion of production tubing 1502 extends through tubing hanger central passage 1532. Production tubing 1502 is secured to tubing hanger 1530. For example, tubing hanger central passage 1532 and the upper end portion of production tubing 1502 may include threads so that production tubing 1502 may be threaded into tubing hanger 1530.

Tubing hanger adapter flange 1524 provides an opening to create a fluid connection from components above tubing head 1520 to production tubing 1502. In the embodiment illustrated, tubing hanger adapter flange 1524 includes a central passage 1538 that extends from upper surface 1534 to lower surface 1536 of tubing hanger adapter flange 1524 and is aligned with tubing hanger central passage 1532. An internally threaded adapter flange connection 1542 extends upward from upper surface 1534 of tubing hanger adapter flange 1524. The threaded inner bore 1544 of internally threaded adapter flange connection 1542 aligns with tubing hanger central passage 1532 and has an inner diameter greater than the outer diameter of production tubing 1502. The upper end 1558 of production tubing 1502, in the embodiment illustrated, extends through tubing hanger adapter flange central passage 1538 such that production tubing 1502 extends from the base of adapter flange connection 1542 into the well. A threaded sealing sub 1580 is threaded into adapter flange connection 1542 to provide a seal with an isolation mandrel 1556, discussed below.

Turning briefly to upper stack 1504, dart launch assembly 1400 may be coupled (e.g., at coupler 1402) to a stack of one or more upper stack components 1554, such as valves, blowout preventers (BOP), frac heads or other treating heads, injector ports, crosses, etc. The inner bore of dart launch assembly 1400 can be connected (from a fluid flow perspective) to the inner bore of an isolation mandrel 1556, potentially through the inner bores of multiple upper stack components 1554 that create a dart flow passage from dart launch assembly 1400 to isolation mandrel 1556. Isolation mandrel 1556 is sized such that isolation mandrel 1556 extends through the lower stack inner bore to abut the upper end 1558 (or other portion) of production tubing 1502 when support plate 1508 and base plate 1510 are brought together. An externally threaded sealing sub 1580 that includes internal seals to seal against the outer surface of isolation mandrel 1556 can be threaded into threaded into adapter flange connection 1542. Sealing sub 1580 seals the connection between isolation mandrel 1556 and production tubing 1502.

Isolation mandrel 1556 can be a length of high pressure tubing used to isolate components in lower stack 1506 from the fracturing pressures and fluids. Thus, as would be appreciated by those of ordinary skill in the art, production components that cannot typically handle fracturing pressures and fluids can be installed in lower stack 1506.

According to one embodiment, the inner bore of dart launch assembly 1400, upper stack components 1554 and isolation mandrel 1556 can match (that is, they can be sufficiently close that they do not trigger the indexing mechanism of indexing darts 1450). Similarly, the inner bore of isolation mandrel 1556 may match the inner bore of production tubing 1502, again so that an indexing dart 1450 does not register a count at the connection between isolation mandrel 1556 and production tubing 1502. Thus, in one embodiment, dart launch assembly defines a dart flow path from the magazine having a matched inner diameter with production tubing 1502. The indexing dart 1450 can drop straight from dart launch assembly 1400 into production tubing 1502 without encountering any shoulders or other features that would register as a count.

In accordance with one broad aspect of the present disclosure, embodiments of indexing darts are provided. An indexing dart may include a body conveyable through the tubing string. The indexing dart may further include a collapsible annular protrusion extending radially outward from the body, the collapsible annular protrusion being configurable between a run in configuration and a landing configuration. A control mechanism further comprising an indexing mechanism may be carried on a radially outer side of a mandrel of the indexing dart. The indexing mechanism can be configured to register a dart seat count responsive to dart seat contact and the control mechanism can be configured to switch the dart between the run in configuration and landing configuration responsive to the indexing mechanism registering a target number of counts.

In the run-in configuration, the annular protrusion may be movable along a protrusion support in a first direction from an extended position to a collapsed position in response to dart seat contact.

According to one embodiment, the indexing mechanism comprises a longitudinally reciprocating sleeve that follows at least one guide slot. The at least one guide slot may be disposed on a radially outer surface of the mandrel. The longitudinally reciprocating sleeve may be operatively coupled to the annular protrusion and may actuate responsive to movement of the annular protrusion in the first direction to register a dart seat. The longitudinally reciprocating sleeve may move the annular protrusion in a second direction.

In accordance with one embodiment, the at least one guide slot comprises an upper guide slot and a lower guide slot and the reciprocating sleeve further comprises an upper indexing sleeve that follows the upper guide slot and a lower indexing sleeve that follows the lower guide slot. The upper indexing sleeve and lower indexing sleeve may be independently rotatable and separable in a separation angular orientation to create an open space. The upper guide slot and lower guide slot may have different walk rates to induce relative rotation between the upper indexing sleeve and lower indexing sleeve during translation. The positions of upper indexing sleeve in the upper guide slot and lower indexing sleeve in the lower guide slot may be configurable to set the target number of counts.

An indexing dart may include a locking mechanism operatively coupled to the indexing mechanism, wherein the locking mechanism is configured to lock the annular protrusion in an extended position in the landing configuration and wherein the indexing mechanism is configured to activate the locking mechanism responsive to registering the target number of counts.

In accordance with one embodiment, an indexing dart may comprise a sleeve locking member disposed radially inward of the reciprocating sleeve. In one embodiment, the sleeve locking member comprises a c-ring disposed in a sleeve locking member recess on an outer surface of the mandrel. The sleeve locking member may be selected to be movable at least partially into the open space to inhibit movement of the lower indexing sleeve. The upper indexing sleeve and lower indexing sleeve can be configured to separate to create the open space in a position aligned with the sleeve locking member. The reciprocating sleeve may be configured to prevent the sleeve locking member from moving radially outward when the upper indexing sleeve and lower indexing sleeve are not separated.

An indexing dart may include a biasing member that biases the lower indexing sleeve in the second direction to promote separation of the upper indexing sleeve and lower indexing sleeve.

An indexing dart may include a protrusion support sleeve movable along the mandrel from a first position in which the protrusion support sleeve supports the annular protrusion to a second position that allows the annular protrusion to collapse. A protrusion support locking member may be movable from a protrusion support locking configuration that prevents translation of the protrusion support sleeve to the second protrusion support position to a protrusion support release configuration that does not prevent the protrusion support sleeve from translating to the second position.

An indexing dart may comprise an inner sleeve defining a recess on an inner sleeve outer surface, the inner sleeve movable in a central bore of the mandrel from an initial position to a release position in which the recess is positioned to align with the protrusion support locking member to allow the protrusion support locking member to shift to the protrusion support release configuration.

According to another broad aspect of the present disclosure, a dart indexing system responsive to contact with dart seats is provided. The indexing system comprises a guide member providing an upper guide slot and a lower guide slot disposed around a circumference of the guide member. The indexing system further comprises a longitudinally reciprocating sleeve configured to respond to contact with a dart seat to count the dart seat. The reciprocating sleeve may comprise an upper indexing sleeve that follows the upper guide slot and a lower indexing sleeve that follows the lower guide slot. The upper indexing sleeve and lower indexing sleeve may be independently rotatable and may be separable when a target dart seat count is reached. The upper guide slot and lower guide slot can be configured to induce different amounts of rotation as the reciprocating sleeve actuates to cause relative rotation between the upper indexing sleeve and lower indexing sleeve.

In some embodiments, indexing system may have a maximum target count of 60-120.

In accordance with another broad aspect of the present disclosure, embodiments of recoverable darts are provided. A dart may include a body defining a central flow bore from an upper end to a lower end of the wellbore dart, the central flow bore adapted to allow circulation of fluid from a recovery tool through the wellbore dart. The dart may further include an internal valve to seal the central flow bore and a valve actuator configured to move from a first actuator position to a valve open position to selectively open the internal valve.

The central flow bore may comprise a central flow bore upper portion proximate to an upper opening. The central flow bore upper portion may have a lower opening with a smaller diameter than the upper opening. The central flow bore upper portion may define a recovery tool receiving area having a shape adapted to receive a tool nose. In one embodiment, the central flow bore upper portion is adapted to create a friction fit with the tool nose.

The central flow bore may further comprise a second portion extending forward from the upper portion of the central bore to the lower end of the wellbore dart, the second portion adapted to receive a latch tool extending from the tool nose. In one embodiment, the central flow bore upper portion continuously narrows from the upper opening to the lower opening of the central flow bore upper portion.

The dart may include a latch keeper feature defined in the second portion of the central flow bore.

The dart may comprise a mandrel at least partially defining the central flow bore. The dart may further comprise a tubular member having a tubular member central bore extending from a tubular member upper opening to a tubular member lower opening. The tubular member upper opening may be disposed in the mandrel. The mandrel and tubular member may cooperate to form at least a portion of the central flow bore through the wellbore dart. The internal valve may be disposed to seal the tubular member upper opening.

The valve actuator may include an inner sleeve disposed in the central flow bore, the inner sleeve adapted to move from an inner sleeve first position to an inner sleeve valve open position. The inner sleeve may comprise an inner sleeve lower end adapted to open the valve.

The dart may further include annular protrusion and a protrusion support. The protrusion support may be movable longitudinally from a supporting position to a disengagement position that disengages the annular protrusion. A protrusion support locking member may be disposed in an opening through a mandrel wall. The protrusion support locking member may be movable from a protrusion support locking position in which the protrusion support locking member prevents the movable protrusion support from moving to the disengagement position to a protrusion support release position that does not prevent the movable protrusion support from moving. The inner sleeve of the valve actuator may define a protrusion support locking member recess. The inner sleeve may be movable to an inner sleeve release position in which the protrusion support locking member recess aligns with the opening through the mandrel wall such that the protrusion support locking member shifts into the protrusion support locking member recess.

The inner sleeve may be adapted to move from the first position to the inner sleeve release position responsive to a differential pressure.

In accordance with one embodiment, the protrusion support is adapted to remain in the supporting position after the protrusion support locking member has moved to the protrusion support release position until pressure across the protrusion support approaches equalization.

The wellbore dart may further include a latch sleeve disposed in the central flow bore, the latch sleeve comprising a keeper feature adapted to engage with a recovery tool. A c-ring may be adapted to prevent the inner sleeve from moving from the inner sleeve release position to the valve open position. The latch sleeve can be adapted to move from a latch sleeve first position to a latch sleeve second position to expand the c-ring into a groove on an inner surface of the central flow bore. The latch sleeve can be adapted to push the inner sleeve from the inner sleeve release position to the valve open position.

The valve actuator may further comprise a valve actuation member disposed in the central flow bore, wherein the valve actuation member comprises a valve actuation member lower end adapted to open the internal valve. The actuation member may be disposed between the inner sleeve and the internal valve. The valve actuation member may also be disposed in the inner sleeve and be adapted to move relative to the inner sleeve from a first valve actuation member position to a second valve actuation member position. The valve actuation member is adapted to engage an inner surface of the inner sleeve in the second valve actuation member position. The valve actuation member may be adapted to move from the first valve actuation member position to the second valve actuation member position and then move together with the inner sleeve responsive to pushing to by a tool.

A wellbore dart may comprise a latch tool extending from a nose portion of the wellbore dart. The latch tool can be adapted to open an internal valve of another dart. The latch tool can be adapted to disengage a selective engagement feature of another dart.

A wellbore dart can be adapted to form a string of darts with at least one other dart, wherein the string of darts comprises a central flow bore through the string of darts adapted to allow circulation of fluid from the recovery tool through the string of darts.

A wellbore dart method may include running in a first wellbore dart in a valve closed configuration, the wellbore dart comprising a central flow bore and an internal valve; running in a recovery tool to the first wellbore dart to open the internal valve; and circulating fluid through the first wellbore dart using the recovery tool. The wellbore dart method may comprise pushing the first wellbore dart into a second wellbore dart to create a string of wellbore darts having a central flow passage running through the string of wellbore darts and pushing the string of wellbore darts down the wellbore or pulling the string of darts from a tubing string using the recovery tool.

According to another aspect of the present disclosure, a system for wellbore treatment that can include darts to activate tools in a tubing string. According to one embodiment, a system may include a tubing string having a long axis and comprising a plurality of sleeve assemblies spaced apart along the long axis. The system can further include a set of darts conveyable along the tubing string to land at the sleeve assemblies. Each of the sleeve assemblies may include an internal sliding sleeve with each of the internal sliding sleeves having the same diameter.

In accordance with one embodiment, the darts may be indexing darts. Each indexing dart can include an indexing mechanism to define which of the plurality of sleeve assemblies with which the indexing dart will engage. Each dart in the set of indexing darts can be configured to activate a different one of the plurality of sleeve assemblies. A dart launcher can be provided to launch the darts down the tubing string. The system may further include a dart trap adapted to catch darts conveyed up the tubing string.

The set of indexing darts is adapted to form a dart string. The set of indexing darts comprises a first indexing dart and a second indexing dart, the second indexing dart comprising a latch tool configured to engage the first indexing dart. The first indexing dart may have a rear entrance profile shaped to accept a nose of the second indexing dart. The first indexing dart and second indexing dart may be configured to cooperatively form a continuous central flow passage through which fluid can be circulated from a recovery tool. The second indexing dart may be configured to activate a disengagement mechanism of the first indexing dart.

The dart launcher may comprise a magazine configured to store the set of indexing darts for launching. The dart launcher may define a straight dart flow path from the magazine to the tubing string.

The dart launcher may comprise an isolation mandrel defining at least a portion of the dart flow path, the isolation mandrel adapted to isolate lower pressure wellhead equipment from higher pressures.

The system may include a tubing hanger supporting the tubing string, a tubing hanger adapter flange having an upwardly extending internally threaded connection a sealing sub disposed in the internally threaded connection about a lower end portion of the isolation mandrel. The sealing sub can be adapted to seal a connection between the isolation mandrel and the tubing string. The isolation mandrel and the upper portion of the tubing string may have matched inner diameters.

The system may comprise a recovery tool. The recovery tool can be configured to push the dart string down the tubing string or pull dart string up the tubing string. The recovery tool can also be adapted to circulate fluid through the dart string.

In accordance with another aspect of the present disclosure, a method for treatment of a wellbore is provided. In one embodiment, the method can include inserting a tubing string in the wellbore, the tubing string having a long axis and comprising a plurality of sleeve assemblies spaced apart along the long axis, each of the plurality of sleeve assemblies having at least one port in a port closed position; providing a set of indexing darts, each indexing dart configurable to land at any of the sleeve assemblies, each indexing dart defining a central fluid flow bore and comprising an engagement feature and an indexing mechanism; configuring a first indexing dart in the set of indexing darts to target a first sleeve assembly from the plurality of sleeve assemblies using the indexing mechanism of the first indexing dart; conveying the first indexing dart down the tubing string to the first sleeve assembly to actuate the first sleeve assembly; actuating the first sleeve assembly to its port open position using the first indexing dart; configuring a second indexing dart in the set of indexing darts to target a second sleeve assembly from the plurality of sleeve assemblies using the indexing mechanism of the second indexing dart; conveying the first indexing dart down the tubing string to the second sleeve assembly; and actuating the second sleeve assembly to its port open position using the second indexing dart. The first indexing dart and second indexing dart may be launched as part of a continuous fracturing operation.

The method may include loading the first indexing dart and second indexing dart in a magazine in an order corresponding to increasing target seat count; launching the first indexing dart from the magazine into the tubing string; and launching the second indexing dart from the magazine into the tubing string after actuating the first sleeve assembly.

The method may include isolating a set a wellhead equipment using an isolation mandrel run through a set of wellhead equipment; sealing a connection between the isolation mandrel and an upper portion of the tubing string; and launching the first indexing dart and second indexing dart into the tubing string through the isolation mandrel. The isolation mandrel may be diameter matched with the upper portion of the tubing string.

In accordance with one embodiment, the method may include running in a recovery tool and disengaging the second indexing dart using the recovery tool. The method may further include pushing the second indexing dart into the first indexing dart to create a string of indexing darts. The method may further include circulating fluid from the recovery tool through a central flow passage formed through the string of indexing darts by the central fluid flow bores of the first indexing dart and second indexing dart. The second indexing dart may be used pull the first indexing dart to surface. The first indexing dart and second indexing dart may be captured at surface in a dart trap.

According to another broad aspect of the present disclosure, embodiments provide a wellbore sliding sleeve assembly. The wellbore sliding sleeve assembly comprises a tubular body comprising an outer wall defining a port through the outer wall and a port sleeve assembly configurable in a port-closed configuration in which the port through the outer wall is blocked, a port-open configuration in which the port through the outer wall is fully open to fluid flow therethrough and a port-screened configuration in which the port through the outer wall is open and covered with a screen. In one embodiment, the screen may be disposed radially inward of the outer wall in the port-screened configuration.

The port sleeve assembly may comprise a screen sleeve comprising a screened port positioned to align with the port through the outer wall when in the port-screened configuration and a port cover sleeve comprising a port cover adapted to cover the port through the outer wall when in the port-closed configuration. The screen sleeve can be adapted to be movable from a screen sleeve first position in which screened port aligns with the port through the outer wall to a screen sleeve second position in which the screened port does not align with the port through the outer wall. The screen sleeve second position can correspond to the port-closed and port-screened configurations.

The port cover sleeve can be adapted to be movable from a port cover sleeve first position in which the port cover is aligned with the port through the outer wall to a port cover sleeve second position in which the port cover is not aligned with the port through the outer wall.

According to one embodiment, in the port-closed configuration, the screen sleeve is in the screen sleeve first position and the port cover sleeve is in the port cover sleeve first position; in the port-open configuration, the screen sleeve is in the screen sleeve second position and the port cover sleeve is in the port cover sleeve second position; and in the port-screened configuration, the screen sleeve is in the screen sleeve first position and the port cover sleeve is in the port cover sleeve second position.

The screen sleeve may be concentrically arranged about the port cover sleeve. According to one embodiment, the port cover sleeve is adapted such that the port cover closes to a radially inner side of the screen sleeve. The port cover sleeve can cooperate with seals between the port cover sleeve and the screen sleeve and seals between the screen sleeve and the outer wall to seal the port through the outer wall.

A wellbore sliding sleeve method may comprise running a sliding sleeve assembly into a well in a port-closed configuration; actuating a port sleeve assembly in the sliding sleeve assembly to open a stimulation port at the sliding sleeve assembly; injecting stimulation fluid into an annulus through the stimulation port; reconfiguring the port sleeve assembly to cover the stimulation port with a screen; and using the stimulation port as a production port. The method may further comprise reclosing the stimulation port with the port sleeve assembly.

Although the invention has been described with respect to specific embodiments thereof, these embodiments are merely illustrative, and not restrictive of the invention. Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

As used herein, the terms "comprises," "comprising," "includes," "including," "has," "having," or any other variation thereof, are intended to cover a non-exclusive inclusion. For example, a process, product, article, or apparatus that comprises a list of elements is not necessarily limited only those elements but may include other elements not expressly listed or inherent to such process, product, article, or apparatus.

Furthermore, the term "or" as used herein is generally intended to mean "and/or" unless otherwise indicated. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural). Also, as used in the description herein, the meaning of "in" includes "in" and "on" unless the context clearly dictates otherwise.

What is claimed is:

1. A wellbore dart configured to target a location in a wellbore, the dart comprising:

a body conveyable through a tubing string, the body defining a central flow bore from an upper end to a lower end of the wellbore dart adapted to allow circulation of fluid from a tool through the wellbore dart;

an internal valve to seal the central flow bore;

a valve actuator, the valve actuator adapted to move from a first actuator position to a valve open position to selectively open the internal valve;

a collapsible annular protrusion extending radially outward from the body, the collapsible annular protrusion being configurable between a run-in configuration and a landing configuration; and a control mechanism further comprising an indexing mechanism, the indexing mechanism configured to register a dart seat count responsive to dart seat contact and the control mechanism configured to switch the dart between the run-in configuration and landing configuration responsive to the indexing mechanism registering a target number of count, wherein the central flow bore comprises:

a central flow bore upper portion proximate to an upper opening, the central flow bore upper portion having a lower opening with a smaller diameter than the upper opening, the central flow bore upper portion defining a recovery tool receiving area having a shape adapted to receive a tool nose; and a central flow bore second portion extending forward from the central flow bore upper portion, the central flow bore second portion adapted to receive a latch tool extending from the tool nose.

2. The wellbore dart of claim 1, further comprising a locking mechanism operatively coupled to the indexing mechanism, wherein the locking mechanism is configured to lock the annular protrusion in an extended position in the landing configuration and wherein the indexing mechanism is configured to activate the locking mechanism responsive to registering the target number of counts.

3. The wellbore dart of claim 1 further comprising a disengagement mechanism configured to disengage the annular protrusion.

4. The wellbore dart of claim 1, wherein the indexing mechanism comprises a longitudinally reciprocating sleeve operatively coupled to the annular protrusion, the reciprocating sleeve configured to actuate responsive to movement of the annular protrusion in a first direction to register a dart seat, to move the annular protrusion in a second direction and to follow at least one guide slot.

5. The wellbore dart of claim 1, further comprising a latch keeper feature defined in the central flow bore second portion.

6. The wellbore dart of claim 1, wherein the wellbore dart is adapted to form a string of darts with at least one other dart, wherein the string of darts comprises a central flow passage through the string of darts through which fluid can be circulated.

7. The wellbore dart of claim 1, further comprising a mandrel at least partially defining the central flow bore, wherein the indexing mechanism is disposed on the outside of the mandrel.

8. A wellbore dart configured to engage a target dart seat in a wellbore comprising:

a body with a central flow bore, a nose section at the downhole end and a rear section at the uphole end, the rear section adapted to receive a nose section of an uphole indexing dart;

a collapsible annular protrusion extending radially outward from the body, configurable between a run-in configuration and a landing configuration;

a control mechanism adapted to identify the target dart seat based on a dart seat count and to switch the collapsible annular protrusion from the run-in configuration to the landing configuration when a target dart seat count has been reached; and a latch tool with a tubular body adapted to be engaged in the nose section of the body, the latch tool having an inner bore aligned axially with the central flow bore.

9. The wellbore dart of claim 8, wherein the control mechanism comprises an indexing mechanism configured to register a dart seat count each time the indexing dart passes by a dart seat uphole from the target dart seat.

10. The wellbore dart of claim 9, wherein the control mechanism further comprises a contact feature that causes actuation of the indexing mechanism responsive to contact with each dart seat uphole from the target dart seat.

11. The actuation dart of claim 9, wherein the indexing mechanism comprises a plurality of guide slots for enabling the dart seat count.

12. The wellbore dart of claim 8, wherein the nose section of the wellbore dart is adapted to be received into the rear section of a downhole wellbore dart for enabling the latch tool to engage the downhole wellbore dart.

13. The wellbore dart of claim 8, further comprising:

an internal valve arranged in the central flow bore to allow and disallow fluid flow through the central flow bore; and a valve actuator adapted to close the internal valve to disallow fluid flow through the central flow bore, and to open the internal valve to allow fluid flow through the central flow bore.

14. The wellbore dart of claim 13, wherein the internal valve is opened by the valve actuator when the collapsible annular protrusion is in the run-in configuration.

15. The wellbore dart of claim 13, wherein the internal valve is closed by the valve actuator when the collapsible annular protrusion is in the landing configuration.

16. The wellbore dart of claim 13, wherein the internal valve is opened to allow cleaning of the wellbore from debris and sand.

* * * * *